US006603263B1

(12) United States Patent
Hashimoto et al.

(10) Patent No.: US 6,603,263 B1
(45) Date of Patent: Aug. 5, 2003

(54) AC PLASMA DISPLAY PANEL, PLASMA DISPLAY DEVICE AND METHOD OF DRIVING AC PLASMA DISPLAY PANEL

(75) Inventors: Takashi Hashimoto, Tokyo (JP); Yasutaka Inanaga, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 84 days.

(21) Appl. No.: 09/688,362

(22) Filed: Oct. 12, 2000

(30) Foreign Application Priority Data

Nov. 9, 1999 (JP) ..... P11-317914

(51) Int. Cl.[7] ..... H01J 11/00; G09G 3/28

(52) U.S. Cl. ..... 313/584; 313/582; 313/586; 345/60

(58) Field of Search ..... 313/581, 582, 313/583, 584, 585, 586, 587; 315/169.4; 345/41, 55, 60

(56) References Cited

U.S. PATENT DOCUMENTS

| | | | | | |
|---|---|---|---|---|---|
| 4,060,749 | A | * | 11/1977 | Shinada et al. | 313/484 |
| 5,659,226 | A | * | 8/1997 | Shigeta et al. | 313/491 |
| 5,825,128 | A | * | 10/1998 | Betsui et al. | 313/582 |
| 6,075,578 | A | * | 6/2000 | Hayashi et al. | 313/32 |
| 6,118,214 | A | * | 9/2000 | Marcotte | 313/582 |
| 6,281,628 | B1 | * | 8/2001 | Choi et al. | 313/585 |
| 6,373,195 | B1 | * | 4/2002 | Whang et al. | 313/169.3 |
| 6,376,986 | B1 | * | 4/2002 | Takagi et al. | 313/582 |
| 2002/0027418 | A1 | * | 3/2002 | Huang et al. | 313/584 |

FOREIGN PATENT DOCUMENTS

| | | |
|---|---|---|
| JP | 5-2993 | 1/1993 |
| JP | 6-12026 | 1/1994 |
| JP | 6-289811 | 10/1994 |
| JP | 7-140922 | 6/1995 |
| JP | 7-160218 | 6/1995 |
| JP | 7-287548 | 10/1995 |
| JP | 9-160525 | 6/1997 |
| JP | 9-231907 | 9/1997 |
| JP | 10-149774 | 6/1998 |
| JP | 2000-311615 | 11/2000 |
| KR | 2000-67805 | 11/2000 |

OTHER PUBLICATIONS

O. Toyoda, et al., IDW, pp. 599–602, "A High Performance Delta Arrangement Cell PDP With Meander Barrier Ribs", 1999.

* cited by examiner

*Primary Examiner*—Ashok Patel
(74) *Attorney, Agent, or Firm*—Oblon, Spivak, McClelland, Maier & Neustadt, P.C.

(57) ABSTRACT

Column electrodes W1 to Wm are arranged on the side of a rear glass substrate along a first direction D1 at regular intervals. Row electrodes X1 to Xn and Y1 to Yn include (a) strip bus electrodes Xb1 to Xbn and Yb1 to Ybn alternately arranged on a surface of a front glass substrate closer to discharge spaces at regular pitches to extend in a second direction D2 and (b) square transparent electrodes Xt and Yt having ends connected to the bus electrodes Xb1 to Xbn and Yb1 to Ybn respectively. The transparent electrodes Xt and Yt alternately extend into single ones of unit areas AR adjacent to each other in the first direction D1 through the bus electrodes Xbi and Ybi connected with the ends thereof. The unit areas AR are separated into discharge cells C having discharge gaps defined by opposite edges of the transparent electrodes Xt and Yt and non-discharge cells NC having no discharge gaps. The discharge gaps C are not adjacent to each other in the first and second directions D1 and D2. Thus provided is an AC-PDP capable of suppressing/avoiding false discharge.

20 Claims, 29 Drawing Sheets

52

57A

AC PLASMA DISPLAY PANEL, PLASMA DISPLAY DEVICE AND METHOD OF DRIVING AC PLASMA DISPLAY PANEL

BACKGROUND OF THE INVENTION

1. Field of the Invention

The present invention relates a structure of and a method of driving an AC plasma display panel (hereinafter also referred to as "AC-PDP") and a plasma display device.

2. Description of the Background Art

Various researches are made on plasma display panels (PDP) as thin-type television or display monitors. AC-PDPs having memory functions include a surface discharge AC-PDP. The structure of this AC-PDP is now described with reference to FIG. 25.

FIG. 25 is a perspective view extracting and showing part of the structure of an AC-PDP 101 according to first background art. For example, Japanese Patent Application Laid-Open No. 7-140922 (1995) or Japanese Patent Application Laid-Open No. 7-287548 (1995) discloses an AC-PDP having such a structure. As shown in FIG. 25, the AC-PDP 101 comprises a front glass substrate 102 serving as a display surface and a rear glass substrate 103 opposed to the front glass substrate 102 through discharge spaces 111. While the glass substrates 102 and 103 are so arranged that the top portions of barrier ribs 110 are in contact with a dielectric layer 106A described later, FIG. 25 illustrates the glass substrates 102 and 103 in a separated state for convenience of illustration. This also applies to FIGS. 28 and 29 described later.

On a surface of the front glass substrate 102 closer to the discharge spaces 111, n row electrodes 104 and n row electrodes 105 (both are transparent electrodes) paired with each other are extended/formed. When metal auxiliary electrodes (also referred to as "bus electrodes") 104*a* and 105*a* having low impedance for supplying a current from a circuit part are provided on partial surfaces of the row electrodes 104 and 105 respectively as shown in FIG. 25, the respective ones are referred to as "row electrodes 104" and "row electrodes 105" inclusive of the metal auxiliary electrodes respectively. The dielectric layer 106 is formed to cover both row electrodes 104 and 105. A protective film 107 of a dielectric substance such as MgO (magnesium oxide) may be formed on the surface of the dielectric layer 106 by a method such as vapor deposition as shown in FIG. 25, and the dielectric layer 106 and the protective film 107 are also generically referred to as "dielectric layer 106A" in this case.

On the surface of the rear glass substrate 103 closer to the discharge spaces 111, on the other hand, m column electrodes 108 are extended/formed to (grade-separately) intersect with the row electrodes 104 and 105, and the barrier ribs 110 are extended/formed between the adjacent ones of the column electrodes 108 in parallel with the column electrodes 108. The barrier ribs 110 separate respective discharge cells from each other while supporting the AC-PDP 101 not to be crushed under the atmospheric pressure.

A phosphor layer 109R for emitting red (R) light, a phosphor layer 109G for emitting green (G) light and a phosphor layer 109B for emitting blue (B) light (these phosphor layers 109R, 109G and 109B are also referred to as "phosphor layers 109") are arranged in U-shaped trenches defined by the aforementioned surface of the rear glass substrate 103 and opposite side wall surfaces of the adjacent barrier ribs 110 in prescribed order to cover the column electrodes 108 in the form of stripes. There is also an ACP-DP having such a structure that a dielectric layer is provided on the aforementioned surface of the rear glass substrate 103 to cover the column electrodes 108 so that the barrier ribs 110 and the phosphor layers 109 are arranged on this dielectric layer.

The front glass substrate 102 and the rear glass substrate 103 having the aforementioned structures are sealed to each other along peripheral edge portions (not shown in FIG. 25) so that spaces (the discharge spaces 111) between the glass substrates 102 and 103 are filled with discharge gas such as an Ne—Xe gas mixture or an He—Xe gas mixture under pressure below the atmospheric pressure. In the AC-PDP 101, the grade-separate intersection between each pair of row electrodes 104 and 105 and each column electrode 108 defines a discharge cell (also referred to as "luminous cell" or "display cell"). In a full color display PDP such as the AC-PDP 101, three discharge cells for emitting red light, green light and blue light form a single pixel. In this case, FIG. 25 shows the structure of the AC-PDP 101 for the single pixel.

In the following description, a transverse line of a luminous color obtained by lighting luminous cells of all luminous colors or arrangement of pixels necessary for displaying the transverse line is referred to as "display line". The AC-PDP 101 can light or select (discharge cells belonging to) a single display line when applying a prescribed voltage to a pair of row electrodes 104 and 105. Such arrangement that three discharge cells forming a single pixel are transversely aligned with each other may also be referred to as "stripe arrangement".

In the AC-PDP 101, the discharge spaces 111, divided by the barrier ribs 110, extending along the longitudinal direction of the column electrodes 108 can be separated into (i) "luminous area" or "display area" forming discharge cells to which the pairs of electrodes 104 and 105 belong and (ii) "non-luminous area" or "non-display area" between an adjacent pair of electrodes 104 and 105 (or each adjacent area of a plurality of discharge cells arranged along the aforementioned longitudinal direction) irrelevant to display luminescence of the PDP. In the following description, the structure forming the non-luminous area in the discharge spaces 111, i.e., the structure between discharge cells adjacent along the longitudinal direction of the column electrodes 108 is referred to as "non-discharge cell (or non-luminous cell or non-display cell)" with respect to the luminous area forming the discharge cell for convenience.

Among gaps between the adjacent row electrodes 104 and 105, (i) a gap between two row electrodes 104 and 105 forming discharge in the discharge cell in a paired manner is referred to as "discharge gap DG" while (ii) a gap between two opposite row electrodes 104 and 105 belonging to adjacent discharge cells respectively is referred to as "non-discharge gap NG". While the non-discharge cell has the discharge space 111 (non-discharge area) defined by the intersection between two row electrodes 104 and 105 (belonging to adjacent discharge cells respectively) and the column electrode 108 similarly to the discharge cell, the distance between the non-discharge gaps NG is so widely set as not to cause discharge in the AC-PDP 101.

Black insulating materials may be arranged on the aforementioned non-discharge cells. In this case, the black insulating materials, arranged in the form of stripes to appear as black transverse lines on the display surface of the PDP, may also be referred to as "black stripes". Thus, it is possible to improve contrast having been problematic since the phosphor material itself is white in a non-luminous state by blackening non-luminous cells irrelevant to image display.

An AC-PDP 201 according to second background art is now described with reference to FIGS. 26 and 27. FIG. 26 is a plan view of the AC-PDP 201 according to the second background art, and FIG. 27 is a longitudinal sectional view taken along the line-I—I in FIG. 26. For example, Japanese Patent Application Laid-Open No. 6-12026 (1994) discloses an AC-PDP having such a structure. As shown in FIGS. 26 and 27, the AC-PDP 201 comprises a front glass substrate 202 serving as a display surface and a rear glass substrate 203 opposed to the front glass substrate 202 through discharge spaces 211. Row electrodes 204 and 205 are alternately formed on the surface of the front glass substrate 202 closer to the discharge spaces 211 at regular intervals. The row electrodes 204 and 205 may be formed by combination of transparent electrodes and bus electrodes similarly to the aforementioned AC-PDP 101, and the electrodes consisting of transparent electrodes and bus electrodes are also referred to as "row electrodes 204 and 205" in this case. A dielectric layer 206 and a protective film 207 (also generically referred to as "dielectric layer 206A") are successively formed on the row electrodes 204 and 205.

Column electrodes 208 are extended/formed on the rear glass substrate 203 to (grade-separately) intersect with the row electrodes 204 and 205, and a dielectric layer 212 is formed to cover the column electrodes 208. The glass substrates 202 and 203 are opposed to each other through barrier ribs 210. As shown in FIG. 26, the space between the glass substrates 202 and 203 is divided into a plurality of hexagonal discharge spaces 211 by the glass substrates 202 and 203 and the barrier ribs 210. The barrier ribs 210 are so arranged that the centers of the respective discharge spaces 211 substantially match with the intersections of the gaps between the adjacent row electrodes 204 and 205 and the column electrodes 208 in the plan view shown in FIG. 26. In the AC-PDP 201, the respective gaps between the adjacent row electrodes 204 and 205 define discharge gaps DG, with no presence of non-discharge gaps, i.e., non-discharge cells. Thus, each discharge cell defined by the intersection between each pair of row electrodes 204 and 205 and each column electrode 208 is enclosed with the barrier ribs 210 and separated from adjacent discharge cells in the AC-PDP 201. As shown in FIG. 26, each column electrode 208 consists of a part opposed to the discharge spaces 211 and a part opposed to the barrier ribs 210, and these parts are alternately repeated at a pitch half that of the discharge cells arranged along the longitudinal direction of the column electrodes 208.

Phosphor layers 209 of the same luminous color are applied onto the dielectric layer 212 and to (parts of) the side wall surfaces of the barrier ribs 210 in the plurality of discharge cells arranged along each column electrode 208. In other words, a plurality of discharge cells for a luminous color of red (R), green (G) or blue (B) are arranged along each column electrode 208. In other words, each column electrode 208 corresponds to a single luminous color (or display color). In the AC-PDP 210, therefore, three discharge cells (FIG. 26 shows exemplary arrangement by symbols R, G and B) for respective luminous colors arranged in the form of a delta form a pixel for white display, and such arrangement of the discharge cells may also be referred to as "delta arrangement". The remaining structure such as discharge gas is similar to that of the first background art.

The AC-PDP 101 (and AC-PDPs 301 and 401 described later) having the discharge cells of stripe arrangement and the AC-PDP 210 having the discharge cells of delta arrangement are compared with each other for describing the difference between the structures thereof.

A. Electrode Arrangement

The AC-PDP 101 can light the respective luminous cells of red, green and blue by controlling a voltage applied to the column electrodes 108 when applying a prescribed voltage to a pair of row electrodes 104 and 105. In other words, the pair of row electrodes 104 and 105 corresponds to a single display line.

In the AC-PDP 201, on the other hand, a single pixel is formed by discharge cells for respective luminous colors arranged in the form of a delta and the respective discharge cells are arranged with displacement by half the pitch of arrangement thereof. In order to light (luminous cells belonging to) a single display line, therefore, a voltage must be applied to three continuously arranged row electrodes, i.e., a pair of row electrodes 204 and 205 and still another row electrode 204 (or 205) adjacent thereto.

An AC-PDP 301 according to third background art is now described with reference to a perspective view of FIG. 28. For example, Japanese Patent Application Laid-Open No. 5-2993 (1993) discloses the structure of the AC-PDP 301. In the following description, elements of the AC-PDP 301 similar to those of the aforementioned AC-PDP 101 (see FIG. 25) are denoted by the same reference numerals. As shown in FIG. 28, the AC-PDP 301 has barrier ribs 110R arranged on the side of a rear glass substrate 103, barrier ribs 1101F1 arranged on the side of a front glass substrate 103 and stripe barrier ribs 1101F2 arranged perpendicularly thereto, in correspondence to the barrier ribs 110 of the AC-PDP 101 shown in FIG. 25. In this case, the barrier ribs 110F2 separate a plurality of discharge cells arranged along the barrier ribs 110F1 and 110R from each other.

In the AC-PDP 301, row electrodes 104 and 105S are formed immediately under the barrier ribs 110F2 at regular pitches as shapes extending over two discharge cells adjacent to each other through the barrier ribs 110F2. In other words, the row electrodes 104 and 105 of the AC-PDP 301 have such shapes that two row electrodes located at the center among two pairs of row electrodes (four in total) in the aforementioned AC-PDP 101 shown in FIG. 25 are integrated with each other. In the AC-PDP 301, the plurality of row electrodes 104 (or 105) are grouped into even and odd electrodes respectively and driven in units of the groups.

For example, Japanese Patent Application Laid-Open No. 9-160525 (1997) discloses an AC-PDP having a row electrode structure similar to that of the AC-PDP 301. Such an AC-PDP is now described with reference to a perspective view of FIG. 29 as an AC-PDP 401 according to fourth background art. In the AC-PDP 401, elements equivalent to those of the AC-PDP 101 are denoted by the same reference numerals. As shown in FIG. 29, the AC-PDP 401 has no barrier ribs 110F1 and 110F2 of the AC-PDP 301 shown in FIG. 28.

The AC-PDP 401 is driven by a driving circuit similar to that for the AC-PDP 301 as follows: A driving method of separating one frame period into an odd field and an even field and selecting a discharge cell, i.e., the so-called interlaced scanning is performed on the AC-PDP 401, thereby preventing interference on discharge between discharge cells adjacent to each other along column electrodes 108. Thus, no barrier ribs parallel to row electrodes 104 and 105 are necessary for separating the discharge cells adjacent to each other along the column electrodes 108. Therefore, the AC-PDP 401 having a structure substantially similar to that of the aforementioned AC-PDP 101 is higher in resolution than the AC-PDP 101.

B. Shape of Barrier Rib

When a single row electrode 104 or 105 extends over two discharge cells (or two display lines) adjacent to each other along the longitudinal direction of the column electrodes 108 as in the AC-PDP 301 shown in FIG. 28, barrier ribs must be basically arranged along the widths or the central axes of shorter sides of the row electrodes which are strip electrodes (in addition to barrier ribs parallel to the column electrodes) for separating the two adjacent cells from each other. When phosphor layers 109 are extended/formed in parallel with the column electrodes 108 (perpendicularly to the row electrodes 104 and 105) as in the AC-PDP 401 shown in FIG. 29, i.e., when discharge cells for respective luminous colors are in stripe arrangement, the barrier ribs 110F2 along the display lines can be eliminated by performing interlaced scanning as described above.

When the discharge cells for the respective luminous colors are in delta arrangement as in the AC-PDP 201 shown in FIGS. 26 and 27, on the other hand, the barrier ribs 210 cannot be eliminated since the phosphor layers 209 for the respective luminous colors are jumbled in the direction parallel to the column electrodes 208. In other words, the barrier ribs having the shapes enclosing the respective discharge cells are inevitably necessary.

Comparing the shapes of the barrier ribs in view of manufacturing processes for the PDPs, (a) the stripe barrier ribs of the AC-PDP 101 shown in FIG. 25 or the like are superior to (b) the barrier rib shapes of the AC-PDP 201 shown in FIGS. 26 and 27. This point is now described.

Comparing the PDPs in relation to formation of the phosphor layers, (a) phosphors for prescribed luminous colors may be applied along the aforementioned U-shaped trenches defined by the barrier ribs 110 and the like in units of the U-shaped trenches when the barrier ribs 110 are in the form of stripes as in the AC-PDP 101 shown in FIG. 25, and hence alignment with respect to the barrier ribs 110 in the phosphor application step is easy. On the other hand, (b) phosphors of the respective luminous colors must be applied with the pitch half that of arrangement of the discharge cells in the case of the shapes of the barrier ribs 210 shown in FIGS. 26 and 27, and hence higher alignment accuracy than that in the phosphor application step for the AC-PDP 101 or the like is required.

In an exhaust step for the space (discharge spaces) between the front and rear glass substrates bonded to each other and a discharge gas introduction step, (a) the stripe barrier ribs 110 provided in the AC-PDP 101 or the like are more preferable than (b) the barrier ribs 210 provided in the AC-PDP 201 for dividing the aforementioned space into completely enclosed discharge spaces, due to small conductance.

Also in view of discharge control in the PDP, the stripe barrier ribs 110 of the AC-PDP 101 or the like are more advantageous. In an AC-PDP having stripe barrier ribs, charged particles caused by discharge quickly spread along the longitudinal direction of the barrier ribs so that discharge controllability in address discharge, for example, can be improved by utilizing such charged particles.

C. Display Area Utilization Factor

In a display panel such as a PDP, resolution depends on the number of display cells formed in a prescribed display area. The resolution is increased as the number of display cells formed in a restricted display area is increased. In the case of the same resolution, the area of the display cells is preferably maximized for improving luminous efficiency of the display cells and the PDP. Therefore, it is preferable to maximize the area (display area) of a part related to image display and minimize the area (non-display area) of a part irrelevant to image display. In consideration of this point, it can be said that the structure of the AC-PDP 201 is desirable in view of luminous efficiency and resolution since (a) the AC-PDP 101 shown in FIG. 25 has non-discharge cells which are non-display areas while (b) the AC-PDP 201 shown in FIGS. 26 and 27 has no non-display areas.

When performing interlaced scanning and driving the AC-PDP 401 shown in FIG. 29, areas corresponding to the non-discharge cells of the AC-PDP 101 shown in FIG. 25 are utilized as discharge cells, more desirably in the point of resolution as compared with the AC-PDP 201. When performing interlaced scanning, upper and lower display lines adjacent to a certain display line are not lighted while the certain discharge cell is lighted, and hence the total area of light-controlled luminous cells is instantaneously equivalent to that of the AC-PDP 101. The time for lighting a single pixel by interlaced scanning is half that in the driving method not utilizing areas of non-discharge cells as discharge cells, and hence driving must be performed at a frequency twice that in such a driving method in order to attain desired luminance.

The display operation principle of the aforementioned AC-PDP 101 (or 201) is now described. First, a voltage pulse is applied across the pair of row electrodes 104 and 105 (or 204 and 205) for causing discharge. Ultraviolet rays resulting from this discharge excite the phosphor layers 109 (209) so that the discharge cells luminesce. Electrons and ions generated in the discharge spaces during this discharge move toward the row electrodes 104 and 105 (204 and 205) having opposite polarity thereto and are stored on the surface of the dielectric layer 106A (206A) located on the row electrodes 104 and 105 (204 and 205). Charges such as the electrons and ions thus stored on the surface of the dielectric layer 106A (206A) are referred to as "wall charges".

An electric field formed by the wall charges acts to weaken an electric field formed by the voltage applied across the row electrodes 104 and 105 (204 and 205), and hence the discharge rapidly disappears following formation of the wall charges. When applying a voltage pulse reversed in polarity across the row electrodes 104 and 105 (204 and 205) after the discharge disappears, discharge can be caused again since an electric field formed by superposition of the applied electric field and an electric field formed by wall charges is substantially applied to the discharge spaces. Thus, once discharge is caused, discharge can be caused again by applying a lower applied voltage (hereinafter also referred to as "sustain voltage") than the firing voltage, whereby discharge can be stationarily sustained by successively applying sustain voltages (hereinafter also referred to as "sustain pulses") reversed in polarity across the row electrodes 104 and 105 (204 and 205). This discharge is hereinafter referred to as "sustain discharge".

This sustain discharge is maintained so far as the sustain pulses are applied until the wall charges disappear. An operation of making the wall charges disappear is referred to as "erasing", while an operation of forming wall charges on the dielectric layer 106A (206A) in the initial stage of discharge is referred to as "writing". Therefore, characters, figures, images and the like can be displayed by first performing writing on arbitrary discharge cells on the screen of the AC-PDP and thereafter performing sustain discharge. Further, motion pictures can also be displayed by performing writing, sustain discharge and erasing at a high speed.

A more specific method of driving the conventional PDP is now described with reference to FIG. 30. For example, Japanese Patent Application Laid-Open No. 7-160218 (1995) (or Japanese Patent No. 2772753) discloses a method of driving the conventional AC-PDP 101 (see FIG. 25). FIG. 30 is a timing chart showing waveforms of driving voltages in a single subfield (SF) in the driving method. In the following description, each of n row electrodes 104 is referred to as "row electrode Xi" (i=1 to n) and each of n row electrodes 105 is referred to as "row electrode Yi" (i=1 to n), while n row electrodes Y1 to Yn are collectively referred to as "row electrodes Y" assuming that all row electrodes Y1 to Yn are driven with a single driving signal (voltage). Further, each of m column electrodes 108 is referred to as "column electrode Wj" (=1 to m).

The subfield (SF) shown in FIG. 30 is one of a plurality of periods obtained by dividing a single frame (F) for image display. The subfield is further divided into three periods, i.e., "reset period", "address period" and "sustain discharge period (also referred to as a sustain period or a display period)".

In the "reset period", a display history at an end point of a preceding subfield is erased while priming particles for improving discharge probability in the subsequent address period are supplied. More specifically, a full writing pulse Vp having a voltage value capable of causing self-erase discharge on the trailing edge thereof is applied across all row electrodes X1 to Xn and row electrodes Y thereby erasing the display history. At this time, a voltage pulse Vp1 is applied to the column electrode Wj.

In the "address period", only discharge cells to be displayed are selectively discharged by selecting a matrix for forming "address discharge" on the discharge cells. More specifically, a scan pulse Vxg (voltage value Vxg (<0)) is successively applied to the row electrodes Xi and a voltage pulse VwD (voltage value VwD (>0)) based on image data is applied to the column electrode(s) Wj in the discharge cell(s) to be lighted, thereby causing "writing discharge" between the column electrode Wj and the row electrode Xi. During the address period, a subscan pulse Vysc (voltage value Vysc (>0)) is applied to the row electrodes Y. At this time, a potential difference (Vysc−Vxg) is applied across the row electrode Xi and the row electrode Yi. This potential difference (Vysc−Vxg), not starting discharge itself, can immediately cause (transfer) "writing sustain discharge" between the row electrodes Xi and Yi with a trigger of the preceding writing discharge. Due to such address discharge, positive or negative wall charges are stored on the surface of the dielectric layer 106A (see FIG. 25) located on the discharge cell(s) in a quantity capable of causing sustain discharge only with later application of a sustain pulse Vs.

Thus, the "address discharge" is formed by (i) "writing discharge" selectively generated between the row electrode Xi and the column electrode Wj and (ii) "writing sustain discharge" triggered by the "writing discharge" and caused between the row electrode Xi and the row electrode Yi.

On the other hand, the discharge cell(s) turned out in image display (i.e., in the sustain discharge period) is not made to cause address discharge and hence no discharge is caused between the row electrodes Xi and Yi of the discharge cell(s) and no wall charges are stored as a matter of course.

The sustain discharge period follows the address period. In the sustain discharge period, the sustain pulse Vs is applied across the row electrodes Xi and Yi, thereby maintaining sustain discharge during this period in the discharge cell(s) subjected to the aforementioned writing. During the sustain discharge period, a voltage Vs2 set to substantially half the voltage value Vs of the sustain pulse Vs is applied to the column electrode Wj, so that sustain discharge can be stably started upon transition from the address period to the sustain period.

<Problem 1>

As described above, the stripe barrier ribs of the AC-PDP 101 or the like are advantageous to the barrier ribs, completely enclosing the discharge cells, of the AC-PDP 201 in view of formation of the phosphor layers, introduction of discharge gas and controllability of discharge. In the AC-PDP having stripe barrier ribs, however, false discharge may be readily induced between discharge cells arranged along the barrier ribs since charged particles resulting from discharge quickly spread along the longitudinal direction of the stripe barrier ribs.

In order to prevent such false discharge, the AC-PDP 101 is provided with the non-discharge areas or the non-discharge cells between the discharge cells arranged along the barrier ribs. When the non-discharge areas are thus provided, however, the utilization factor of the display area is disadvantageously reduced by the non-discharge areas.

When driving the PDP by interlaced scanning, as hereinabove described, it is possible to increase the display area utilization factor by utilizing the areas of the non-discharge cells in the AC-PDP 101 as discharge cells thereby increasing the resolution. However, only half the display area is instantaneously utilized in driving, and hence it is necessary to employ means of increasing the number of applied pulses per unit time, i.e., the driving frequency in order to attain luminance identically to the driving method performing no interlaced scanning. In this case, it is necessary to increase instantaneous suppliability of a power source and hence it may not be possible to attain improvement of the luminous efficiency as a result.

When utilizing the areas of the non-discharge cells in the AC-PDP 101 as discharge cells and performing driving with no interlaced scanning, it is difficult to drive two discharge cells arranged through a single row electrode to share this row electrode while preventing induction of false discharge therebetween without providing a barrier rib (see the barrier ribs 110F2 shown in FIG. 28) separating the two discharge cells from each other.

<Problem 2>

Induction of false discharge from a lighted discharge cell or a discharge cell to be lighted to a discharge cell adjacent thereto can be caused in any of the aforementioned AC-PDPs 101 to 401. Discharge cells arranged in parallel with display lines share pairs of row electrodes and hence discharge readily takes place beyond barrier ribs. When gaps are defined between top portions of barrier ribs and a glass substrate opposed to the barrier ribs, or when barrier ribs are cracked or broken to define gaps in a process of manufacturing a PDP, for example, charged particles in discharge diffuse through such gaps to readily cause false discharge beyond the barrier ribs. Therefore, the barrier ribs must have process accuracy in manufacturing and strength of their own.

Further, interference of electric fields across adjacent cells may cause false discharge beyond barrier ribs, for example. When column electrodes are displaced from prescribed positions, false discharge is readily caused. In the AC-PDP 101, a strong electric field is formed in a space where the row electrodes Xi and Yi and the column electrode Wj intersect with each other in the address period, for example, and hence such a strong electric field readily causes false discharge between adjacent discharge cells when the column electrodes Wj is displaced from a prescribed position.

<Problem 3>

It may be unpreferable to provide black stripes on the non-discharge areas of the AC-PDP 101 in view of visuality, since the boundaries between the luminous areas and the non-luminous areas are clearly recognizable as black transverse lines in this case.

SUMMARY OF THE INVENTION (1) According to a first aspect of the present invention, an AC plasma display panel comprises a plurality of discharge cells having discharge gaps capable of forming desired discharge and arranged on a same plane and a plurality of non-discharge cells having non-discharge gaps harder to form discharge than the discharge gaps and arranged on the same plane, while the discharge gaps are arranged adjacently to each other through at least one non-discharge gap at least in a direction parallel to a display line.

According to the first aspect, the non-discharge gap is present between two discharge gaps in the direction parallel to the display line. As compared with the conventional AC plasma display panel having the discharge gaps adjacently arranged along the aforementioned direction, therefore, false discharge induced in another discharge cell due to discharge (and a voltage/electric field for controlling this discharge) in each discharge cell can be remarkably suppressed/prevented when driving the display line.

(2) According to a second aspect of the present invention, the AC plasma display panel further comprises a first substrate, a second substrate opposed to the first substrate at a prescribed distance, a plurality of barrier ribs dividing a space between the first substrate and the second substrate into a plurality of discharge spaces, a first electrode and a second electrode each including a strip first portion extending in parallel with the display line and a plurality of second portions connected to the first portion and extending toward the discharge cells, and arranged on the side of the first substrate, a dielectric substance covering at least one of the first and second electrodes, and a plurality of strip third electrodes each arranged on the side of the second substrate in a direction grade-separately intersecting with each first portion of the first and second electrodes for defining the discharge cells and the non discharge cells with the first and second electrodes, while the discharge gaps are formed by both edges of each second portion of the first and second electrodes opposed to each other in the discharge cells, and the non-discharge gaps are formed by both edges of a portion of each first portion of the first and second electrodes opposed through the non-discharge cells.

According to the second aspect, the aforementioned effect (1) can be attained in the so-called three-electrode surface discharge type AC plasma display panel.

(3) According to a third aspect of the present invention, second portions of the first and second electrodes is so arranged that the edges forming the discharge gaps are arranged to be along a longitudinal direction of the third electrodes.

According to the third aspect, (energy) loss of electrons in discharge can be remarkably reduced by lowering the height of discharge, whereby luminous efficiency can be improved.

(4) According to a fourth aspect of the present invention, the first and second electrodes include a plurality of first and second electrodes respectively, the plurality of first and second electrodes are alternately arranged, and the discharge gaps are arranged adjacently to each other through at least one of the non-discharge gaps in a direction perpendicular to the display line.

According to the fourth aspect, any of the aforementioned effects (1) to (3) can be attained on the overall surface of the AC plasma display panel.

(5) According to a fifth aspect of the present invention, two of the second portions present between two of the discharge gaps located on both sides of the first portion of the first or second electrode are connected to the first or second electrode held between the two of the discharge gaps.

According to the fifth aspect, an effect similar to the aforementioned effect (4) can be attained. Particularly when applying this connection mode to the AC plasma display panel according to the third aspect, reactive power can be remarkably suppressed.

(6) According to a sixth aspect of the present invention, the AC plasma display panel further comprises a first substrate, a second substrate opposed to the first substrate at a prescribed distance, a plurality of barrier ribs dividing a space between the first substrate and the second substrate into a plurality of discharge spaces, a first electrode and a second electrode each including a strip first portion extending in parallel with the display line and a strip second portion connected to the first portion and extending on both sides of the first portion with respect to a direction perpendicular to a longitudinal direction of the first portion to extend along the longitudinal direction of the first portion, and arranged on the side of the first substrate, a dielectric substance covering at least one of the first and second electrodes, a plurality of strip third electrodes each arranged on the side of the second substrate in a direction grade-separately intersecting with each first portion of the first and second electrodes for defining the discharge cells and the non-discharge cells with the first and second electrodes, and a discharge suppressor arranged at least on a grade-separate intersection of a gap between adjacent ones of second portions and the third electrodes for defining one of non-discharge cells, while the discharge gaps are formed by both edges of a portion of each second portion of the first and second electrodes opposed in the discharge cells, and the non-discharge gaps are formed by both edges of a portion of each second portion of the first and second electrodes opposed in the non-discharge cells.

According to the sixth aspect, the aforementioned effect (1) can be attained in the so-called three-electrode surface discharge type AC plasma display panel.

(7) According to a seventh aspect of the present invention, the discharge suppressor is arranged on the side of the second substrate.

According to the seventh aspect, the discharge cells and the non-discharge cells can be reliably formed even if misalignment takes place when bonding the first and second substrates to each other. As compared with the AC plasma display panel according to the second aspect, therefore, alignment accuracy in the aforementioned bonding step can be relaxed.

(8) According to an eighth aspect of the present invention, the discharge suppressor has a height equivalent to the barrier ribs.

According to the eighth aspect, the discharge suppressors and the barrier ribs can be collectively formed. Therefore, the discharge suppressors can be formed without increasing the number of manufacturing steps and complicating the manufacturing steps.

(9) According to a ninth aspect of the present invention, the discharge suppressor is arranged on the side of the first substrate, and the dielectric substance includes an electrode covering portion covering at least one of the first and second electrodes and a convex portion forming the discharge suppressor.

According to the ninth aspect, convex portions forming the discharge suppressors serve as guides for the plurality of discharge spaces divided by the barrier ribs in the step of bonding the first and second substrates to each other, whereby the first and second substrates are hardly misaligned with each other.

(10) According to a tenth aspect of the present invention, the discharge suppressor is not in contact with the barrier ribs.

According to the tenth aspect, the spaces are defined between the discharge suppressors and the barrier ribs, not to hinder execution of an exhaust step and a discharge gas introduction step for manufacturing the AC plasma display panel.

(11) According to an eleventh aspect of the present invention, the discharge suppressor is black at least on the side of the first substrate.

According to the eleventh aspect, high contrast and visuality can be attained.

(12) According to a twelfth aspect of the present invention, the first and second electrodes include a plurality of first and second electrodes respectively, the plurality of first and second electrodes are alternately arranged, and the discharge gaps are arranged adjacently to each other through at least one of the non-discharge gaps in a direction perpendicular to the display line.

According to the twelfth aspect, any of the aforementioned effects (6) to (11) can be attained on the overall surface of the AC plasma display panel.

(13) According to a thirteenth aspect of the present invention, at least one of the discharge cell is larger than at least one of the non-discharge cells when viewing the AC plasma display panel from the side of the first or second substrate.

According to the thirteenth aspect, the AC plasma display panel has a higher display area utilization factor than an AC plasma display panel (according to a sixteenth aspect) having discharge cells and non-discharge cells of the same size when having the same panel area and resolution, whereby luminous efficiency can be further improved. When rendering the panel area and the sizes of the discharge cells identical to those in the AC plasma display panel according to the sixteenth aspect, an AC plasma display panel having higher resolution can be implemented.

(14) According to a fourteenth aspect of the present invention, the plurality of barrier ribs include a plurality of strip barrier ribs arranged along a longitudinal direction of the third electrodes to separate adjacent ones of the third electrodes from each other, and at least one space between two adjacent ones of the strip barrier ribs is wider in a portion defining one of the discharge cells than in a portion defining one of the non-discharge cells.

According to the fourteenth aspect, when forming phosphor layers in U-shaped trenches defined by two adjacent barrier ribs and the second substrate, for example, portions of the phosphor layers in the non-discharge cells can be rendered thicker than portions in the discharge cells. Thus, in ultraviolet rays resulting from discharge caused in the discharge cells, those radiated toward the non-discharge cells can be converted to visible light in the phosphor layers in the aforementioned non-discharge cells. In other words, the utilization factor for the ultraviolet rays can be improved as compared with an AC plasma display panel having linearly arranged barrier ribs. In this case, portions of the discharge spaces forming the non-discharge cells are narrower than portions forming the discharge cells due to the difference of the thickness of the aforementioned phosphor layers, whereby discharge in the non-discharge cells can be more reliably prevented.

(15) According to a fifteenth aspect of the present invention, a space between both edges of the first portions of the first and second electrodes opposed through one of the discharge gaps is wider than a space between the both edges of first portions opposed through one of the non-discharge cells.

According to the fifteenth aspect, the discharge cells can be rendered larger than the non-discharge cells also when linearly forming the barrier ribs. Therefore, it is possible to sufficiently suppress cracking or breakage of the barrier ribs readily caused when meandering the barrier ribs.

(16) According to a sixteenth aspect of the present invention, the discharge cells are equal to the non-discharge cells in area when viewing the AC plasma display panel from the side of the first or second substrate.

According to the sixteenth aspect, the barrier ribs can be linearly formed, for example, whereby a conventional barrier rib forming step can be applied as such for forming barrier ribs capable of suppressing cracking or breakage.

(17) According to a seventeenth aspect of the present invention, the AC plasma display panel further comprises a first substrate, a second substrate opposed to the first substrate at a prescribed distance, a plurality of barrier ribs dividing a space between the first substrate and the second substrate into a plurality of discharge spaces, a first electrode and a second electrode each including a strip first portion extending in parallel with the display line and a plurality of second portions connected to the first portion and extending on both sides of the first portion with respect to a direction perpendicular to a longitudinal direction of the first portion, and arranged on the side of the first substrate, a dielectric substance covering at least one of the first and second electrodes, and a plurality of strip third electrodes each arranged on the side of the second substrate in a direction grade-separately intersecting with each first portion of the first and second electrodes for defining the discharge cells and the non-discharge cells with the first and second electrodes, while the discharge gaps are formed by both edges of each second portion of the first and second electrodes opposed to each other in the discharge cells, and the non-discharge gaps are formed by both edges of each second portion of the first and second electrodes opposed to each other through the non-discharge cells.

According to the seventeenth aspect, the aforementioned effect (1) can be attained in the so-called three-electrode surface discharge type plasma display panel.

(18) According to an eighteenth aspect of the present invention, the first and second electrodes include a plurality of first and second electrodes respectively, the plurality of first and second electrodes are alternately arranged, and the discharge gaps are arranged adjacently to each other through at least one of the non-discharge gaps in a direction perpendicular to the display line.

According to the eighteenth aspect, the aforementioned effect (17) can be attained on the overall surface of the AC plasma display panel.

(19) According to a nineteenth aspect of the present invention, two of the second portions present between two of the discharge gaps located on both sides of the first portion of the first or second electrode are connected to the first or second electrode held between the two of the discharge gaps.

According to the nineteenth aspect, an effect similar to the aforementioned effect (18) can be attained. In particular, reactive power can be remarkably suppressed.

(20) According to a twentieth aspect of the present invention, at least one of the discharge cells is larger than at least one of the non-discharge cells when viewing the AC plasma display panel from the side of the first or second substrate.

According to the twentieth aspect, an effect similar to the aforementioned effect (13) can be attained in the AC plasma display panel according to the-seventeenth aspect.

(21) According to a twenty-first aspect of the present invention, the first portion is linear, and a portion of second portions of the first and second electrodes on the side of the edges forming the discharge gaps with respect to the first portion is larger than a portion on the side of the edges forming the non-discharge gaps with respect to the first portion.

According to the twenty-first aspect, the first portion is linear and hence shape inconvenience of the first portion such as a pattern defect can be sufficiently suppressed as compared with the case of meandering the first portion.

(22) According to a twenty-second aspect of the present invention, the plurality of barrier ribs include a plurality of strip barrier ribs arranged along a longitudinal direction of the third electrodes to separate adjacent ones of the third electrodes from each other, and at least one space between two adjacent ones of the strip barrier ribs is wider in a portion defining one of the discharge cells than in a portion defining one of the non-discharge cells.

According to the twenty-second aspect, an effect similar to the aforementioned effect (14) can be attained in the AC plasma display panel according to the seventeenth aspect.

(23) According to a twenty-third aspect of the present invention, the first and second portions are made of an opaque conductive material, and the second portions have an opening.

According to the twenty-third aspect, the first and second portions can be collectively formed. Thus, the total number of steps for forming the first and second electrodes can be saved/simplified as compared with the case of employing transparent electrodes for the second portions. Consequently, the cost can be reduced.

(24) According to a twenty-fourth aspect of the present invention, the AC plasma display panel further comprises a black insulator arranged on a portion other than the discharge cells.

According to the twenty-fourth aspect, higher contrast and visuality can be attained as compared with a plasma display panel having the so-called black stripes.

(25) According to a twenty-fifth aspect of the present invention, the black insulator is arranged on a region corresponding to one of the non-discharge cells in a surface of the first substrate closer to the discharge spaces.

According to the thirty-fifth aspect, the discharge spaces in the non-discharge cells can be narrowed by the black insulators, whereby formation of discharge (false discharge) in the non-discharge cells can be more reliably prevented.

(26) According to a twenty-sixth aspect of the present invention, the black insulator is arranged on the second substrate.

According to the twenty-sixth aspect, an existing barrier rib forming step can be utilized as such by simply blackening a raw material for barrier ribs when forming the black insulators as parts or the whole of the barrier ribs, for example.

(27) According to a twenty-seventh aspect of the present invention, a width of the first portion is uniform along a longitudinal direction of the first portion.

According to the twenty-seventh aspect, the driving voltage margin can be enlarged while ensuring visuality for stably driving the AC plasma display panel by setting the width of the first portion to be smaller toward the center and larger toward each end. Further, the driving voltage margin can be further enlarged for more stably driving the AC plasma display panel as compared with the aforementioned case narrower at the center than each end by setting the width of the first portion to be larger toward the center and smaller toward each end.

(28) According to a twenty-eighth aspect of the present invention, the width of the first portion is smaller at the center and larger toward each end.

According to the twenty-eighth aspect, the resistance of the first portion can be lowered for reducing a voltage drop caused by the first portion as compared with the case of having a uniform width equivalent to the width of the center. Consequently, the driving voltage margin can be enlarged, for stably driving the AC plasma display panel. While luminance is reduced around the end portion as compared with the center, this does not lead to remarkable reduction of visuality.

(29) According to a twenty-ninth aspect of the present invention, the width of the first portion is larger at the center and smaller toward each end.

According to the twenty-ninth aspect, the aforementioned driving voltage margin can be more enlarged for further stably driving the AC plasma display panel as compared with the AC plasma display panel according to the twenty-eighth aspect.

(30) According to a thirtieth aspect of the present invention, a plasma display device comprises an AC plasma display panel including a plurality of discharge cells having discharge gaps capable of forming desired discharge and arranged on a same plane and a plurality of non-discharge cells having non-discharge gaps harder to form discharge than the discharge gaps and arranged on the same plane, while the discharge gaps are arranged adjacently to each other through at least one non-discharge gap at least in a direction parallel to a display line and a driving unit driving the plurality of discharge cells.

According to the thirtieth aspect of the present invention, it is possible to provide a plasma display device capable of exhibiting any of the aforementioned effects (1) to (9).

(31) According to a thirty-first aspect of the present invention, a driving method is for the AC plasma display panel according to the twenty-third aspect in which the first and second electrodes include a plurality of first and second electrodes respectively, and the plurality of first and second electrodes are alternately arranged and the discharge gaps are arranged adjacently to each other through at least one non-discharge gap in a direction perpendicular to the display line, and driving method does not simultaneously forms discharge in the discharge cells arranged on one side of the first portion and the discharge cells arranged on the other side.

According to the thirty-first aspect of the present invention, the instantaneous current flowing to the first and second electrodes can be reduced. Therefore, a voltage drop caused by the resistance of the first and second electrodes can be reduced for stably driving the AC plasma display panel.

A first object of the present invention is to provide a an AC plasma display panel capable of remarkably suppressing/removing false discharge.

A second object of the present invention is to provide an AC plasma display panel manufacturable with a process technique substantially identical to or easier than the method of manufacturing the AC-PDP 101 along with attainment of the aforementioned first object.

A third object of the present invention is to provide an AC plasma display panel more improved in visuality than a conventional AC-PDP along with attainment of the aforementioned first and second objects.

A fourth object of the present invention is to provide a stably drivable AC plasma display panel by increasing the driving voltage margin for the AC plasma display panel attaining the aforementioned first to third objects.

In addition, a fifth object of the present invention is to provide a plasma display device comprising the AC plasma display panel attaining the aforementioned first to fourth objects.

A sixth object of the present invention is to provide a driving method suitable for the AC plasma display panel attaining the aforementioned first to fourth objects.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1:
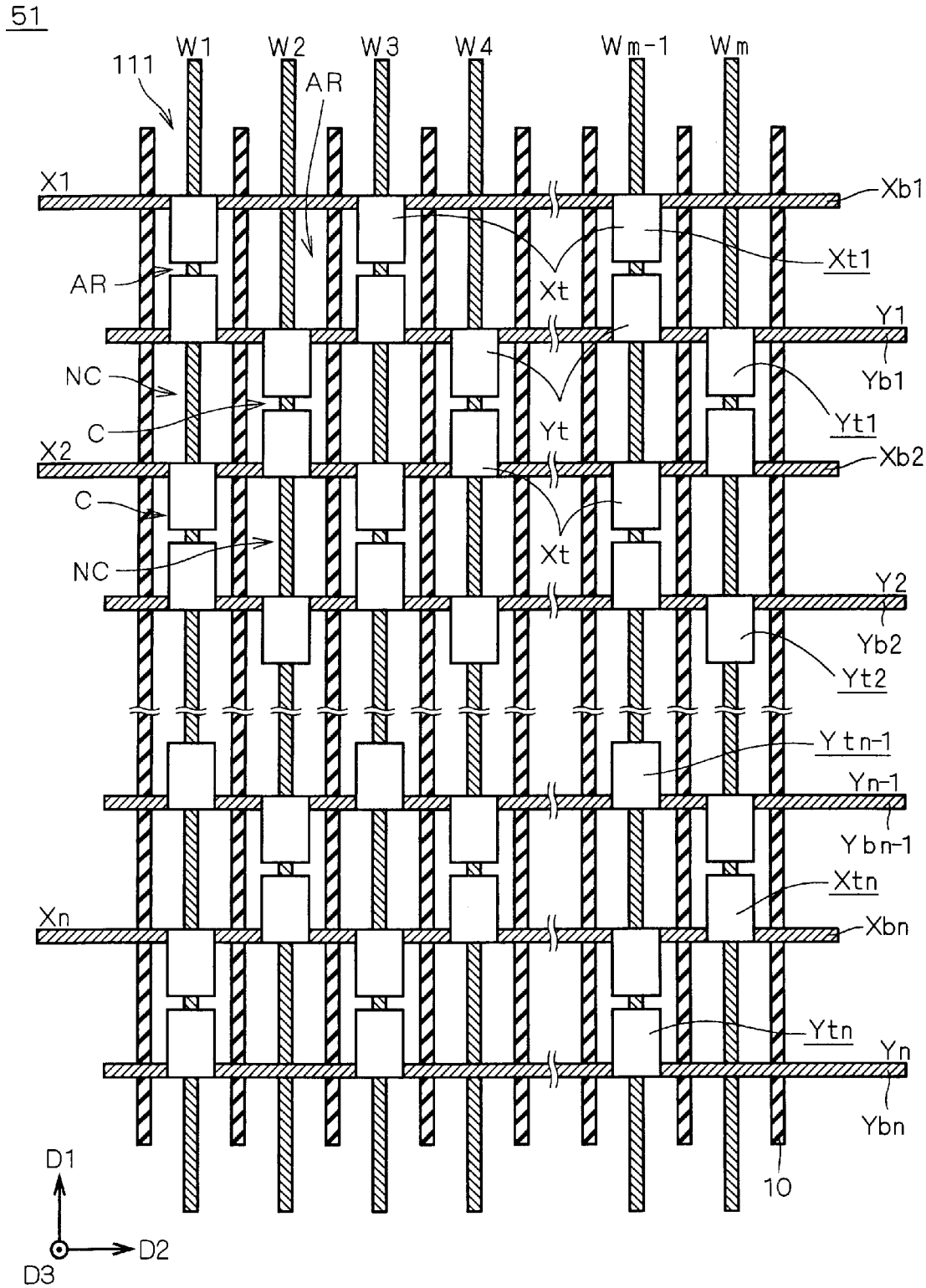
FIG. 1 is a plan view for illustrating the structure of an AC plasma display panel according to an embodiment 1 of the present invention.
Figure 2:
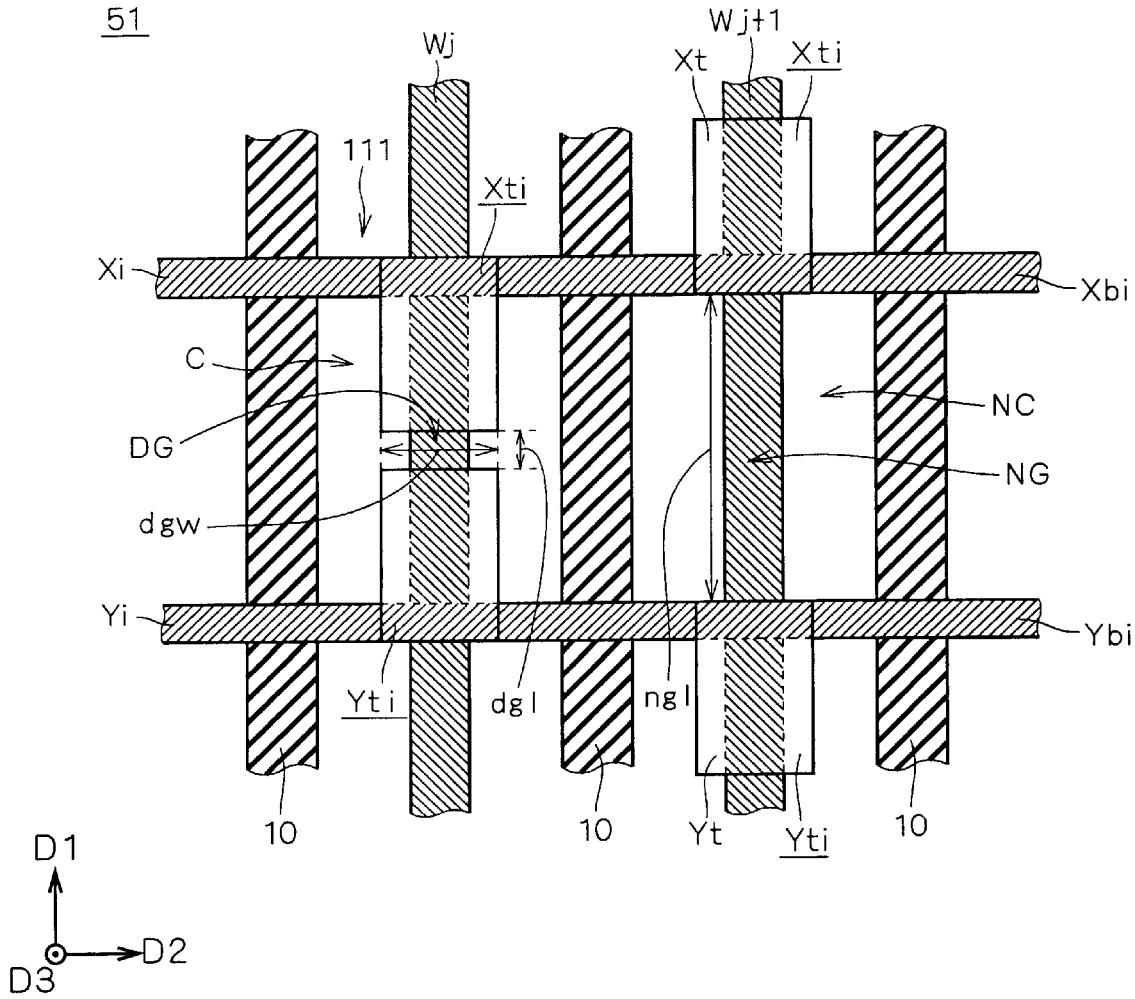
FIG. 2 is a plan view showing a principal part of the structure of the AC plasma display panel according to the embodiment 1 in an enlarged manner.

FIG. 1 is a plan view typically showing the structure of an AC-PDP 51 according to an embodiment 1 of the present invention, and FIG. 2 is an enlarged view showing a principal part in FIG. 1. The AC-PDP 51 is described mainly with reference to the structures of electrodes and barrier ribs (also referred to as "ribs") characterizing the AC-PDP 51, and FIGS. 1 and 2 extract and illustrate only the electrodes and the barrier ribs of the AC-PDP 51. As to the remaining elements of the AC-PDP 51, those equivalent to the elements of any conventional AC-PDP are applicable. Therefore, elements equivalent to those of the aforementioned AC-PDPs 101 to 401 (see FIGS. 25 to 29) are denoted by the same reference numerals, to omit redundant description. This also applies to embodiments 2 to 8 described later.

As shown in FIGS. 1 and 2, n row electrodes (first or second electrodes) X1 to Xn (an arbitrary one of the n row electrodes X1 to Xn is referred to as "row electrode Xi" (i=1 to n)) and n row electrodes (second or first electrodes) Y1 to Yn (an arbitrary one of the n row electrodes Y1 to Yn is referred to as "row electrode Yi"(i=1 to n)) are alternately arranged on the side of a front glass substrate (first substrate) 102 (see FIG. 25) forming a display surface. On the other hand, m column electrodes (third electrodes) W1 to Wm (an arbitrary one of the m column electrodes W1 to Wm is referred to as "row electrode Wj"(=1 to m)) are arranged on the side of a rear glass substrate (second substrate) 103 (see FIG. 25) in a direction grade-separately intersecting with the row electrodes Xi and Yi. The front glass substrate 102 and the rear glass substrate 103 are oppositely arranged in parallel with each other at a prescribed distance. The space between the substrates 102 and 103 is divided into a plurality of discharge spaces 111 by barrier ribs 10 each arranged between adjacent column electrodes Wj and Wj+1.

More specifically, the column electrodes W1 to Wm (corresponding to the column electrodes 108 shown in FIG. 25) extending along a first direction D1 parallel to the surface of the rear glass substrate 103 closer to the discharge spaces 111 are arranged on the surface at regular pitches in a second direction D2 perpendicular to the first direction D1 in the surface. It is assumed that the first and second directions D1 and D2 are the vertical and transverse directions in a display screen of the AC-PDP 51 respectively. The barrier ribs 10 are arranged in the form of stripes along the first direction D1, similarly to the barrier ribs 110 shown in FIG. 25. Phosphor layers 109R, 109G and 109B of respective luminous colors are arranged in U-shaped trenches defined by the aforementioned surface of the rear glass substrate 103 and opposite side walls of the adjacent barrier ribs 10 in units of the U-shaped trenches. A dielectric layer may be provided on the aforementioned surface of the rear glass substrate 103 to cover the column electrodes W1 to Wm, for arranging the barrier ribs 10 and the phosphor layers 109 on the dielectric layer.

On the front glass substrate 102, the row electrodes Xi and Yi consist of strip bus electrodes (first portions) Xb and Yb (the relation with the row electrodes Xi and Yi is clarified as "bus electrodes Xbi and Ybi" with subscripts i when particularly necessary) extending on the surface of the substrate 102 closer to the discharge spaces 111 along the second direction D2 and m transparent electrodes (second portions) Xt and Yt (the relation with the bus electrodes Xbi and Ybi is clarified as "transverse electrodes Xti and Yti" with subscripts i when particularly necessary) of square shapes, for example, having ends connected to prescribed positions (described later) of the bus electrodes Xbi and Ybi respectively. In this case, n bus electrodes Xb1 to Xbn and n bus electrodes Yb1 to Ybn are alternately arranged in parallel with each other at regular pitches in relation to the first direction D1. The bus electrodes Xbi and Ybi are preferably lower in impedance than the transparent electrodes Xt and Yt. While the transparent electrodes Xt and Yt are arranged on the surface of the front glass substrate 102 closer to the discharge spaces 111 and the bus electrodes Xbi and Ybi are arranged on the aforementioned surface to cover ends of the transparent electrodes Xti and Yti in FIGS. 1 and 2, the order of these electrodes may be reversed.

Figure 30:
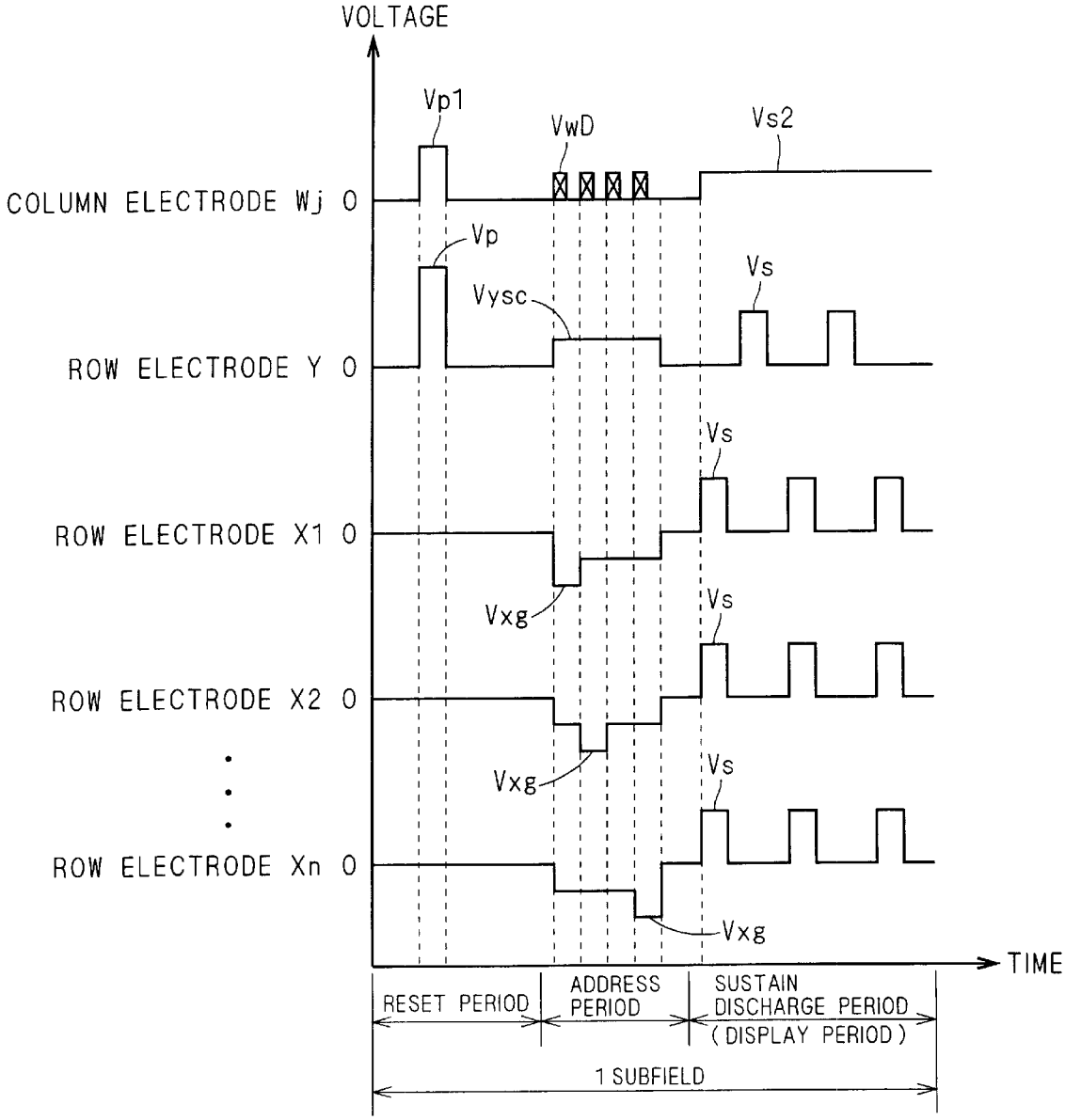
FIG. 30 PRIOR ART
FIG. 30 is a timing chart for illustrating a method of driving the conventional AC plasma display panel.

Similarly to the AC-PDP 101, a dielectric layer 106 (or 106A) is arranged to cover the row electrodes X1 to Xn and the row electrodes Y1 to Yn. When at least either the row electrodes X1 to Xn or the row electrodes Y1 to Yn are covered with a dielectric substance, a memory function resulting from wall charges in the AC-PDP can be attained so that the aforementioned driving method separating the address period and the sustain period shown in FIG. 30 is applicable.

The transparent electrodes Xt and Yt are now described in detail. In the following description, each of a plurality of areas defined as areas divided in the form of a matrix by 2n bus electrodes Xb1 to Xbn and Ybi to Ybn and (m+1) barrier ribs 10 in FIGS. 1 and 2 is referred to as "unit area AR". In this case, each unit area AR can also be grasped as defined by each of grade-separate intersections between the row electrodes X1 to Xn and Y1 to Yn (or gaps between two adjacent row electrodes) and the column electrodes W1 to Wm. It is assumed that the unit area AR is not restricted to the two-dimensional area shown in FIG. 1 but also stands for a three-dimensional area extending in a third direction D3 perpendicular to both of the first and second directions D1 and D2 in relation to the two-dimensional area.

Each transparent electrode Xti has an end connected with the bus electrode Xbi, and extends into one of two unit areas AR adjacent to each other in the first direction DI through the bus electrode Xbi. Further, the m transparent electrodes Xt extend in alternate directions with respect to the first direction D1. In other words, adjacent transparent electrodes Xt are formed not to extend in the same direction. Similarly, each of m transparent electrodes Yt forming the transparent electrode Yti has an end connected to the bus electrode Ybi, and extends into the unit area AR so that the directions of such extensions of the transparent electrodes Yt are alternate with respect to the first direction D1. In particular, edges of each transparent electrode Xt and each transparent electrode Yt are opposed to each other in the same unit area AR through a prescribed gap, in order to form desired discharge. The prescribed gap corresponds to the aforementioned discharge gap DG, and is hereinafter referred to with this term. This space (or distance) of the gap is referred to as "space (or distance) dg1 of the discharge gap DG", and the length of the opposed portions of the edges of the transparent electrodes Xt and Yt is referred to as "width (or length) dgw of the discharge gap DG". On the other hand, the gap between opposed edges of two adjacent bus electrodes corresponds to the aforementioned non-discharge gap NG, and is hereinafter referred to with this term. This space (or distance) of the gap is referred to as "space (or distance) ng1 of the non-discharge gap NG".

Figure 3:
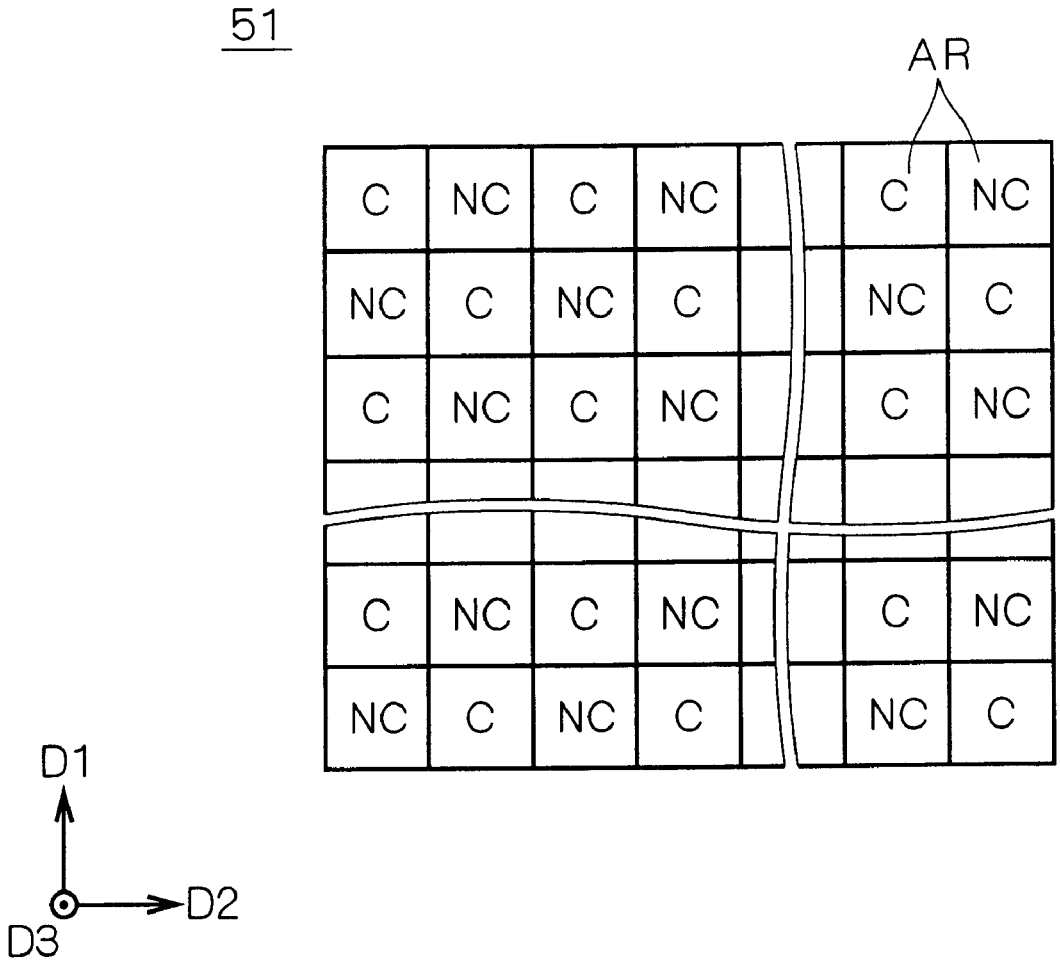
FIG. 3 is a plan view typically showing the arrangement of discharge cells and non-discharge cells in the AC plasma display panel according to the embodiment 1.

The AC-PDP 51 comprising the aforementioned row electrodes X1 to Xn and Y1 to Yn can generate discharge in the gaps DG without causing discharge in the gaps NG by controlling a voltage applied across the adjacent row electrodes Xi and Yi (or Yi-1) due to the difference between the spaces dg1 and ng1 of the gaps DG and NG. Therefore, the (three-dimensional) unit areas AR are divided into (i) the aforementioned discharge cells C having the discharge gaps DG defined by the transparent electrodes Xt and Yt and (ii) non-discharge cells (or non-discharge areas) NC having no transparent electrodes Xt and Yt but comprising the non-discharge gaps NG defined by the bus electrodes Xbi and Ybi (or Ybi−1). In this case, the discharge cells C (or the discharge gaps DG shown in FIGS. 1 and 2) and the non-discharge cells NC (or the non-discharge gaps NG shown in FIGS. 1 and 2) are alternately arranged in the directions parallel to and perpendicular to display lines (or in second and first directions D2 and D1) in the overall AC-PDP 51 as shown in FIG. 3, so that the discharge cells C (or the discharge gaps DG) are not directly adjacent to each other in the aforementioned two directions. In other words, the discharge gaps DG are adjacent to each other through at least one non-discharge gap NG in the aforementioned directions. As shown in FIGS. 1 and 2, two transparent electrodes present between two discharge gaps DG obliquely opposed to each other are connected to the bus electrode Xbi or Ybi held between the two discharge gaps DG.

In the AC-PDP 51, two adjacent gaps or spaces among a plurality of gaps or spaces extending along two adjacent bus electrodes (or in the second direction D2) define "display line". When the luminous color is monochromatic (a single type of phosphor is present or the AC-PDP 51 has no phosphor), for example, a single aforementioned gap or space defines a display line.

Therefore, also when a strong electric field is formed on the grade-separate intersection between the row electrodes Xi and Yi (or Yi-1) and the column electrode Wj, particularly on the grade-separate intersection between the transparent electrodes Xt and Yt and the column electrode Wj in the discharge cell C in the aforementioned address period, for example, the AC-PDP 51 can remarkably suppress/avoid induction of false discharge in the discharge cell C adjacent to this discharge cell C due to the presence of the non-discharge cell NC. Even if the positions of arrangement of the column electrodes W1 to Wm are displaced from the central axis between two adjacent barrier ribs 10, occurrence of false discharge can be reliably prevented due to the presence of the non-discharge cells NC. Even if the barrier ribs 10 are partially cracked or broken, further, occurrence of false discharge can be reliably prevented for a similar reason. In order to suppress/avoid occurrence of false discharge in the address period forming a particularly strong electric field, the discharge gaps DG may not be adjacent to each other at least in the direction parallel to the display lines (or in the second direction D2). When the discharge gaps DG are not adjacent to each other in the direction perpendicular to the display lines (or in the first direction D1), further, occurrence of false discharge can be suppressed/avoided on the overall surface of the AC-PDP 51 (in sustain discharge, for example).

Figure 4:
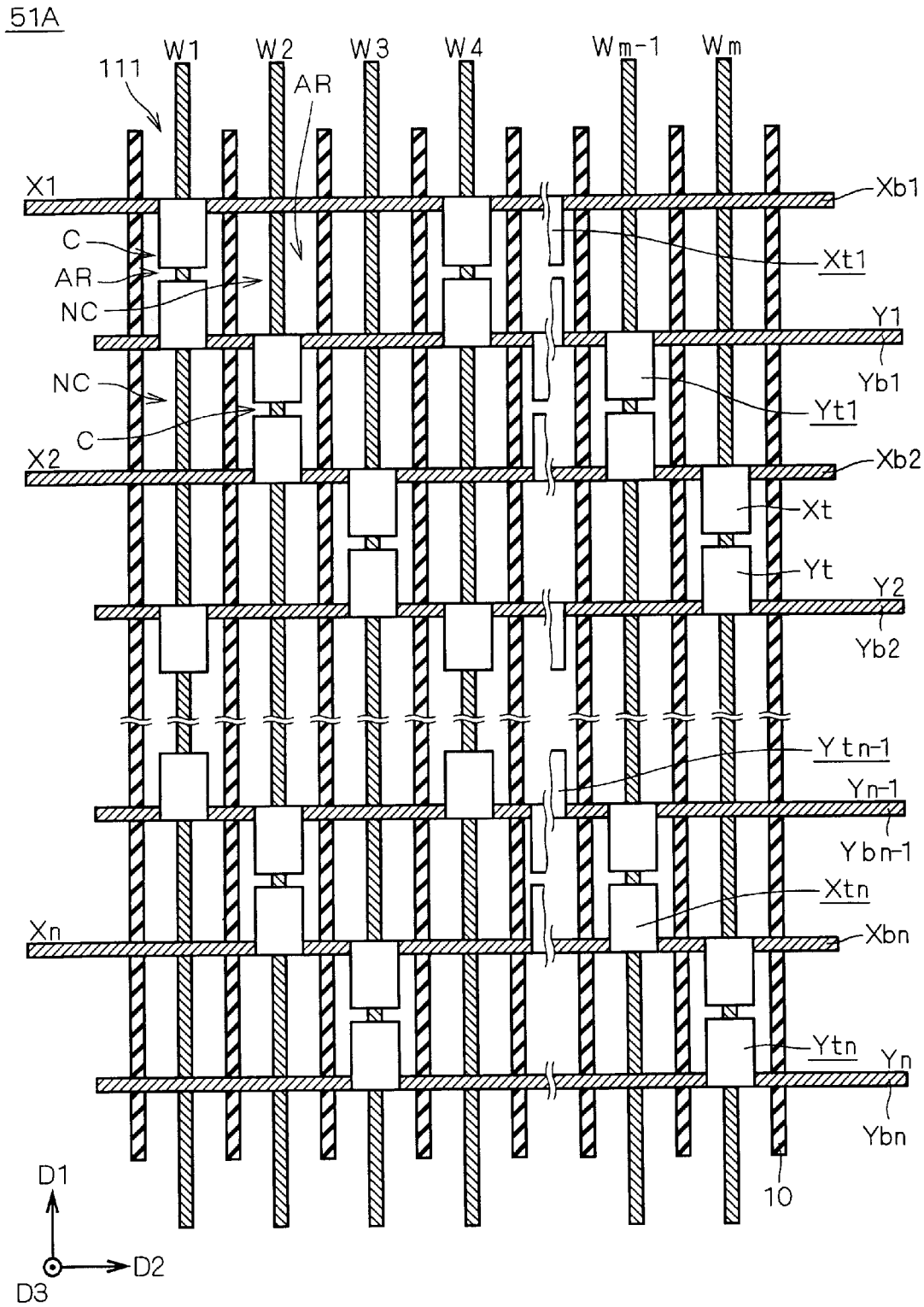
FIG. 4 is a plan view for illustrating another structure of the AC plasma display panel according to the embodiment 1.

A plurality of non-discharge gaps NG may be adjacently arranged along the first and second directions D1 and D2. As an example of such a structure, FIG. 4 shows an AC-PDP 51A having two adjacently arranged non-discharge gaps NG. In this case, adjacent three gaps between the aforementioned two adjacent bus electrodes define "display line".

The bus electrodes Xb1 to Xbn and Yb1 to Ybn, the column electrodes W1 to Wm, the barrier ribs 10 and the like can be linearly formed in the AC-PDP 51, whereby the AC-PDP 51 can advantageously be manufactured through a manufacturing process equivalent to that for the conventional AC-PDP 101) easier than that for the conventional AC-PDP 201.

Figure 5:
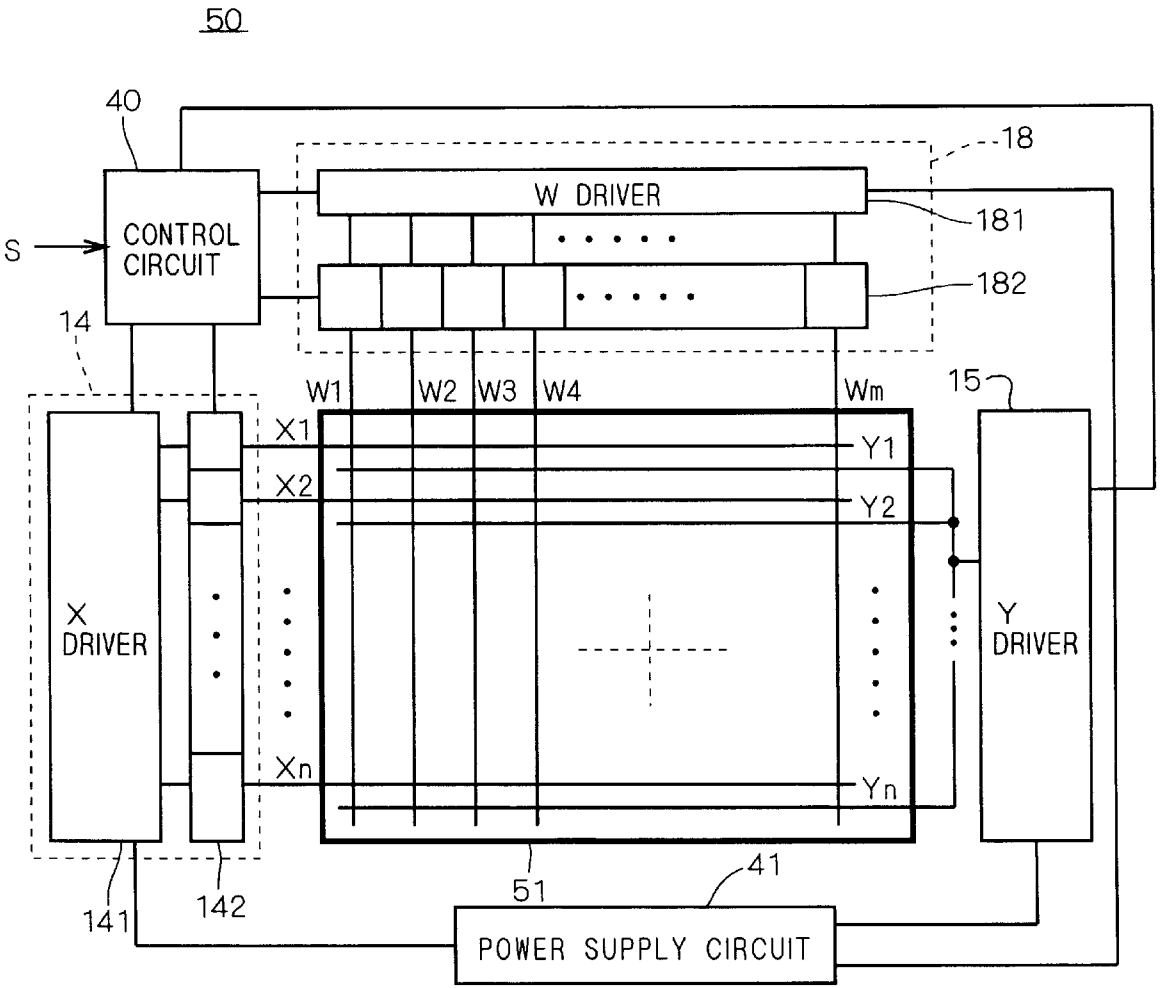
FIG. 5 is a block diagram showing the overall structure of a plasma display device according to the embodiment 1.

A plasma display device 50 comprising the AC-PDP 51 is now described with reference to FIG. 5. FIG. 5 is a block diagram typically showing the overall structure of the plasma display device 50 according to the embodiment 1 of the present invention. As shown in FIG. 5, the plasma display device 50 comprises the aforementioned AC-PDP 51, driving circuits 14, 15 and 18 for supplying prescribed voltages to the row electrodes X1 to Xn and Y1 to Yn and the column electrodes W1 to Wm respectively, a control circuit 40 controlling the driving circuits 14, 15 and 18 and a power supply circuit 41 generating the prescribed voltages and supplying the same to the driving circuits 14, 15 and 18. A driving unit of the plasma display device 50 includes the driving circuits 14, 15 and 18.

First, the control circuit 40 generates control signals based on an input video signal S and outputs the same to the driving circuits 14, 15 and 18.

As shown in FIG. 5, the driving circuit 14 is formed by an X driver 141 and driving ICs 142. The X driver 141 receives the control signal from the control circuit 40 and the supply voltage from the power supply circuit 41 to generate a prescribed voltage pulse. A plurality of output terminals of the driving ICs 142 are connected to corresponding ones of the row electrodes X1 to Xn respectively, and the driving ICs 142 scan and apply the prescribed voltage pulse generated in the X driver 141 on the basis of the control signal from the control circuit 40 to the row electrodes X1 to Xn.

The driving circuit 15 is formed by a Y driver (also referred to as "Y driver 15" with the same reference numeral) equivalent to the aforementioned X driver 141. The n row electrodes Y I to Yn are connected in common to an output terminal of the Y driver 15, so that the same voltage is simultaneously supplied to the row electrodes Y1 to Yn.

The driving circuit 18 is formed by a W driver 181 corresponding to the aforementioned X driver 141 and driving ICs 182 corresponding to the driving ICs 142. A plurality of output terminals of the driving ICs 182 are connected to corresponding ones of the column electrodes W1 to Wm respectively.

As to a method of driving the AC-PDP 51 in the plasma display device 50, the conventional driving method such as the aforementioned driving method shown in FIG. 30, for example, is applicable. In other words, one field (1F) period is divided into a plurality of subfields (SF) and each subfield is further divided into "reset period", "address period" and "sustain discharge period (or display period)" for driving the AC-PDP 51. In the address period, a writing operation or an address operation (including both of cases of forming and not forming address discharge) is executed in discharge cells C arranged on both sides of the row electrode Xi in synchronization with sequential scanning of the row electrode Xi. In the reset period and the sustain discharge period, a prescribed voltage is applied in units of the row electrodes X1 to Xn, the row electrodes Y1 to Yn or the column electrodes W1 to Wm for driving the AC-PDP 51 along the overall surface.

Embodiment 2

Figure 6:
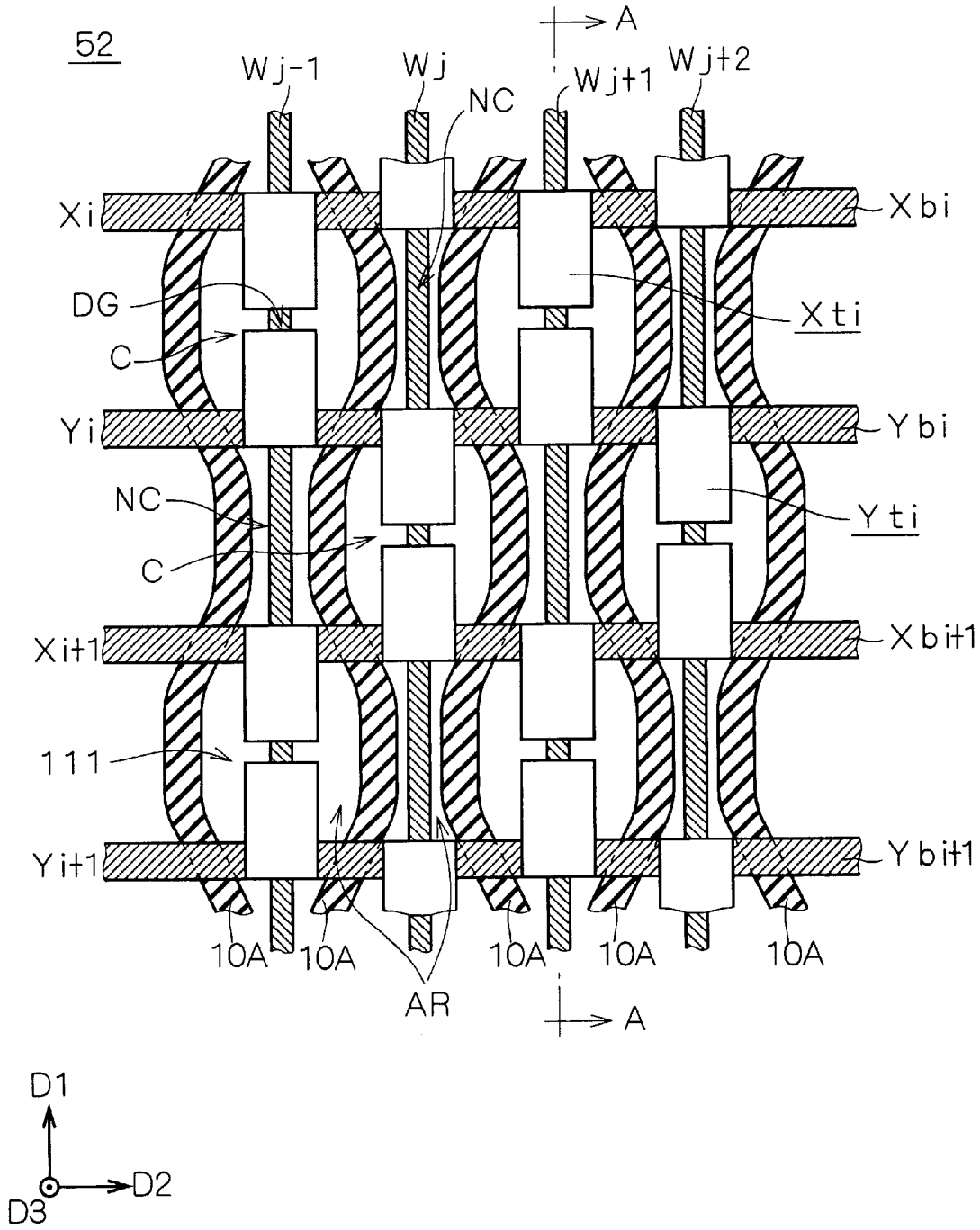
FIG. 6 is a plan view for illustrating the structure of an AC plasma display panel according to an embodiment 2 of the present invention.

An AC-PDP 52 according to an embodiment 2 of the present invention is now described with reference to FIG. 6 corresponding to FIG. 1. FIG. 6 extracts and illustrates only electrodes and barrier ribs in the AC-PDP 52, similarly to FIG. 1. The AC-PDP 52 is described with reference to the structure of the barrier ribs characterizing the AC-PDP 52 as compared with the aforementioned AC-PDP 51.

As shown in FIG. 6, row electrodes Xi (i=1 to n) and row electrodes Yi (i=1 to n) extending along a second direction D2 are alternately arranged at regular pitches in a first direction D1 while column electrodes Wj (=1 to m) extending along the first direction D1 are arranged at regular pitches in the second direction D2 similarly to the AC-PDP 51.

In particular, barrier ribs 10A of the AC-PDP 52 are in the form of meandering strips along the first direction D1 as a whole. More specifically, the space (or the distance) between opposite side wall surfaces of adjacent barrier ribs 10A is so set that portions of the barrier ribs 10A forming (or defining) discharge cells C are wider than portions forming non-discharge cells NC. When the barrier ribs 10A have substantially wavy shapes provided with no steep corners shown in FIG. 6 as viewed from a third direction D3, it is possible to sufficiently suppress inconvenience such as cracking of the barrier ribs 10A resulting from nonlinearity of the barrier ribs 10A.

As shown in FIG. 6, the discharge cells C are larger than the non-discharge cells NC with respect to area when viewing the AC-PDP 52 from the third direction D3, due to the shapes of the barrier ribs 10A. As compared with the AC-PDP 51 having the same panel area and resolution, therefore, the area of a region concerned with image display can be more increased. Therefore, the AC-PDP 52 can improve the utilization factor of the display area as compared with a PDP (e.g. the aforementioned AC-PDP 51) having discharge cells C and non-discharge cells NC of the same size. When setting the size or area of transparent electrodes Xt and Yt equivalent to that in the AC-PDP 51, the space between edges of the transparent electrodes Xt and Yt along the first direction D1 and the barrier ribs 10A is wider than that in the AC-PDP 51, whereby the quantity of electrons in discharge colliding with the barrier ribs 10A can be reduced for consequently improving luminous efficiency. When increasing the areas of the transparent electrodes Xt and Yt beyond those in the AC-PDP 51 in response to enlargement of the discharge cells C, luminous efficiency can be improved by enlarging the discharge itself.

In the AC-PDP 52, the shapes of the barrier ribs 10A are so defined that the non-discharge cells NC are present. In this point, a clear structural difference is recognized between the AC-PDP 52 and the conventional AC-PDP 201 (see FIGS. 26 and 27) having no non-discharge cells. In this case, the following effects can be attained due to the presence of the non-discharge cells NC:

First, the AC-PDP 52 has U-shaped trenches extending in the first direction D1 defined by opposite side wall surfaces of adjacent barrier ribs 10A and a glass substrate 103 (see FIG. 7 described later) having the barrier ribs 10A, whereby a process of forming phosphor layers in the conventional AC-PDP 101 having linear barrier ribs can be utilized as such. In other words, no complicated alignment is required in a step of forming phosphor layers, dissimilarly to the conventional AC-PDP 201.

Figure 7:
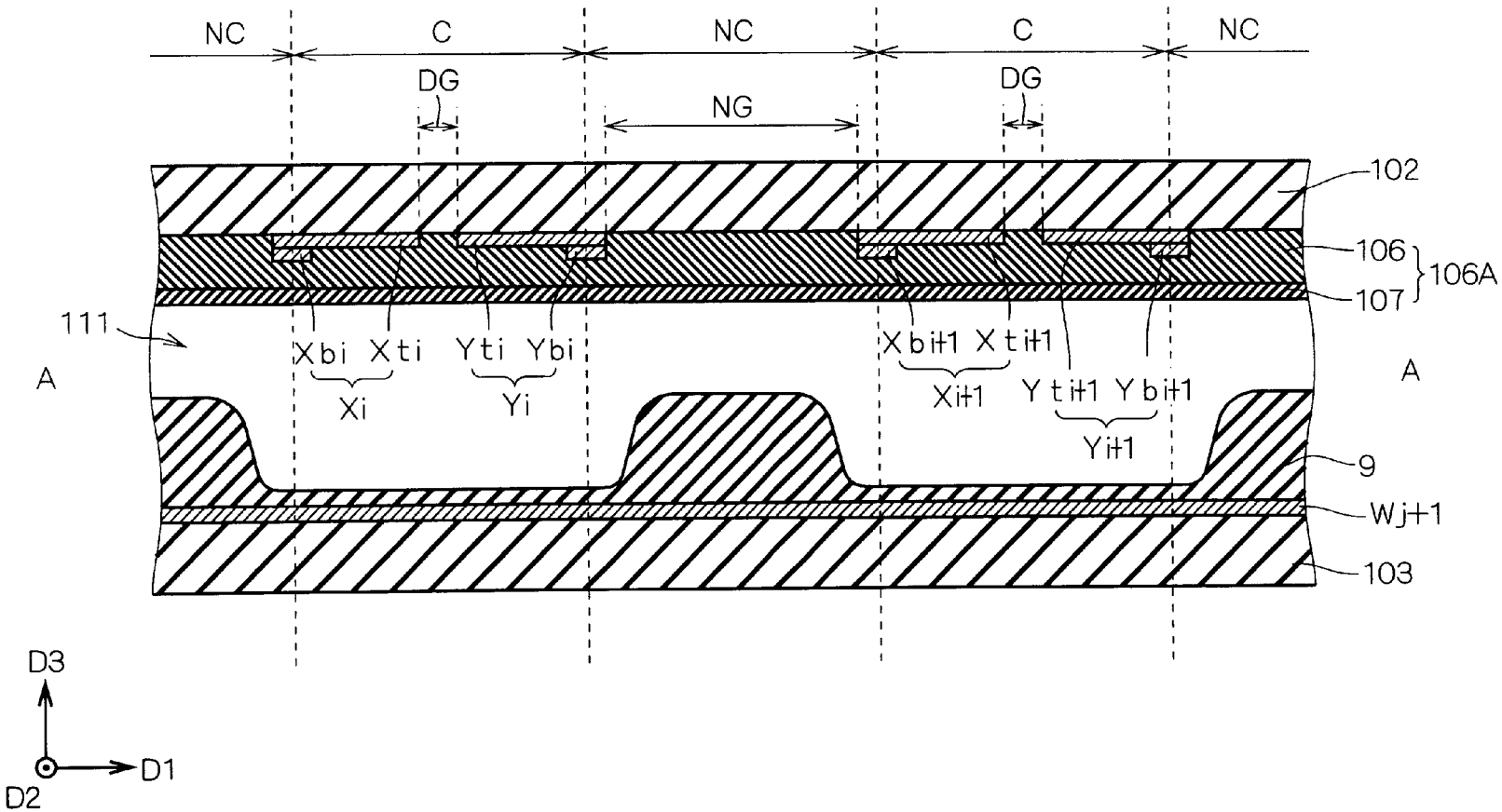
FIG. 7 is a longitudinal sectional view of the AC plasma display panel according to the embodiment 2.

When applying phosphor paste serving as the raw material for the phosphor layers by a printing method or a dispenser method in the step of forming phosphor layers for the AC-PDP 52, the phosphor layers are formed as phosphor layers 9 having characteristic longitudinal sections, as shown in FIG. 7. FIG. 7 is a longitudinal sectional view taken along the line A—A in FIG. 6. According to the aforementioned printing method or the like, the same quantity of phosphor paste is applied into the U-shaped trenches regardless of the discharge cells C and the non-discharge cells NC. Consequently, the thickness (the size in the third direction D3) of the phosphor layers 9 in the non-discharge cells NC is larger than that in the discharge cells C, as shown in FIG. 7.

Due to such shapes of the phosphor layers 9, the AC-PDP 52 can attain an ultraviolet utilization factor higher than that in the conventional AC-PDP 101 or the like. This is because the quantity of ultraviolet rays resulting from discharge in the discharge cells C and reaching the non-discharge cells NC can be reduced due to (the height of) the phosphor layers 9. In other words, the AC-PDP 52 converts ultraviolet rays radiated toward the non-discharge cells NC to visible light in the phosphor layers 9 in the non-discharge cells NC and utilizes the same as display luminescence of the discharge cells C. While the peripheries of the discharge cells may slightly shine due to diffusion of ultraviolet rays resulting from discharge in the direction along the column electrodes (or in the longitudinal direction of the U-shaped trenches) in the conventional AC-PDP 101 or the like, the AC-PDP 52 can also solve such a problem in display quality simultaneously with the aforementioned effective utilization of the ultraviolet rays.

The AC-PDP 52 is superior to the conventional AC-PDP 201 also in an exhaust step and a discharge gas introduction step included in manufacturing steps for the PDP and in discharge controllability in driving of the PDP due to the presence of the aforementioned U-shaped trenches.

The AC-PDP 52 can be driven by a structure similar to the aforementioned plasma display device 50 shown in FIG. 5. This also applies to AC-PDPs described in an embodiment 3 and the like.

Embodiment 3

Figure 8:
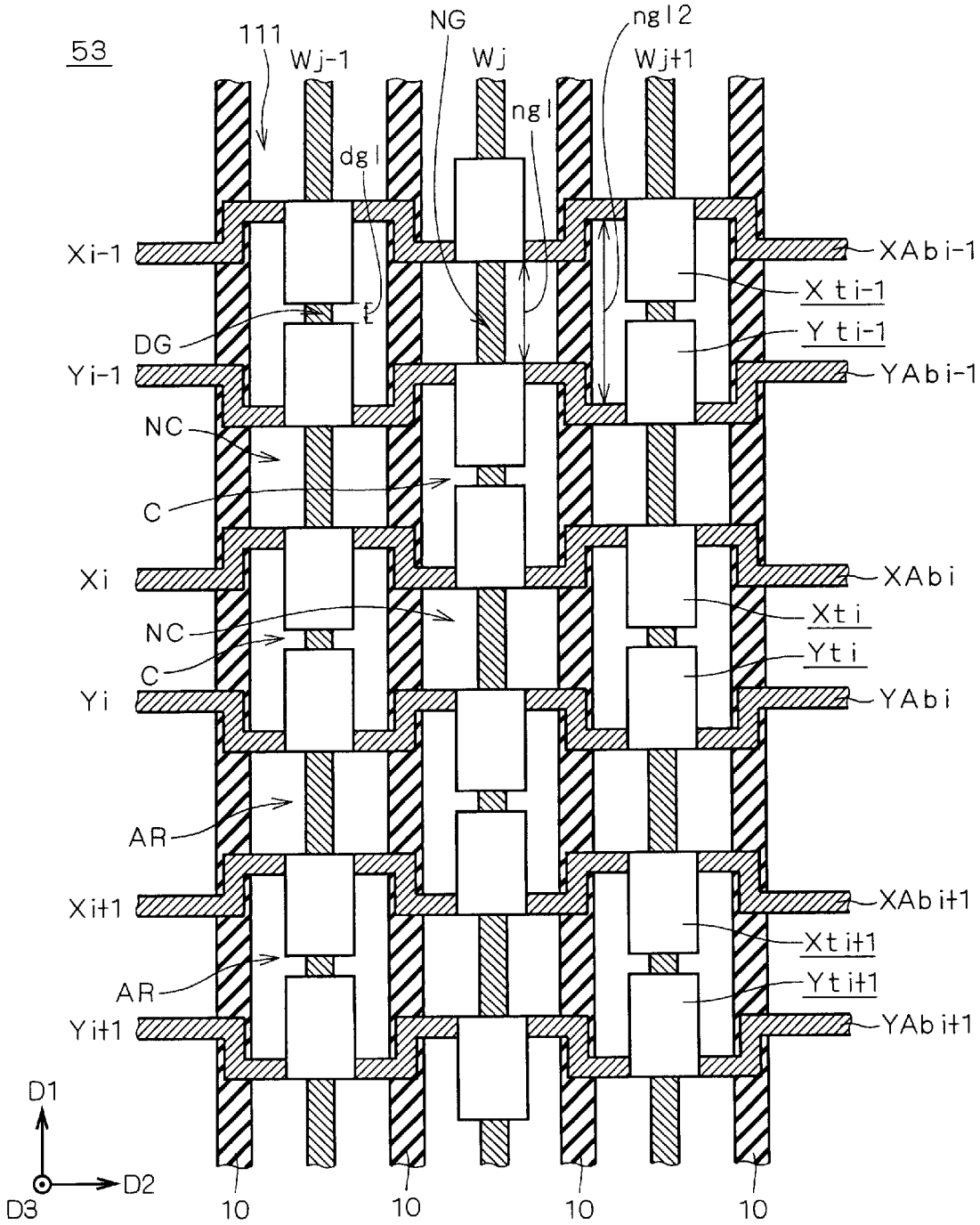
FIG. 8 is a plan view for illustrating the structure of an AC plasma display panel according to an embodiment 3 of the present invention.

An AC-PDP 53 according to the embodiment 3 of the present invention is now described with reference to a plan vie of FIG. 8 corresponding to FIG. 1. As shown in FIG. 8, column electrodes Wj (j=1 to m) and barrier ribs 10 of the AC-PDP 53 are similar in structure and arrangement pitch to those of the AC-PDP 51.

The AC-PDP 53 is described with reference to the structure of bus electrodes XAb and YAb forming row electrodes characterizing the AC-PDP 53 in particular as compared with the aforementioned AC-PDP 51. As shown in FIG. 8, the bus electrodes XAb and YAb are in the form of meandering strips along a second direction D2 as a whole. More specifically, the bus electrodes XAb and YAb consist of (i) portions extending along the second direction D2 and defining discharge cells C and non-discharge cells NC and (ii) portions extending along a first direction D1 to overlap with the barrier ribs 10. Adjacent bus electrodes XAb and YAb are symmetrical about straight lines (axes) parallel to the second direction D2. In the adjacent bus electrodes XAb and YAb, the space (or distance) ng12 between edges opposed to each other through the discharge cells C (or discharge gaps DG) is wider (longer) than the space ng1 between non-discharge gaps.

The distance dg1 of the discharge gaps DG is set below about 200 $\mu$m (e.g., 70 $\mu$m) and the distance ng1 of the non-discharge gaps NG is set to at least about 200 $\mu$m (e.g., 260 $\mu$m) depending on the structure of the AC-PDP, the type and pressure of discharge gas filled therein and the like. According to such size setting, the AC-PDP 53 can be reliably controlled to be capable of generating discharge in the discharge gaps DG while causing no discharge in the non-discharge gaps NG upon application of a prescribed voltage.

Thus, the discharge cells C can be rendered larger than the non-discharge cells NC due to the shapes of the aforementioned bus electrodes XAb and YAb, whereby the utilization factor for a display area can be further improved as compared with the AC-PDP 51. Therefore, discharge efficiency can be improved similarly to the AC-PDP 52. In this case, the AC-PDP 53 has such an advantage that the barrier ribs 10 can be linearly formed similarly to the AC-PDP 51 and the conventional AC-PDP 101.

The structure of the bus electrodes XAb and YAb in the AC-PDP 53 may be combined with the barrier ribs 10A of the aforementioned AC-PDP 52.

Modification 1 of Embodiment 3

Figure 9:
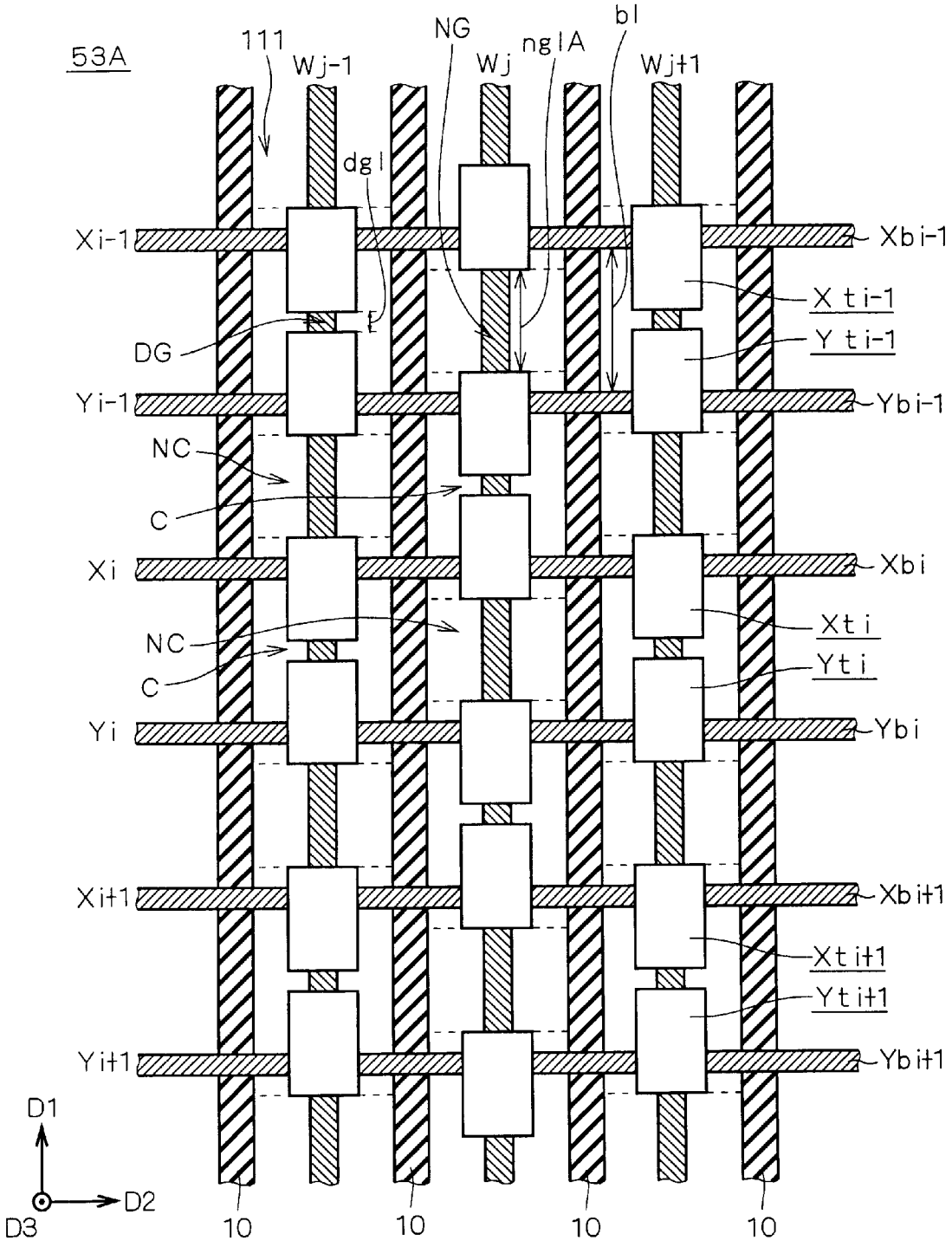
FIG. 9 is a plan view for illustrating the structure of an AC plasma display panel according to a modification 1 of the embodiment 3.

The discharge cells C can be rendered larger than the non-discharge cells NC also in an AC-PDP 53A shown in FIG. 9 for improving the utilization factor for the display area and discharge efficiency. The AC-PDP 53A is described mainly with reference to the structure of row electrodes Xi and Yi characterizing the same.

The AC-PDP 53A has a structure obtained by applying linear bus electrodes Xb and Yb (see FIG. 1 etc.) in place of the bus electrodes XAb and YAb in the AC-PDP 53 (see FIG. 8) while leaving the shape and the positions of arrangement of the transparent electrodes Xt and Yt intact. Therefore, the transparent electrodes (second portions) Xt and Yt of the AC-PDP 53A are connected with the bus electrodes Xb and Yb while extending toward a first direction D1 on both sides of the bus electrodes Xb an Yb.

Similarly to the AC-PDP 51 etc., discharge gaps DG of the AC-PDP 53A are defined by edges of the transparent electrodes Xt and Yt opposed to each other in the discharge cells C. On the other hand, gaps between edges of the transparent electrodes Xt and Yt separate from the aforementioned discharge gaps DG define the non-discharge gaps NG. The space (or distance) of the gaps is referred to as "space (or distance) ng1 A of the non-discharge gaps NG". In this case, (space dg1 of the discharge gaps DG)<(space ng1A of the non-discharge gaps NG)<(space b1 between the opposite edges of the bus electrodes Xb and Yb). In other words, the portions of the transparent electrodes Xt and Yt on the side of the aforementioned edges defining the discharge gaps DG with respect to the bus electrodes Xb and Yb are larger than the portions on the side of the aforementioned edges defining the non-discharge gaps NG.

The AC-PDP 53A corresponds to a structure obtained by extending the transparent electrodes Xt and Yt toward the side opposite to the discharge gaps DG beyond the bus electrodes Xb and Yb with respect to the AC-PDP 51. In the AC-PDP 53A, therefore, the sizes of the discharge cells C and the non-discharge cells NC do not match with the aforementioned unit areas AR (see FIG. 1 etc.). More specifically, areas extending between adjacent barrier ribs 10 along a first direction D1 and three-dimensional areas extending along a third direction D3 with respect to these areas in the plan view of FIG. 9 can be divided into a plurality of areas with lines (shown by broken lines in FIG. 9) parallel to a second direction D2 passing through edges of the transparent electrodes Xt and Yt separate from the discharge gaps DG. The divided plurality of areas can be classified into (i) portions wider than the unit areas AR along the first direction D1, comprising the discharge gaps DG and graspable as the discharge cells C and (ii) non-discharge cells NC narrower than the unit areas AR and comprising the aforementioned non-discharge gaps NG.

According to the AC-PDP 53A, the discharge cells C are larger than the non-discharge cells NC, whereby the aforementioned utilization factor for the display area and discharge efficiency can be further improved as compared with the AC-PDP 51. Further, the AC-PDP 53A has such an advantage that bus electrodes can be linearly formed similarly to the AC-PDP 51 and the conventional AC-PDP 101. As compared with the meandering bus electrodes XAb and YAb shown in FIG. 8, therefore, occurrence of inconvenience of shapes such as pattern defects of the bus electrodes can be sufficiently suppressed.

In general, there is such a tendency that a discharge cell closer to a discharge gap DG has higher luminance. In consideration of such a tendency, luminance or luminous efficiency can be increased as the positions connecting the transparent electrodes Xt and Yt with the bus electrodes are separate from the discharge gaps DG. Therefore, the AC-PDP 53 has higher luminance than the AC-PDP 53A.

The structure of the row electrodes Xi and Yi in the AC-PDP 53A may be combined with the aforementioned barrier ribs 10A (see FIG. 6) or black insulators 30 described later. Embodiments 7 and 8 described later are applicable to the structure of the row electrodes Xi and Yi of the AC-PDP 53A. Also when the transparent electrodes extend on both sides of the bus electrodes with respect to the first direction D1, it is possible to set the discharge cells C and the non-discharge cells NC to the same size by meandering the bus electrodes.

Modification 1 Common to Embodiments 1 to 3

When the distance ng1 of the non-discharge gaps NG of the aforementioned AC-PDP 53 is equivalent to that in the AC-PDP 51, surface discharge formed between the transparent electrodes Xt and Yt through the discharge gaps DG can be rendered larger than that in the AC-PDP 51 since the size of the transparent electrodes Xt and Yt of the AC-PD 53 along the first direction D1 is longer than that in the AC-PDP 51. If the height (size along the third direction D3) of the surface discharge is excessive, this discharge may collide with the rear glass substrate 103 (see FIG. 25) to result in loss of (the energy of) electrons in discharge. Such a discharge state can be sufficiently caused also when supplied power is large in the AC-PDP 51 or the like.

While a higher voltage may be applied in order to compensate for the loss resulting from collision for maintaining the surface discharge, power consumption is increased. Means capable of suppressing/avoiding collision of the surface discharge with the rear glass substrate 103 include means of increasing the height of the barrier ribs in response to enlargement of the transparent electrodes Xt and Yt.

Figure 10:
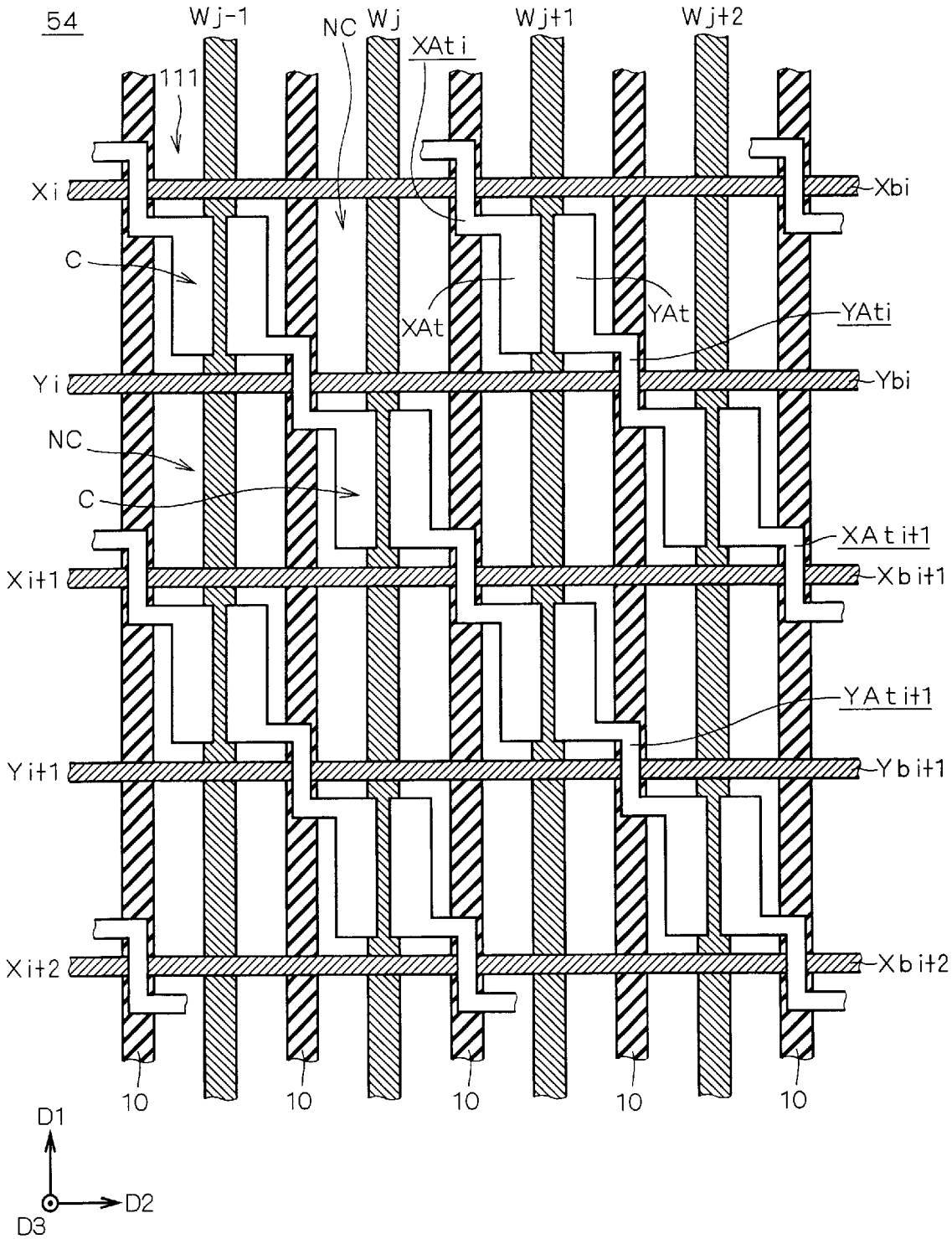
FIG. 10 is a plan view for illustrating the structure of an AC plasma display panel according to a common modification 1 of the embodiments 1 to 3.
Figure 11:
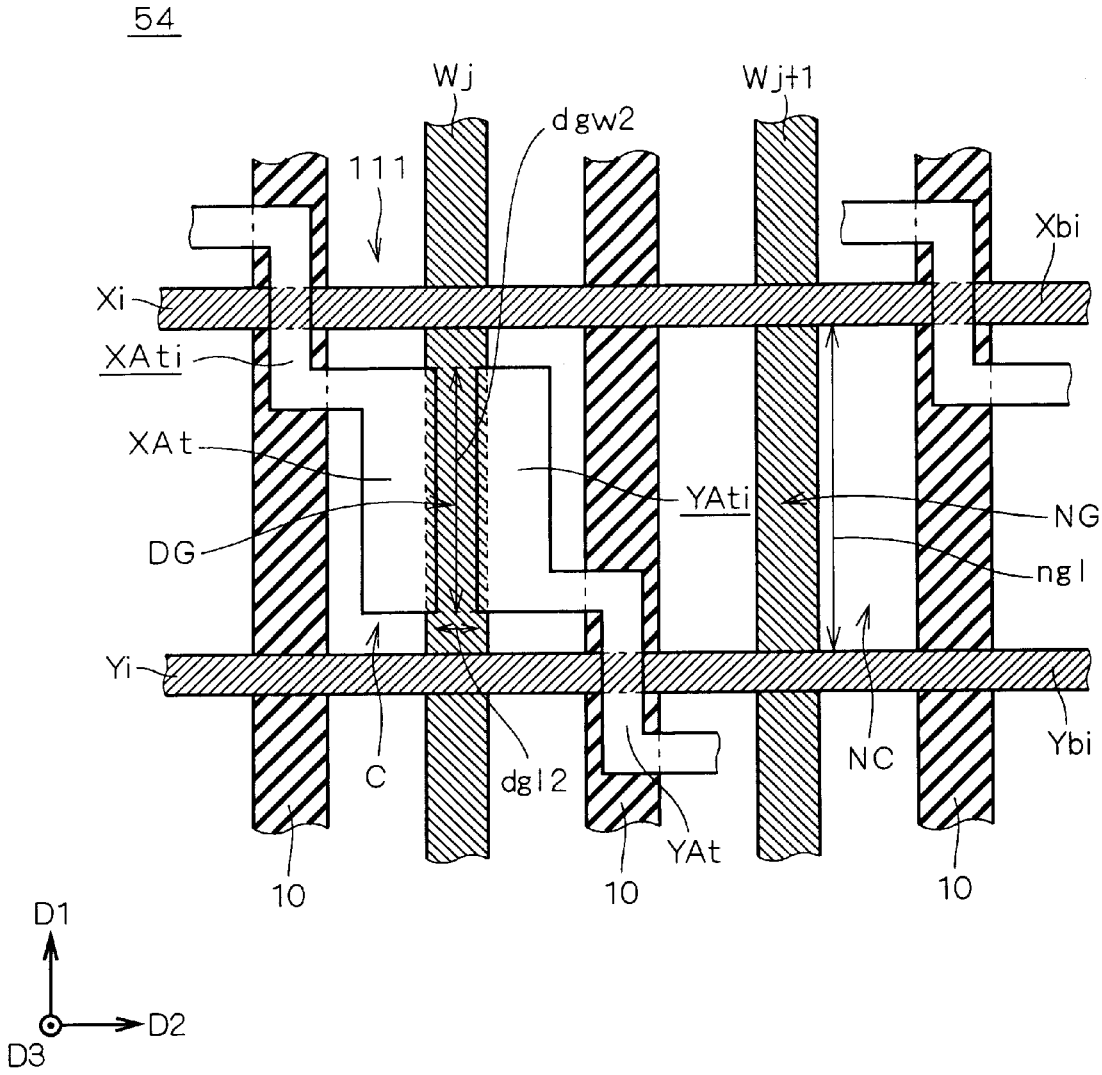
FIG. 11 is a plan view showing a principal part of the structure of the AC plasma display panel according to the common modification 1 of the embodiments 1 to 3 in an enlarged manner.

Further, the aforementioned collision of the surface discharge with the rear glass substrate 103 can also be suppressed/avoided by applying an electrode structure disclosed in Japanese Patent Application Laid-Open No. 9-231907 (1997), for example, to the AC-PDP 53. An AC-PDP 54 according to a common modification 1 of the embodiments 1 to 3 is described with reference to a plan view of FIG. 10 corresponding to FIG. 1 and FIG. 11 illustrating a principal part of FIG. 10 in an enlarged manner. As shown in FIGS. 10 and 11, the AC-PDP 54 is similar in structure to the AC-PD 51 except the shapes of transparent electrodes XAt and YAt.

In particular, the transparent electrodes XAt and YAt of the AC-PDP 54 are connected with bus electrodes Xb and Yb and have portions extending toward two discharge cells C obliquely opposed to each other through the bus electrodes Xb and Yb, as shown in FIGS. 10 and 11. As shown in FIG. 11, opposite edges of the transparent electrodes XAt and YAt arranged in each discharge cell C along a first direction D1 define a discharge gap DG. When a unit area AR has a vertically long shape, i.e. when the distance between adjacent bus electrodes is longer than the distance between adjacent barrier ribs, a gap length (or width) dgw2 of the discharge gap DG of the AC-PDP 54 along the first direction D1 is larger than the gap length dgw (see FIG. 2) in the AC-PDP 51. A gap space (or distance) dg12 along a second direction D2 is equivalent to the gap space dg1 (see FIG. 2) in the AC-PDP 51.

According to the AC-PDP 54, therefore, the size of the transparent electrodes XAt and YAt along the direction perpendicular to the longitudinal direction of the discharge gaps DG (or the second direction D2) is shorter than that in the AC-PDP 51 or the like, whereby the height of surface discharge between the transparent electrodes XAt and YAt can be rendered lower than that in the AC-PDP 51 or the like. Therefore, collision of the aforementioned surface discharge with the rear glass substrate 103 can be suppressed/avoided. It is possible to sufficiently compensate for the size of the overall discharge by increasing the gap length dgw2, and also when the discharge cells C are enlarged, the non-discharge cells NC can be kept small by applying the structure of the bus electrodes of the AC-PDP 53 (see FIG. 8).

Selection as to whether to render the discharge gaps DG along the second direction D2 as in the AC-PDP 51 or along the first direction D1 as in the AC-PDP 54 may be defined on the basis of the shape of the unit areas AR. The aforementioned effect can be attained by forming the discharge gaps DG along the longer one of the sizes of the unit areas AR along the first direction D1 or the second direction D2.

While the number of materials, processes or the like is increased due to the increase of the height of the barrier ribs in the aforementioned means of adjusting the height of the barrier ribs for suppressing/avoiding collision of the surface discharge with the rear glass substrate 103, the AC-PDP 54 has such an advantage that the formation pattern of the transparent electrodes Xt and Yt may simply be changed.

Figure 12:
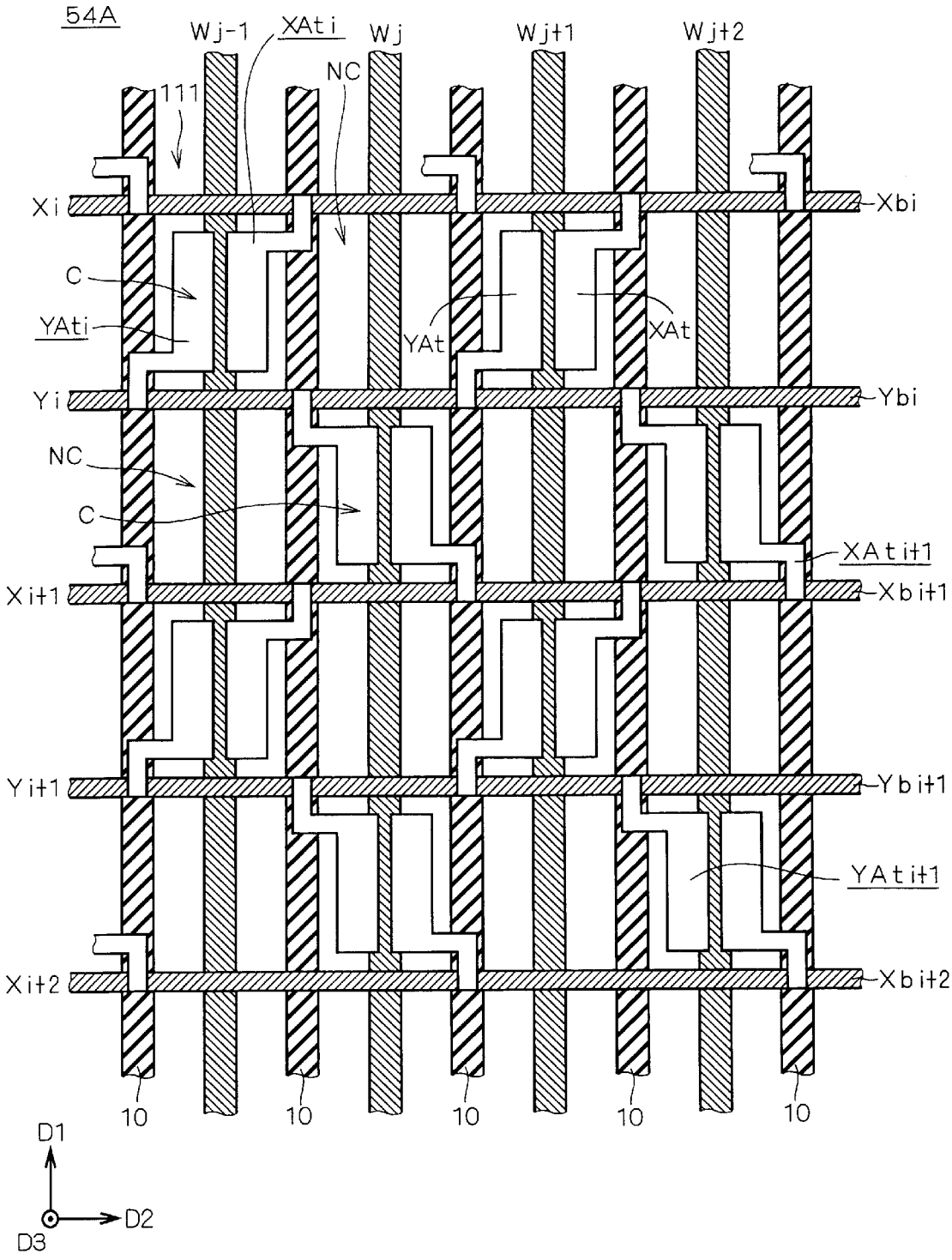
FIG. 12 is a plan view for illustrating another structure of the AC plasma display panel according to the common modification 1 of the embodiments 1 to 3.

The transparent electrodes arranged in the discharge cells C shown in FIG. 11 can be connected to both of the bus electrodes Xb and Yb arranged above and under the transparent electrodes along the first direction D1. 1n this case, (i) a mode (hereinafter referred to as "connection mode (i)") of connecting two transparent electrodes present between two obliquely located discharge gaps DG to the bus electrode Xb or Yb present between the two discharge gaps DG is formable, as in the AC-PDP 54 shown in FIG. 10 (and FIG. 11). Further, (ii) as in an AC-PDP 54A shown in FIG. 12, a mode (hereinafter referred to as "connection mode (ii)") of connecting a left bus electrode in the upper left discharge cell C in FIG. 12 (referred to as first discharge cell C) to a bus electrode Ybi while connecting a right transparent electrode to a bus electrode Xbi and further connecting a left transparent electrode of a discharge cell C (referred to as second discharge cell C) located right under the first discharge cell C to the bus electrode Ybi while connecting a right transparent electrode to a bus electrode Xbi+1 is also formable. The connection mode of the transparent electrodes in the second discharge cell C is similar to that shown in FIG. 10.

While the AC-PDP can be driven with both of the connection modes (i) and (ii), the following difference is recognized: The AC-PDP 54 having the connection mode (i) shown in FIG. 10 can set transparent electrodes adjacent to (obliquely opposed to) each other through a single bus electrode to the same potential. As compared with the AC-PDP 54A having the aforementioned connection mode (ii), therefore, the degree of change of electric fields in the overall AC-PDP can be loosened. Therefore, the AC-PDP 54 attains such an effect that reactive power (power generated by capacitance regardless of discharge) can be remarkably suppressed as compared with the AC-PDP 54A.

The transparent electrodes XAt and YAt of the AC-PDPs 54 and 54A are applicable to all of the aforementioned AC-PDPs 51, 51A, 52 and 53 and AC-PDPs 55, 58 and 58A (see FIGS. 13, 19 and 20) described later. In this case, barrier ribs can be lowered due to the reduced height of the discharge, for consequently attaining effects of simplification of a barrier rib forming step and reduction of the cost.

Embodiment 4

Figure 13:
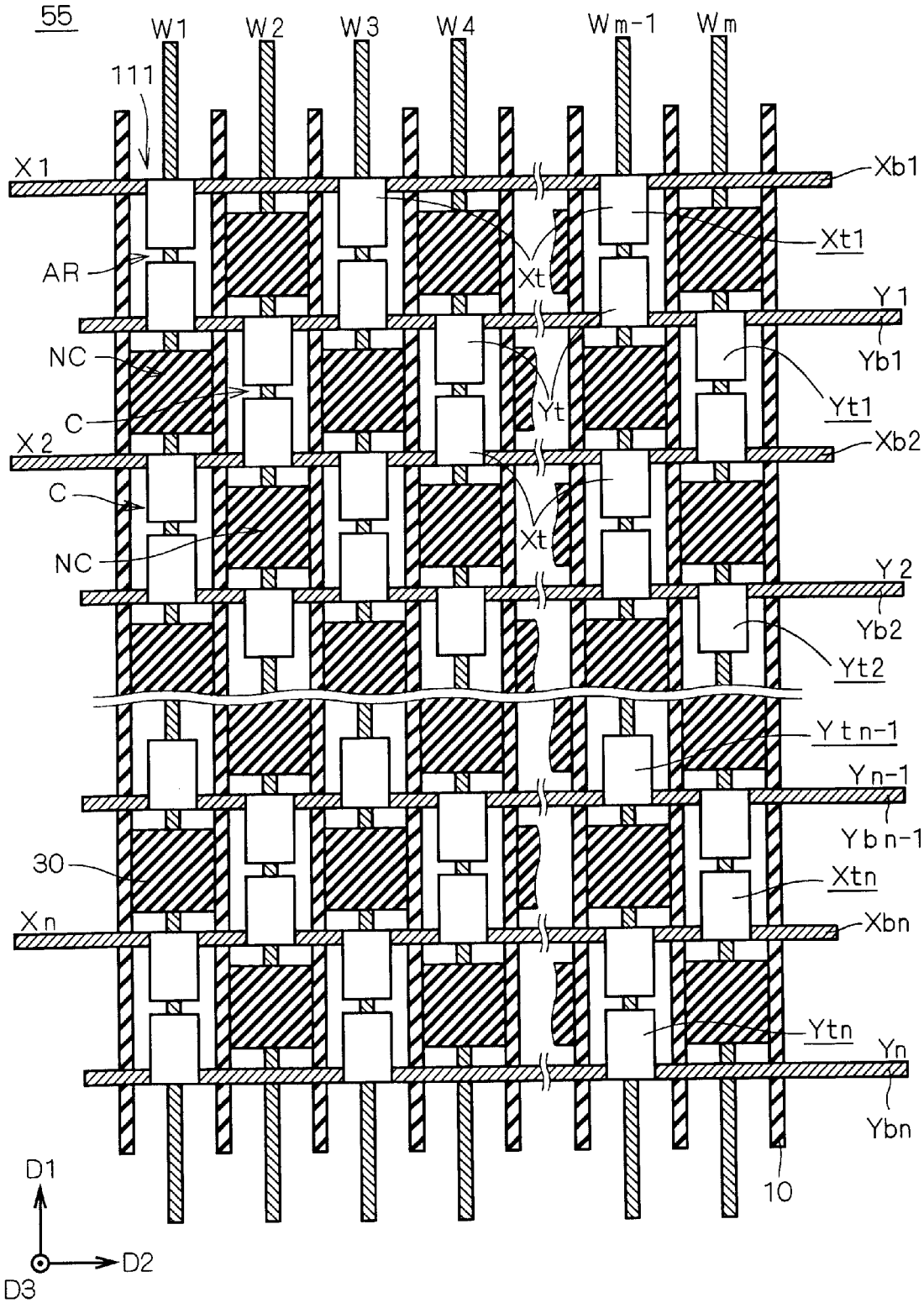
FIG. 13 is a plan view for illustrating the structure of an AC plasma display panel according to an embodiment 4 of the present invention.

An AC-PDP 55 according to an embodiment 4 of the present invention is now described with reference to a plan view of FIG. 13 corresponding to FIG. 1. As shown in FIG. 13, the AC-PDP 55 is similar in basic structure to the aforementioned AC-PDP 51.

As shown in FIG. 13, black insulators 30 are arranged in non-discharge cells NC of the AC-PDP 55 on the side of a front glass substrate 102 (see FIG. 25) not to be in contact with the side of a rear glass substrate 103. Such black insulators 30 can be formed with a material and a formation process for conventional black stripes. It is obvious from the following description that the black insulators 30 may be arranged in the aforementioned AC-PDP 52 or the like, and this also applies to an AC-PDP 56 or the like described later.

Such black insulators 30 can improve the contrast ratio of the AC-PDP. When the aforementioned (linear) black stripes are provided on the conventional AC-PDP 101, the display lines and the black stripes are clearly separated as transverse lines, i.e., the discharge cells are held between adjacent black stripes, and hence the phosphor layers white in non-luminous states may be so conspicuous that a sufficient effect of improving the contrast cannot be attained. In the AC-PDP 55, on the other hand, the black insulators 30 arranged in the non-discharge cells NC are dispersed along the overall AC-PDP 55. Therefore, the AC-PDP 55 remarkably improves the contrast and visuality as compared with the conventional AC-PDP having black stripes. Needless to say, the black insulators 30 may be arranged in areas other than discharge cells C in order to attain such an effect.

Further, the black insulators 30 are arranged in non-discharge gaps NG and hence portions of the non-discharge gaps NG in discharge spaces 111, i.e., non-discharge areas are rendered narrower due to the black insulators 30. Considering that discharge is hardly caused in a narrow discharge space in general, occurrence of discharge (false discharge) in the non-discharge cells NC can be more reliably suppressed due to the black insulators 30. In other words, the height or thickness (size in a third direction D3) of the black insulators 30 may be defined in view of prevention of occurrence of discharge in the non-discharge cells NC. When the black insulators 30 are provided on the side of the front glass substrate 102 of the aforementioned AC-PDP 53 (see FIG. 8), the distance ng1 of the non-discharge gaps NG can be more reduced so that the discharge cells C can be further enlarged or high resolution can be attained.

The black insulators 30 are arranged not to be in contact with the side of the rear glass substrate 103, i.e., gaps or spaces are provided between the front glass substrate 102 and the rear glass substrate 103, whereby no inconvenience results from such a structure that barrier ribs completely enclose discharge cells in an exhaust step and a discharge gas introduction step included in steps of manufacturing the PDP and discharge controllability in driving of the PDP, dissimilarly to the conventional AC-PDP 201.

Figure 25:
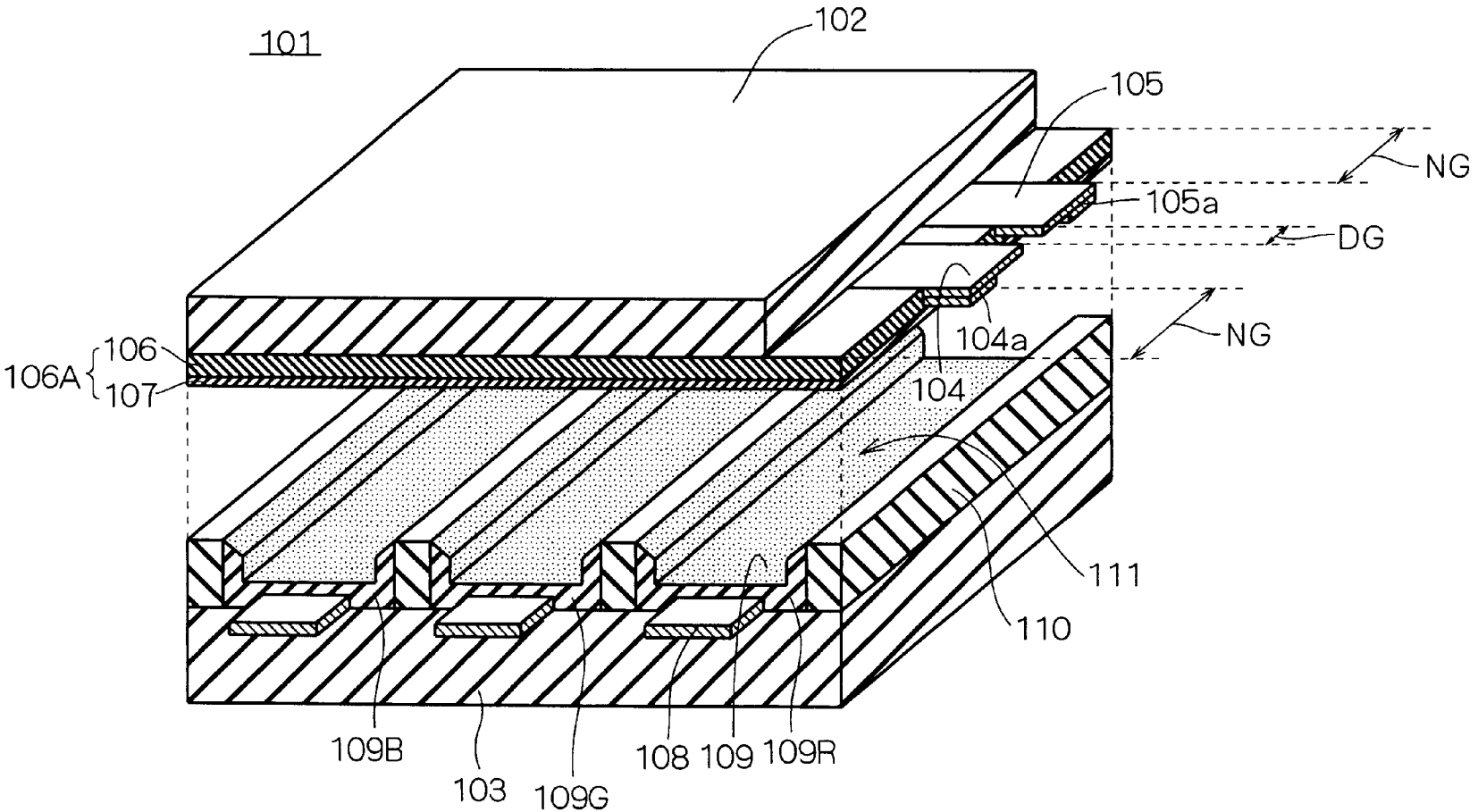
FIG. 25 PRIOR ART
FIG. 25 is a perspective view showing the structure of an AC plasma display panel according to first background art.
Figure 26:
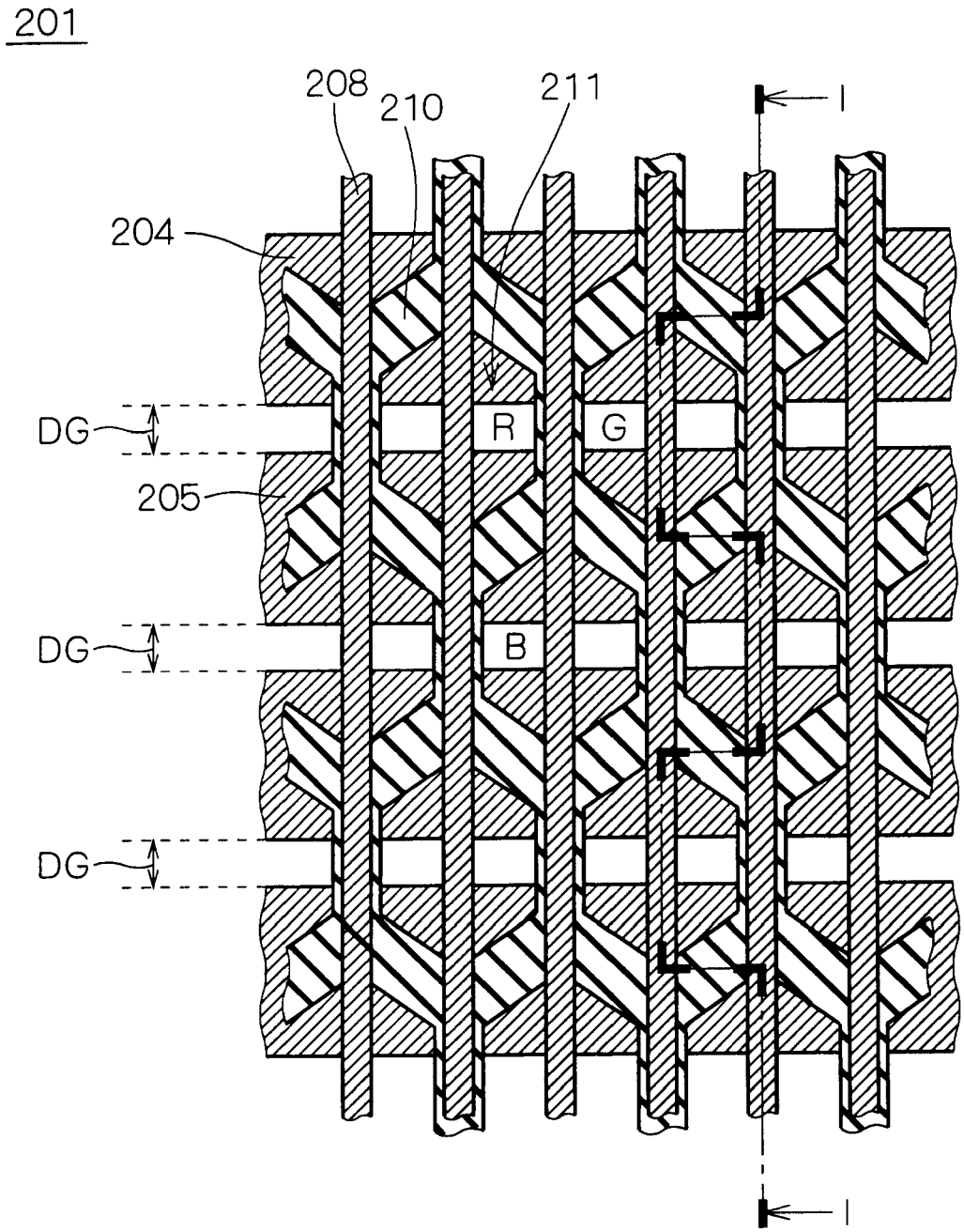
FIG. 26 PRIOR ART
FIG. 26 is a plan view showing the structure of an AC plasma display panel according to second background art.
Figure 27:
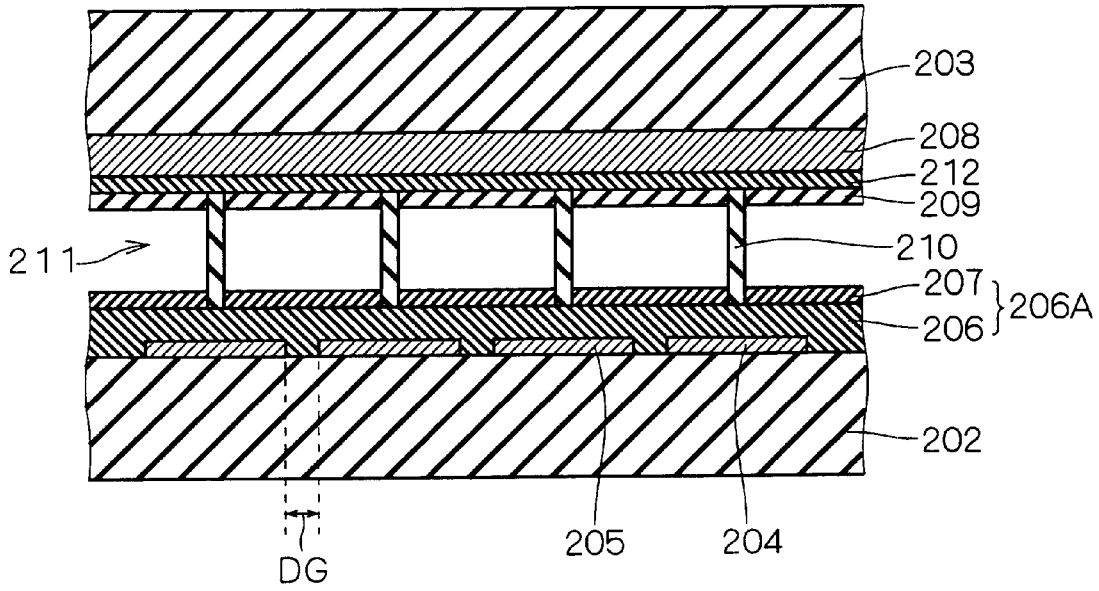
FIG. 27 PRIOR ART
FIG. 27 is a longitudinal sectional view showing the structure of the AC plasma display panel according to the second background art.
Figure 28:
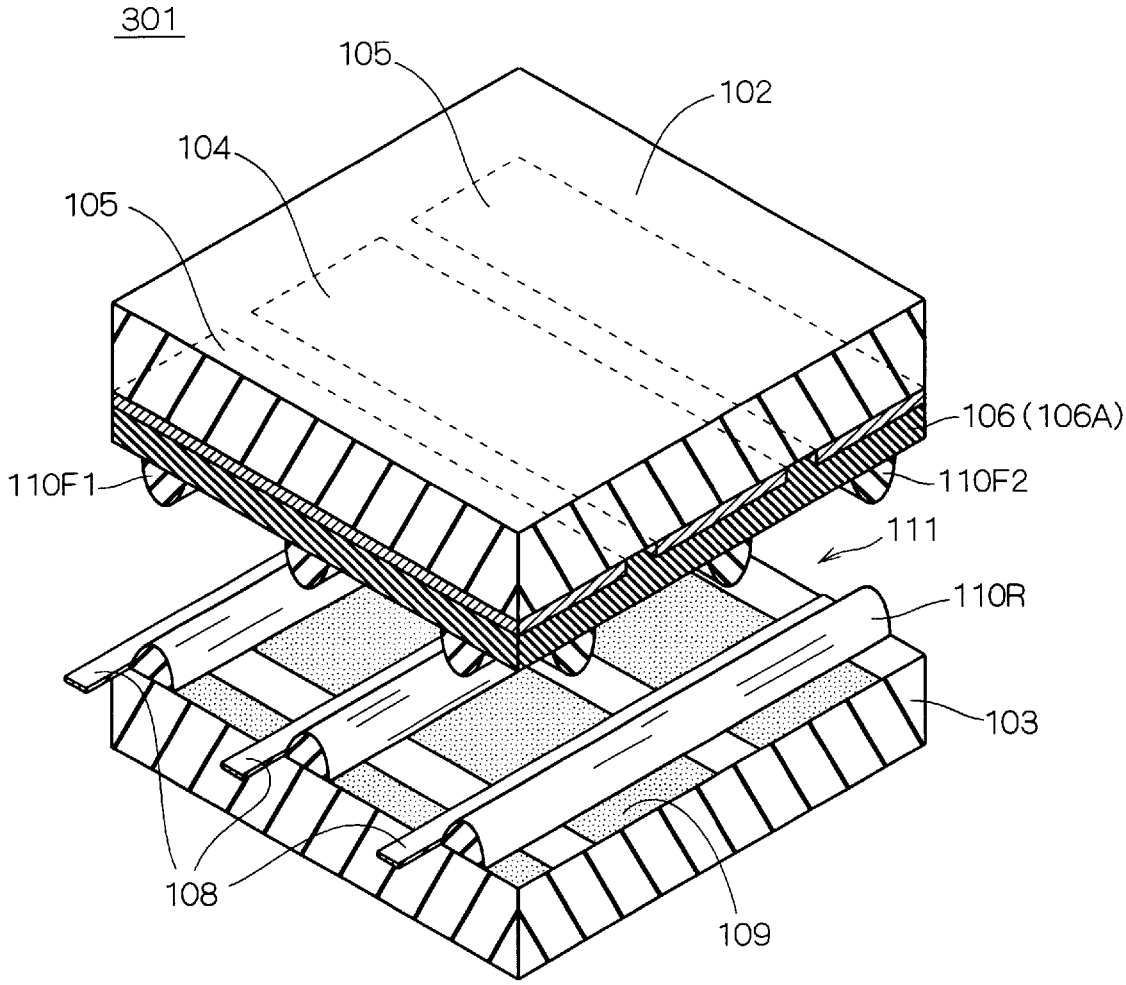
FIG. 28 PRIOR ART
FIG. 28 is a perspective view showing the structure of an AC plasma display panel according to third background art.

The black insulators 30 may alternatively be provided on the side of the rear glass substrate 103 (see FIG. 25). When adding a material for blackening to a material for barrier ribs in this case, for example, the black insulators 30 can be formed as the whole or parts of the barrier ribs. In this case, the black insulators 30 are formed lower than the barrier ribs not to be in contact with the side of the front glass substrate 102.

Embodiment 5

In the aforementioned AC-PDP 51 or the like, alignment must be so performed as to arrange the transparent electrodes Xt and Yt in prescribed regions between adjacent barrier ribs 10 in a step of bonding the front glass substrate 102 and the rear glass substrate 103 to each other and hence a high-degree alignment technique is required at this time. Therefore, the transparent electrodes Xt and Yt may be misaligned from the barrier ribs 10. Also when the front glass substrate 102 and/or the rear glass substrate 103 is distorted or warped, misalignment may be caused between the transparent electrodes Xt and Yt and barrier ribs 10. Therefore, an embodiment 5 of the present invention is described with reference to an AC-PDP 56 capable of relaxing alignment accuracy in the aforementioned bonding step.

Figure 14:
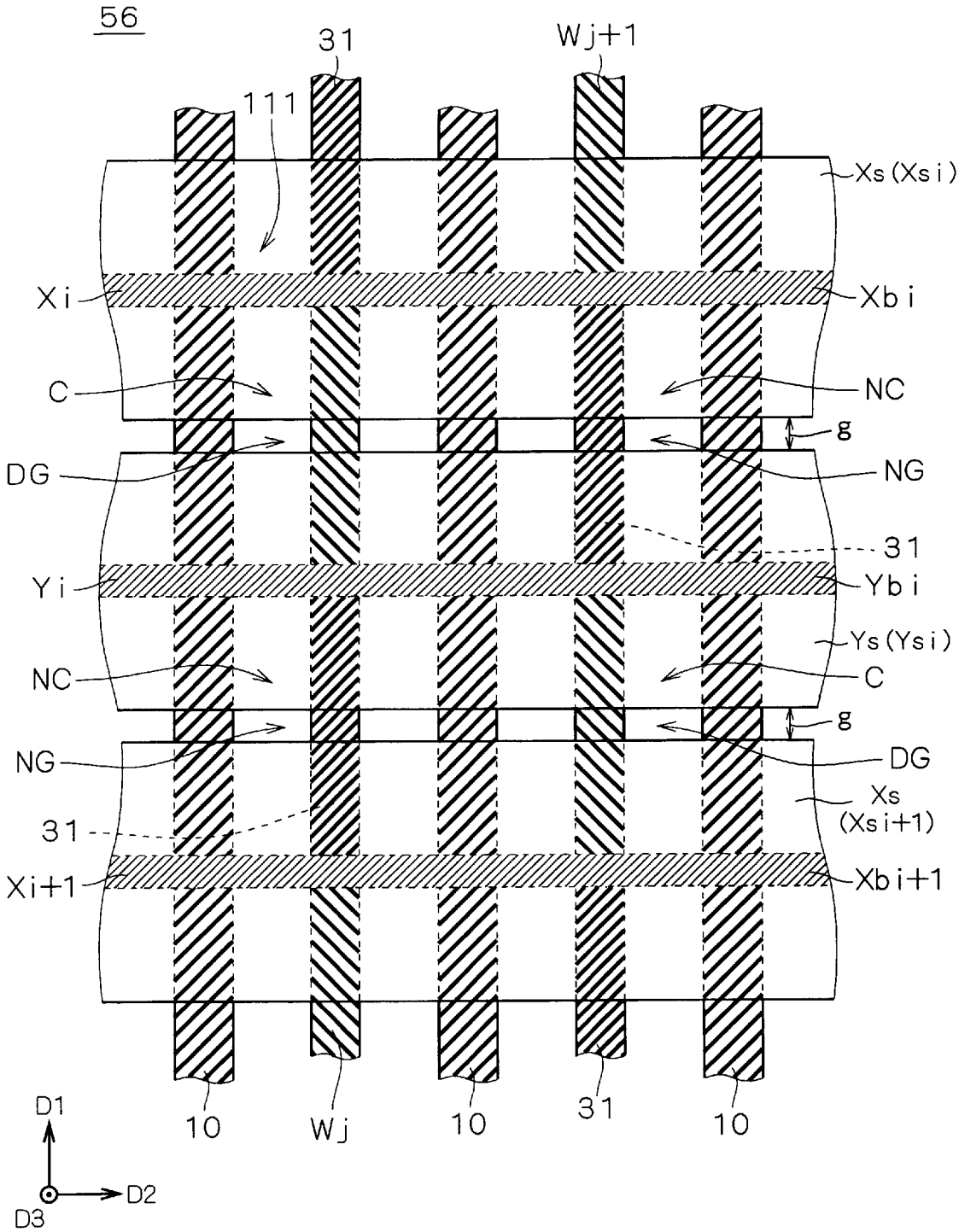
FIG. 14 is a plan view for illustrating the structure of an AC plasma display panel according to an embodiment 5 of the present invention.
Figure 15:
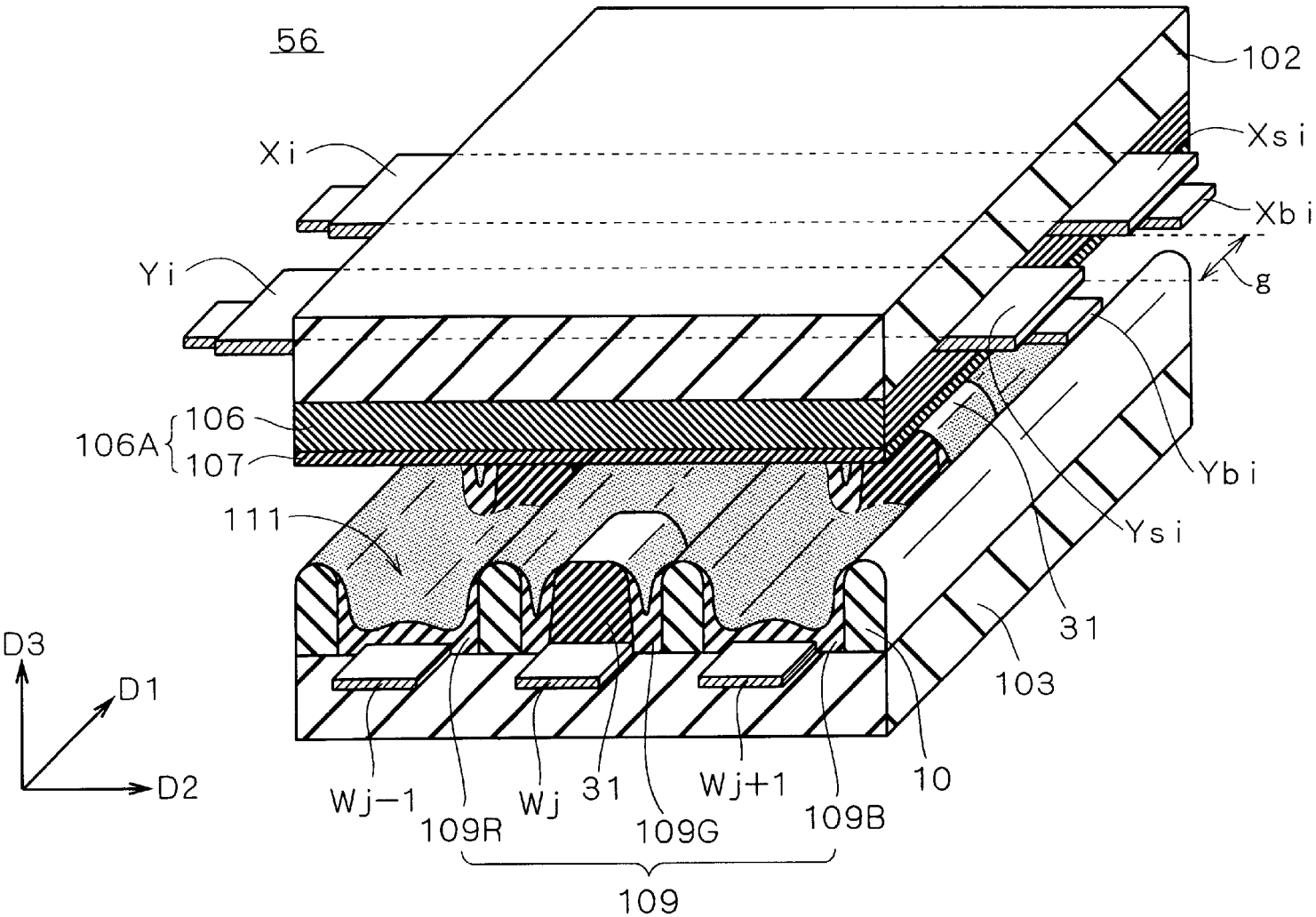
FIG. 15 is a perspective view for illustrating the structure of the AC plasma display panel according to the embodiment 5.

FIG. 14 is a typical plan view showing the AC-PDP 56 in correspondence to FIG. 1. FIG. 15 is a typical perspective view of the AC-PDP 56. For convenience of illustration, FIG. 15 illustrates glass substrates 102 and 103 in a separated state while showing a portion around discharge suppressors 31 described later in a partially fragmented manner.

Figure 29:
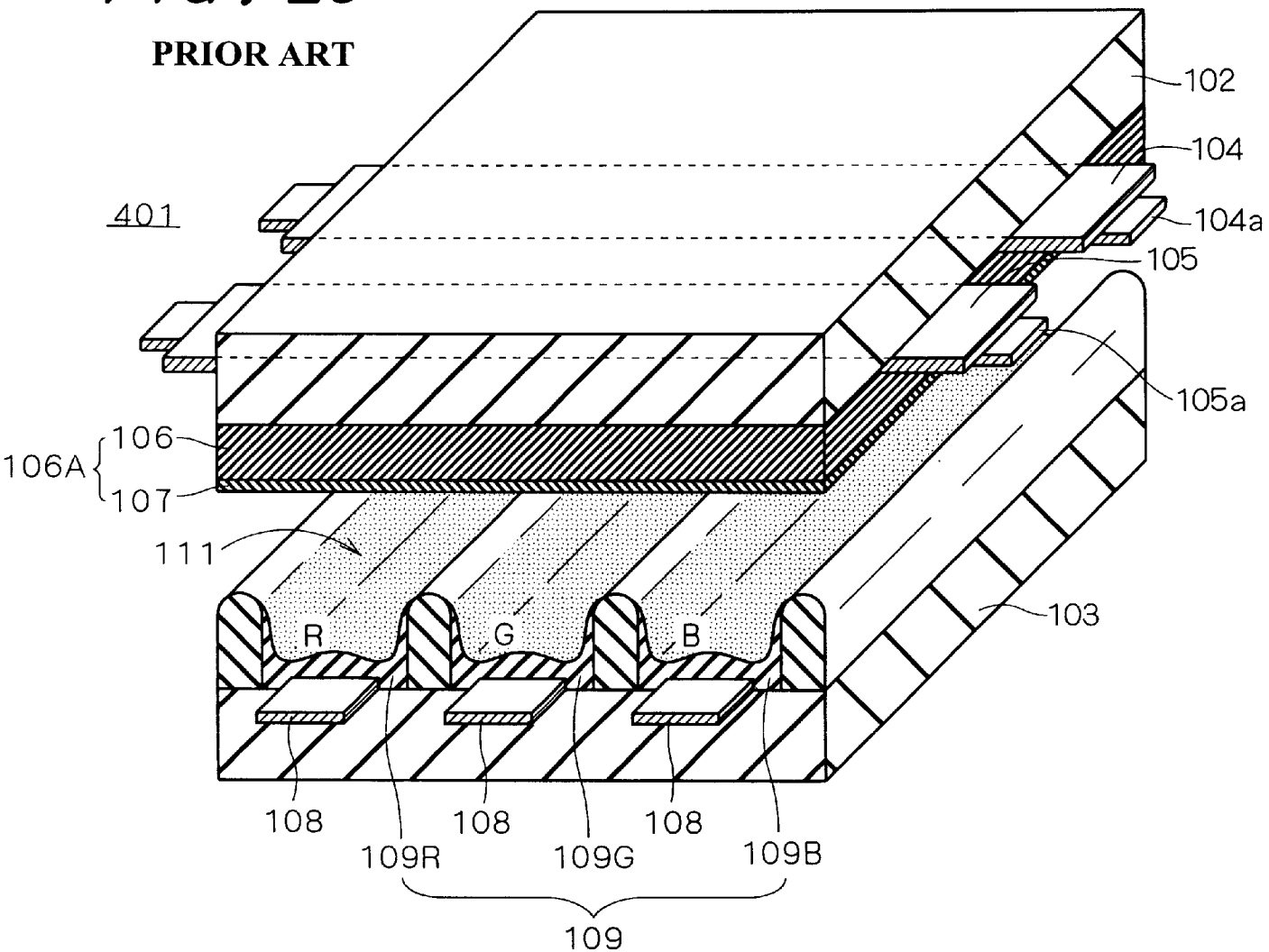
FIG. 29 PRIOR ART
FIG. 29 is a perspective view showing the structure of an AC plasma display panel according to fourth background art.

As shown in FIG. 14, the AC-PDP 56 comprises row electrodes X1 to Xn and Y1 to Yn similar to the row electrodes 104 and 105 of the aforementioned conventional AC-PDP 401 shown in FIG. 29. More specifically, row electrodes Xi and Yi of the AC-PDP 56 are formed by the aforementioned bus electrodes Xbi and Ybi and strip transparent electrodes (second portions) Xs and Ys (the relation with the bus electrodes Xbi and Ybi is clarified as "transparent electrodes Xsi and Ysi" with subscripts i when particularly necessary) extending along a second direction D2 i.e., the longitudinal direction of the bus electrodes Xbi and Ybi. In the AC-PDP 56, the transparent electrodes Xsi and Ysi are lager in width than the bus electrodes Xbi and Ybi, and the bus electrodes Xbi and Ybi are arranged substantially at the centers along the width of the transparent electrodes Xsi and Ysi so that the transparent electrodes Xsi and Ysi and the bus electrodes Xbi and Ybi are connected with each other. In other words, the transparent electrodes Xsi and Ysi extend on both sides of the bus electrodes Xbi and Ybi along a first direction D1 perpendicular to the longitudinal direction of the bus electrodes Xbi and Ybi. In particular, the size (or space or distance) of gaps g between adjacent transparent electrodes Xs and Ys are equally set substantially identically to the aforementioned space dg1 (see FIG. 2) of the discharge gaps DG.

As shown in FIGS. 14 and 15, the AC-PDP 56 comprises the discharge suppressors 31 consisting of an insulating material in unit areas AR (see FIG. 1) corresponding to the non-discharge cells NC in the aforementioned arrangement relation shown in FIG. 3. More specifically, the discharge suppressors 31 are formed on the side of the rear glass substrate 103, and arranged on positions covering portions of respective column electrodes W1 to Wm corresponding to the non-discharge cells NC while covering gaps g between adjacent transparent electrodes Xs an Ys when viewing the AC-PDP 56 from a third direction D3.

Top portions of the discharge suppressors 31 closer to the front glass substrate 102 are set to a height level equivalent to that of top portions of barrier ribs 10, while spaces are provided therebetween so that the discharge suppressors 31 and the barrier ribs 10 are not in contact with each other.

In the AC-PDP 56, the discharge suppressors 31 are set to the height level equivalent to that of the barrier ribs 10, i.e., the discharge suppressors 31 are in contact with a dielectric layer 106A on the side of the front glass substrate 102, whereby no spaces capable of forming discharge are present on the grade-separate intersections between the gaps g between the adjacent transparent electrodes Xs and Ys and the column electrodes W1 to Wm in the non-discharge cells NC. Also when the gaps g between the adjacent transparent electrodes Xs and Ys are set to a size substantially equivalent to the aforementioned space dg1 (see FIG. 2) of the discharge gaps, therefore, the plurality of unit areas AR (see FIG. 1 etc.) of the AC-PDP 56 are separated into the non-discharge cells NC and the discharge cells C defined by presence/absence of the discharge suppressors 31. In particular, the unit areas AR can be converted to non-discharge cells by arranging the discharge suppressors 31 at least on the grade-separate intersections between the gaps g between the adjacent transparent electrodes Xs and Ys and the column electrodes W1 to Wm. The discharge gaps DG are defined by edges of portions of the adjacent transparent electrodes Xs and Ys opposed to each other in the discharge cells C while the non-discharge gaps NG are defined by edges of portions of the adjacent transparent electrodes Xs and Ys opposed to each other in the non-discharge cells NC.

According to the AC-PDP 56, the non-discharge cells NC and the discharge cells C are defined due to presence/absence of the discharge suppressors 31, whereby not a plurality of transparent electrodes Xt and Yt but strip transparent electrodes Xs and Ys are applicable to each of the bus electrodes Xb and Yb, dissimilarly to the aforementioned AC-PDP 51 or the like. Therefore, no high-accuracy alignment is required for arranging the transparent electrodes Xt and Yt in the prescribed regions between the adjacent barrier ribs 10 in the bonding step for the front glass substrate 102 and the rear glass substrate 103, dissimilarly to the aforementioned AC-PDP 51 or the like. Further, the discharge suppressors 31 provided on the side of the rear glass substrate 103 define the non-discharge cells NC as described above, whereby the discharge cells C and the non-discharge cells NC can be reliably formed also when the rear glass substrate 102 and the rear glass substrate 103 are displaced from each other in the aforementioned bonding step or the front glass substrate 102 and/or the rear glass substrate 103 has distortion or the like. Thus, according to the AC-PDP 56, alignment accuracy in the aforementioned bonding step is relaxed as compared with the AC-PDP 51 or the like, whereby the yield can be consequently improved.

Further, the discharge suppressors 31 having the height level equivalent to the barrier ribs 10 can be formed simultaneously with the barrier ribs 10. For example, the barrier ribs 10 and the discharge suppressors 31 can be collectively formed by screen printing employing a screen plate having both patterns of the barrier ribs 10 and the discharge suppressors 31. Alternatively, a raw material for the barrier ribs 10 entirely applied to the side of the rear glass substrate 103 can be simultaneously pattern-formed into the shapes of the barrier ribs 10 and the discharge suppressors 31, for example. Such patterning can be implemented by applying sandblasting or the like after pattern-exposing resist arranged on the raw material or the raw material supplied with photosensitivity into the shapes of the barrier ribs 10 and the discharge suppressors 31. Thus, no separate step is required for the discharge suppressors 31, so that the discharge suppressors 31 can be formed without increasing the number of manufacturing steps and complicating the manufacturing steps.

The discharge suppressors 31 and the barrier ribs 10 are not in contact with each other but spaces are provided therebetween, not to hinder execution of an exhaust step and a discharge gas introduction step when manufacturing the AC-PDP.

Figure 16:
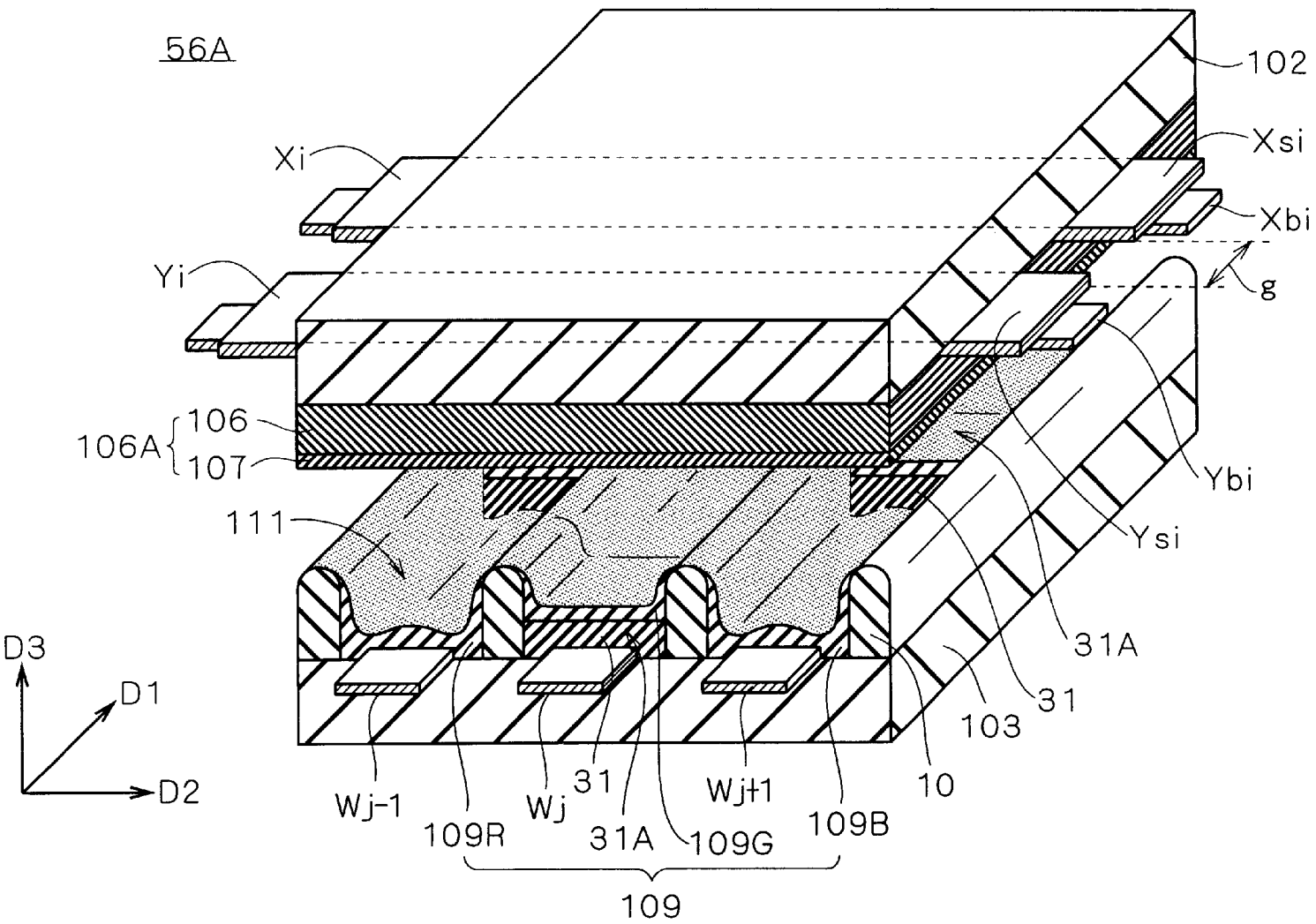
FIG. 16 is a perspective view for illustrating another structure of the AC plasma display panel according to the embodiment 5.

The discharge suppressors 31 may be formed lower than the barrier ribs 10, as in an AC-PDP 56A shown in FIG. 16. When phosphor layers 109 are arranged on top portions of the discharge suppressors 31 closer to a front glass substrate 102 as shown in FIG. 16, elements consisting of the discharge suppressors 31 and portions of the phosphor layers 109 located on the top portions are referred to as "discharge suppressors 31A." While spaces are provided between the discharge suppressors 31 and 31A and a dielectric layer 106A in the AC-PDP 56A, the discharge suppressors 31 and 3 1A are provided with shapes/sizes capable of suppressing discharge formation in non-discharge cells NC. More specifically, the shapes/sizes of the discharge suppressors 31 and 31 A are so set that a voltage necessary for forming discharge in the non-discharge cells NC is higher than the voltage for discharge cells due to narrowness of the aforementioned spaces or discharge spaces 111. Also in this case, the discharge suppressors 31 and 31A of the AC-PDP 56A are arranged at least on grade-separate intersections between gaps g between adjacent transparent electrodes Xs and Ys and column electrodes W1 to Wm. The discharge suppressors 31 and 31A of the AC-PDP 56A may alternatively be in contact with the barrier ribs 10 as shown in FIG. 16, and execution of the aforementioned exhaust step and discharge gas introduction step is not hindered also in this case since the aforementioned spaces are provided between the discharge suppressors 31 and 31A and the dielectric layer 106A.

Embodiment 6

The aforementioned discharge suppressors 31 narrow the discharge spaces 111 of the non-discharge cells NC below those of the discharge cells C while increasing an applied voltage necessary for discharge formation beyond that for the discharge cells C thereby suppressing discharge formation in the non-discharge cells NC. In consideration of such action of the discharge suppressors 31, it is also possible to attain the effect of the embodiment 5 by forming elements corresponding to the discharge suppressors 31 on the side of the front glass substrate 102. An embodiment 6 of the present invention is now described as to an AC-PDP 57 having such a structure with reference to a longitudinal sectional view shown in FIG. 17.

Figure 17:
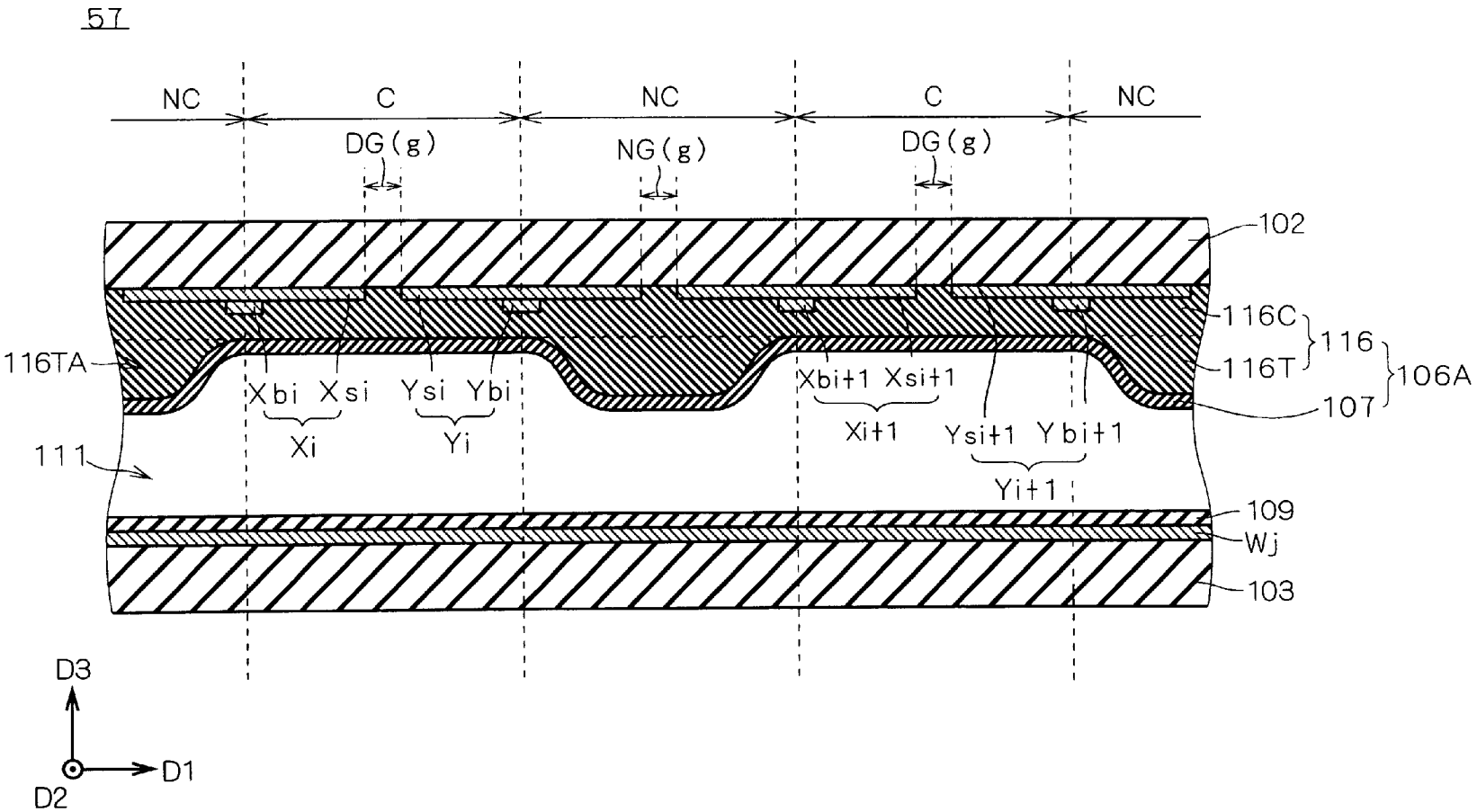
FIG. 17 is a longitudinal sectional view for illustrating the structure of an AC plasma display panel according to an embodiment 6 of the present invention.

As shown in FIG. 17, the AC-PDP 57 comprises a dielectric layer 116 having prescribed thickness distribution on the side of a front glass substrate 102, in place of the aforementioned dielectric layer 106 (see FIG. 7). In more detail, the dielectric layer 116 consists of an electrode covering portion 116C equivalent to the aforementioned dielectric layer 106 and convex portions 116T arranged in non-discharge cells NC to project from the electrode covering portion 116C toward a rear glass substrate 103. When having the aforementioned protective film 107 on the surface of the dielectric layer 116 closer to the rear glass substrate 103 as shown in FIG. 17, an element consisting of the dielectric layer 116 and the protective film 107 corresponds to the aforementioned "dielectric layer 106A", and elements consisting of the convex portions 116T and portions of the protective film 107 located on the convex portions 116T can be grasped as "convex portions (or discharge suppressors) 116TA of the dielectric layer 106A".

In this case, the shapes/sizes of the convex portions 116T and 116TA are so set that a voltage necessary for forming discharge in the non-discharge cells NC is higher than that in discharge cells C. For example, the thickness of the electrode covering portion 116C located on transparent electrodes Xs and Ys is set to about 25 $\mu$m, and the thickness or height between the transparent electrodes Xs and Ys and the tops of the convex portions 116T or 16TA is set to about 50 $\mu$m.

In particular, the convex portions 116T and 116TA are arranged at least on grade-separate intersections between gaps g between adjacent transparent electrodes Xs and Ys and column electrodes W1 to Wm thereby converting unit areas AR to non-discharge cells, similarly to the discharge suppressors 31. Thus, the convex portions 116T and 116TA of the dielectric layer 116 correspond to the aforementioned discharge suppressors 31 and 31A (see FIGS. 14 to 16) in the AC-PDP 57, and the non-discharge cells NC and the discharge cells C are defined due to presence/absence of the convex portions 116T and 116TA.

The dielectric layer 116 is formed by printing in the following method, for example: First, dielectric paste is applied to the overall surface on the side of the front glass substrate 102, for forming the electrode covering portion 116C. Then, dielectric paste is applied onto the electrode covering portion 116C with a screen plate corresponding to the pattern of the convex portions 116T, for forming the convex portions 116T. A drying/sintering step for the dielectric paste may be executed after forming the electrode covering portion 116C and the convex portions 116T respectively, or may be collectively executed after forming the convex portions 116T.

The AC-PDP 57 can attain the following effect along with the effect of the aforementioned embodiment 5: The aforementioned convex portions 116T and 116TA serve as guides into U-shaped trenches defined by adjacent barrier ribs 110 in a bonding step for the front glass substrate 102 and the rear glass substrate 103, whereby the front glass substrate 102 and the rear glass substrate 103 are hardly displaced. Consequently, the yield can be improved.

Figure 18:
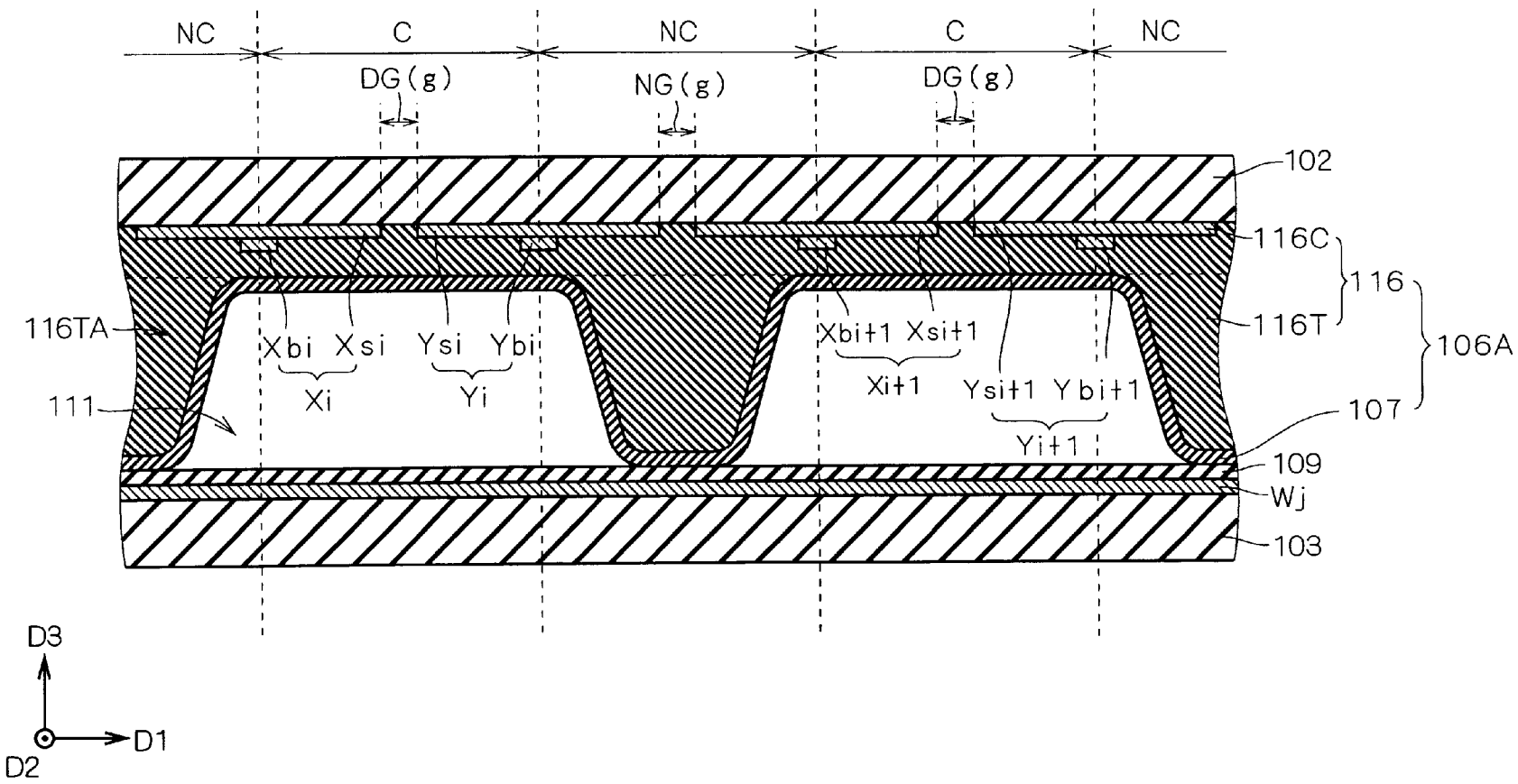
FIG. 18 is a longitudinal sectional view for illustrating another structure of the AC plasma display panel according to the embodiment 6.

Dissimilarly to the shapes/sizes of the convex portions 116T of the dielectric layer 116 illustrated in FIG. 17, convex portions 116TA (convex portions 116T of the dielectric layer 116 when having no protective film 107 thereon) of a dielectric layer 106A may be in contact with phosphor layers 109 on the side of a rear glass substrate 103 as in an AC-PDP 57A shown in FIG. 18. In this case, the shapes/sizes of the convex portions 116T or 116TA are so set that the protective film 107 on the convex portions 116T or the convex portions 116TA of the dielectric layer 106A are not in contact with barrier ribs 10.

Modification 1 Common to Embodiments 5 and 6

High contrast and visuality can be attained by blackening at least portions of the discharge suppressors 31 and the convex portions 116T and 116TA of the dielectric layer 116 closer to the front glass substrate 102, similarly to the aforementioned black insulators 30 (see FIG. 13).

The aforementioned meandering barrier ribs 10A (see FIG. 6) or meandering bus electrodes XAb and YAb may be applied to the AC-PDPs 56, 56A, 57 and 57A for rendering the sizes of the discharge cells C and the non-discharge cells NC different from each other.

Embodiment 7

An AC-PDP 58 according to an embodiment 7 of the present invention is now described with reference to a plan view of FIG. 19 corresponding to FIG. 1. In order to avoid complication of illustration, FIG. 19 omits illustration of column electrodes W1 to Wm.

Figure 19:
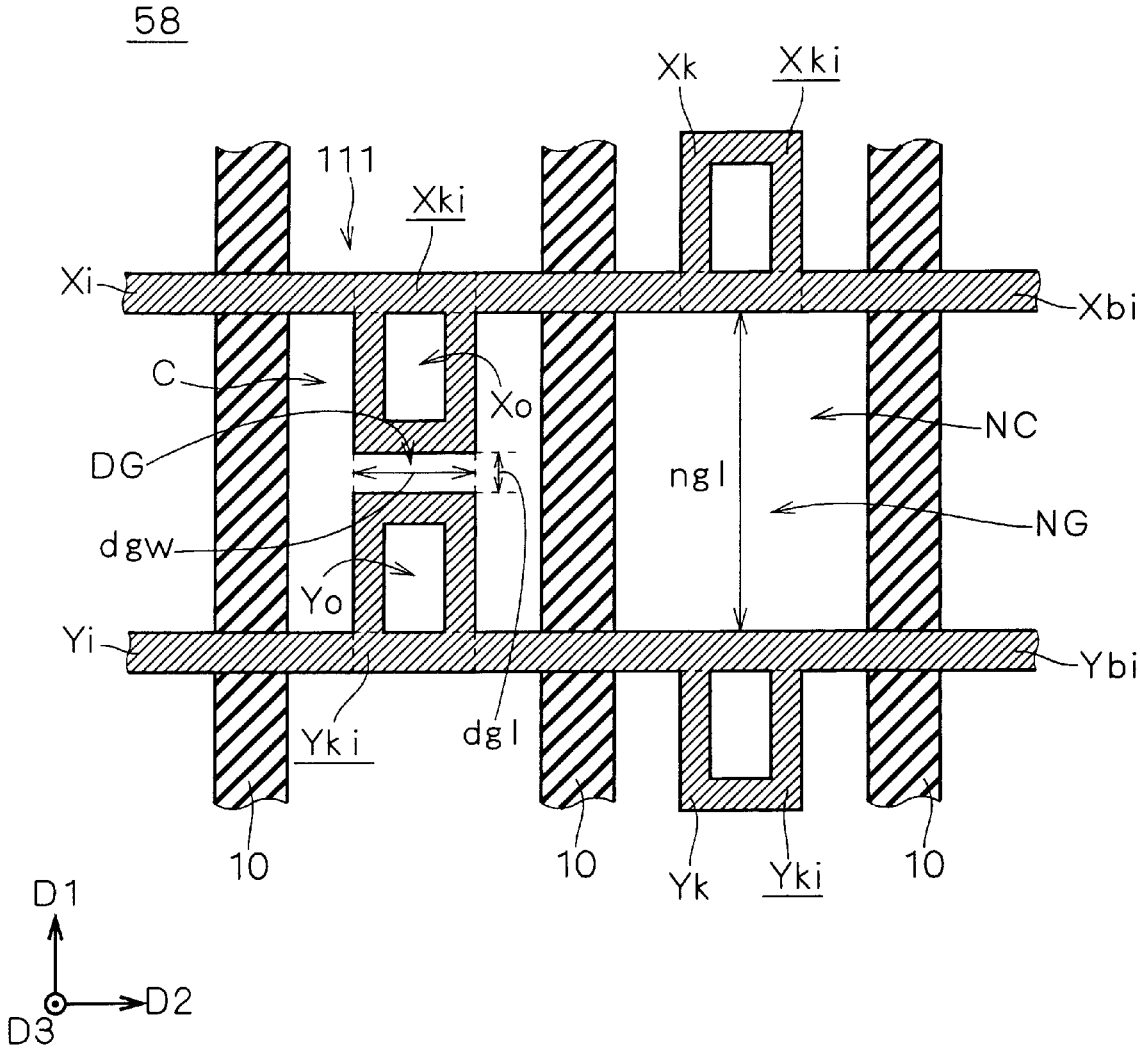
FIG. 19 is a plan view for illustrating the structure of an AC plasma display panel according to an embodiment 7 of the present invention.

As shown in FIG. 19, extension electrodes (second portions) Xk and Yk (the relation with bus electrodes Xbi and Ybi is clarified as "extension electrodes Xki and Yki" with subscripts i when particularly necessary) are arranged in the AC-PDP 58 in place of the aforementioned transparent electrodes Xt and Yt (see FIG. 1 etc.), on the same positions as the transparent electrodes Xt and Yt. In more detail, the extension electrodes Xk and Yk have sizes or outer dimensions equivalent to those of the transparent electrodes Xt and Yt and have square or O shapes provided with openings Xo and Yo in the centers thereof. In particular, the extension electrodes Xk and Yk and the bus electrodes Xb and Yb consist of an opaque conductive material.

In this case, the extension electrodes Xk and Yk and the bus electrodes Xb and Yb can be collectively formed by employing the same opaque metal material as that for the bus electrodes. Collective formation is enabled by vacuum deposition or printing, for example. Thus, it is possible to eliminate a step of forming the transparent electrodes Xt and Yt, whereby the total number of steps for forming row electrodes can be reduced/simplified as compared with the aforementioned AC-PDP 51 etc. Consequently, the cost can be reduced.

Figure 20:
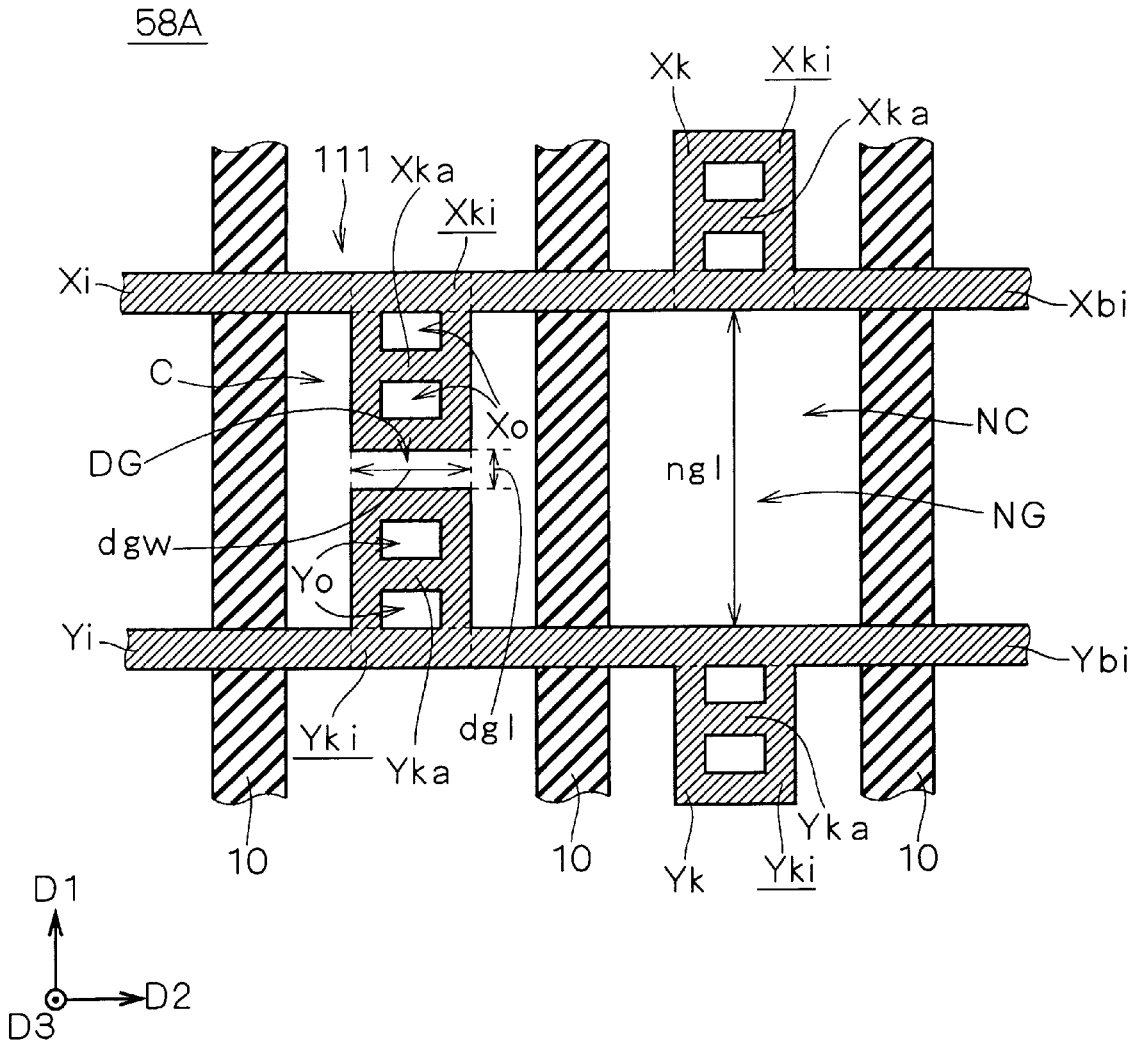
FIG. 20 is a plan view for illustrating another structure of the AC plasma display panel according to the embodiment 7.

While all row electrodes X1 to Xn and Y1 to Yn consist of an opaque conductive material in the AC-PDP 58 as described above, a larger quantity of visible light can be extracted since the openings Xo and Yo are provided in the extension electrodes Xk and Yk. Also when the extension electrodes Xk and Yk have such shapes, discharge can be sufficiently formed/sustained due to exudation resulting from spreading of field distribution from the electrodes upon voltage application. When the outer dimensions of the extension electrodes Xk and Yk are large, an AC-PDP 58A shown in FIG. 20 is also employable. As shown in FIG. 20, connecting portions Xka and Yka made of the aforementioned opaque conductive material may be provided on substantially central portions of square shapes of extension electrodes Xk and Yk along a second direction D2 as shown in FIG. 20. In the AC-PDP 58A, each of the extension electrodes Xk and Yk has two openings Xo or Yo.

In order to further increase the opening ratio of the extension electrodes Xk and Yk, the width of each portion of the extension electrodes Xk and Yk may be further reduced. In this case, however, the resistance values of the extension electrodes Xk and Yk are increased. In consideration of that (allowable) voltage drops in the row electrodes X1 to Xn and Y1 to Yn are decided by the resistance values of the row electrodes X1 to Xn and Y1 to Yn and the values of discharging currents flowing therein, the aforementioned voltage drops are increased in response to the increase of the resistance values of the extension electrodes Xk an Yk. Consequently, the driving voltage margin is reduced due to such increase of the voltage drops.

Figure 21:
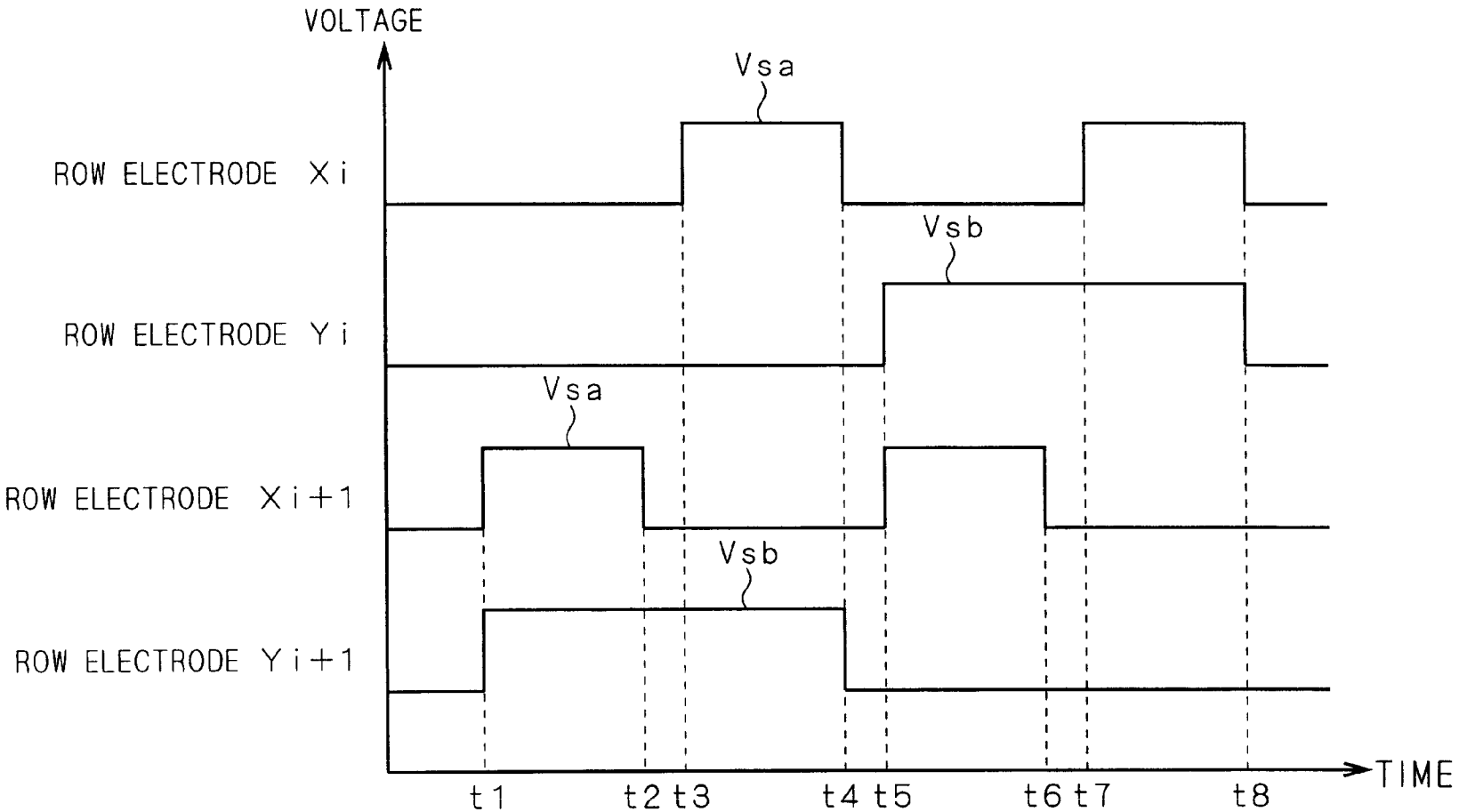
FIG. 21 is a timing chart for illustrating a method of driving the AC plasma display panel according to the embodiment 7.
Figure 22:
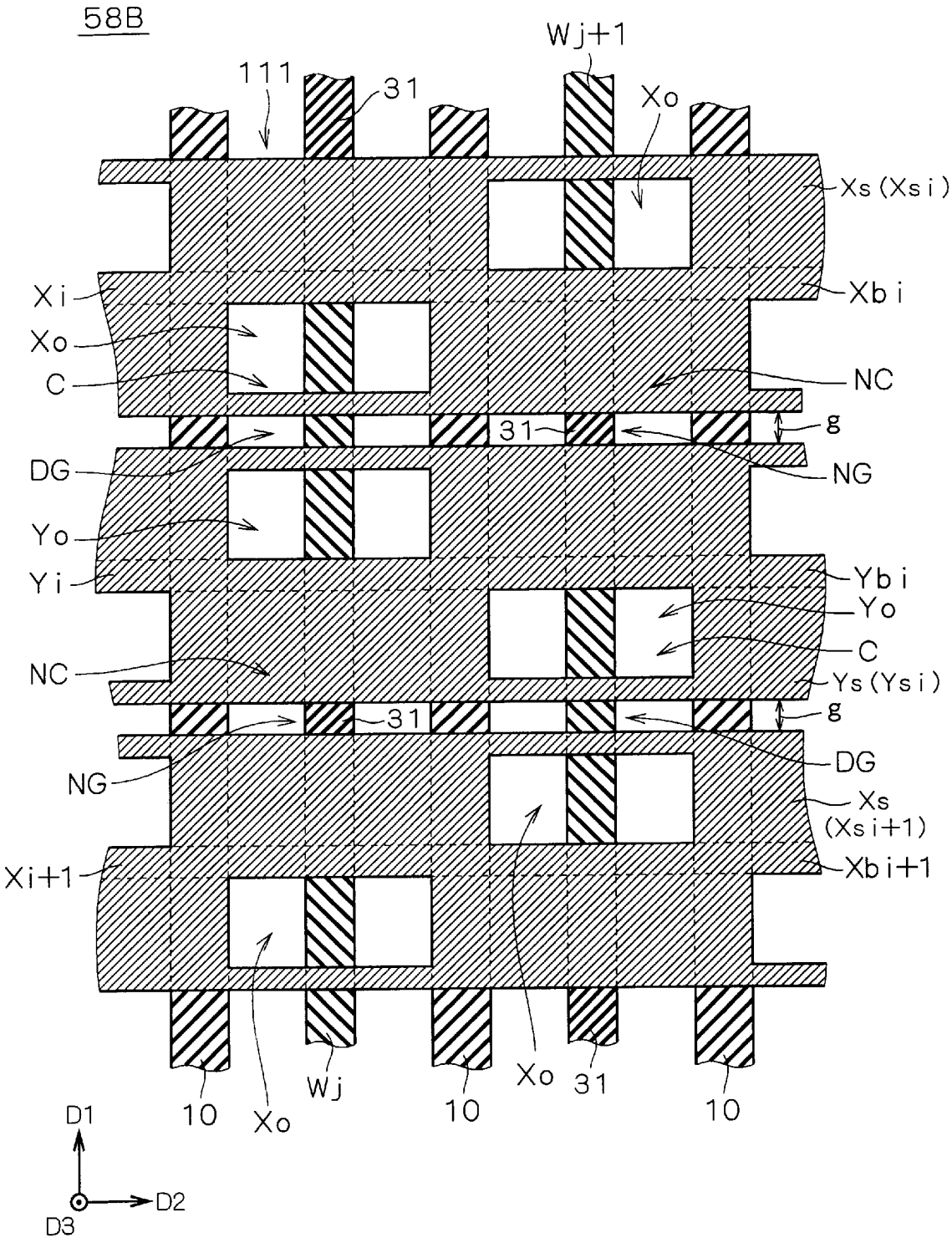
FIG. 22 is a plan view for illustrating still another structure of the AC plasma display panel according to the embodiment 7.

A driving method capable of stably operating the AC-PDP 58 or 58A by suppressing reduction of the driving voltage margin also when reducing the width of each portion of the extension electrodes Xk and Yk is now described. FIG. 21 is a timing chart for illustrating such a driving method in a sustain discharge period. As to a reset period and an address period, the conventional driving method shown in FIG. 30 or the like is applicable, for example. In order to facilitate understanding the following description, it is assumed that writing is executed on all discharge cells in the address period.

First, a sustain pulse Vsa is applied to a row electrode Xi+1 between times t1 and t2, and the sustain pulse Vsa is applied to a row electrode Xi between subsequent times t3 and t4. At this time, a sustain pulse Vsb is applied to a row electrode Yi+1 between the times t1 and t4. The sustain pulse Vsa is applied to the row electrode Xi+1 between times t5 and t6, and the sustain pulse Vsa is applied to the row electrode Xi between subsequent times t7 and t8. At this time, the sustain pulse Vsb is applied to the row electrode Yi between the times t5 and t8. Such sustain pulses Vsa and Vsb are applied prescribed numbers of times.

Due to the application of the sustain pulses Vsa and Vsb, sustain discharges are caused in a discharge cells C defined by the row electrodes Yi and Xi+1 at the times t1 and t6, while sustain discharges are formed in a discharge cells C defined by the row electrodes Xi+1 and Yi+1 at the times t2 and t5. Further, sustain discharges are caused in a discharge cells C defined by the row electrodes Xi and Yi at the times t3 and t5. At the times t1 and t7, sustain discharges are caused in discharge cells defined by the row electrode Xi and a row electrode Yi-1(supplied with the same voltage as the row electrode Yi+1) and defined by the row electrode Yi+1 and a row electrode Xi+2 (supplied with the same voltage as the row electrode Xi).

Noting the discharge cells C arranged on both sides of the row electrode Yi, for example, sustain discharges are formed separately between one side and the other side while deviating timing with respect to the row electrode Yi. In other words, discharges are not simultaneously formed in the discharge cells C arranged on one side of a bus electrode Ybi of the row electrode Yi and the discharge cells C arranged on the other side. Therefore, a discharging current of the discharge cells C defined by the row electrodes Yi and Xi+1 flows to the row electrode Yi at the times t1 and t6 while a discharging current of the discharge cells C defined by the row electrodes Yi and Xi flows to the discharge electrode Yi at the times t3 and t5. According to the driving method shown in FIG. 21, therefore, the instantaneous current flowing to the row electrode Yi can be halved as compared with the conventional driving method (see FIG. 30) in which discharging currents of all discharge cells C arranged on both sides of the row electrode Yi simultaneously flow. This point is proper as to all row electrodes X1 to Xn an Y1 to Yn, as a matter of course. Consequently, an equivalent driving voltage margin can be ensured also when the resistance values of the row electrodes X1 to Xn and Y1 to Yn are doubled, for example, by reducing the width of the extension electrodes Xk and Yk. Thus, stable driving of the AC-PDP 58 and 58A can be implemented while increasing the opening ratio of the extension electrodes Xk and Yk.

The transparent electrodes Xs and Ys of the aforementioned AC-PDP 56 (see FIG. 14) etc. may be replaced with electrodes consisting of an opaque conductive material. In this case, openings Xo and Yo are formed in portions of such electrodes consisting of an opaque conductive material located in discharge cells C for setting a prescribed opening ratio.

Japanese Patent Application Laid-Open No. 10-149774 (1998) discloses an AC-PDP prepared by forming the row electrodes 104 and 105 of the conventional AC-PDP 101 by only metal electrodes without employing transparent electrodes. In the AC-PDP disclosed in this gazette, a pair of (or two) row electrodes define a single display line, similarly to the conventional AC-PDP 101. Therefore, the driving method shown in FIG. 21 cannot be applied to this AC-PDP. This is because sustain discharge is formed in a plurality of discharge cells C forming a single display line while displacing timing every prescribed group in the driving method shown in FIG. 21. One side of discharge cells C arranged on both sides of the row electrode Yi corresponds to the aforementioned group, for example. In other words, the AC-PDP disclosed in the gazette cannot form sustain discharges in a grouped manner in discharge cells C forming a single display line in a grouped manner.

Embodiment 8

An AC-PDP 61 according to an embodiment 8 of the present invention is now described with reference to a typical plan view shown in FIG. 23. The AC-PDP 61 is characterized in bus electrodes Xb and Yb, and hence FIG. 23 extracts and illustrates such a point. As to elements other than the bus electrodes Xb and Yb, those equivalent to the elements of the AC-PDP 51 are applicable, for example.

Figure 23:
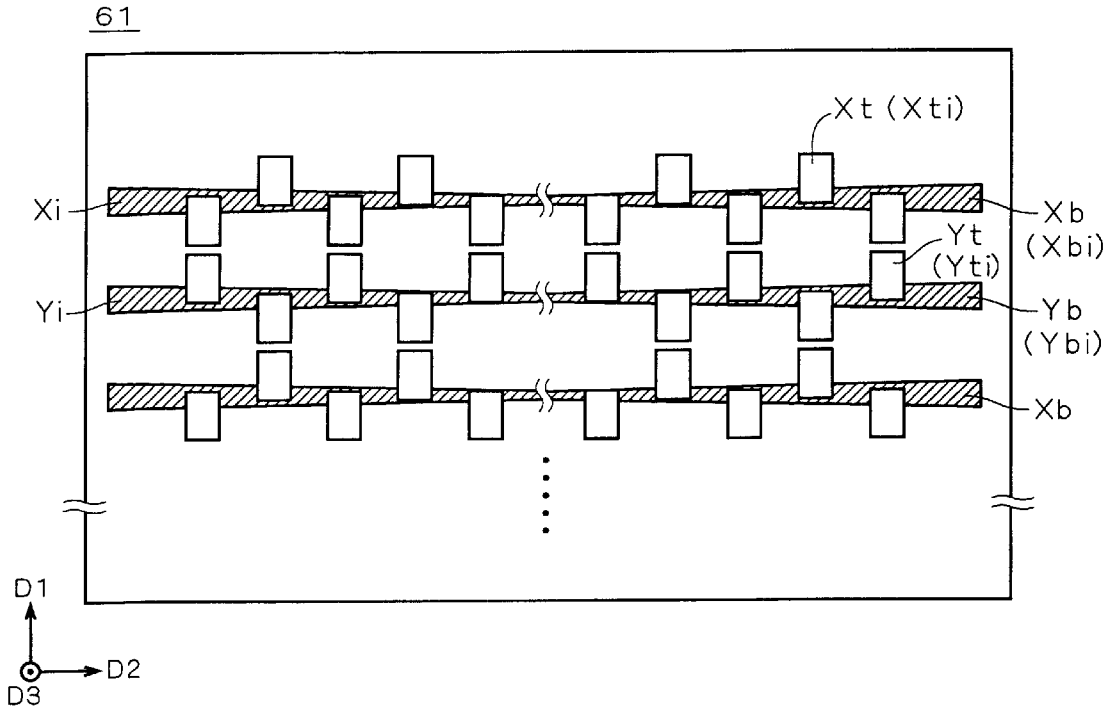
FIG. 23 is a plan view for illustrating the structure of an AC plasma display panel according to an embodiment 8 of the present invention.

As understood by comparing FIG. 23 with the aforementioned FIG. 1, the widths or dimensions of the bus electrodes Xb and Yb in the direction perpendicular to the longitudinal direction are constant in the AC-PDP 51, while the widths of the bus electrodes Xb and Yb are smaller toward the centers and larger toward respective end portions in the AC-PDP 61. In more detail, the widths of the bus electrodes Xb and Yb of the AC-PDP 61 are substantially equal to those of the bus electrodes Xb and Yb of the AC-PDP 51 around the center of the AC-PDP and larger toward the respective end portions. Therefore, the bus electrodes Xb and Yb of the AC-PDP 61 are lower in resistance value than the bus electrodes Xb and Yb of the AC-PDP 51 as a whole.

According to the AC-PDP 61, therefore, voltage drops caused by the bus electrodes Xb and Yb can be reduced due to the resistance values lower than those of the bus electrodes Xb and Yb of the AC-PDP 51. Consequently, the driving voltage margin can be enlarged following reduction of the aforementioned voltage drops, so that the AC-PDP 61 can be more stably driven.

Figure 24:
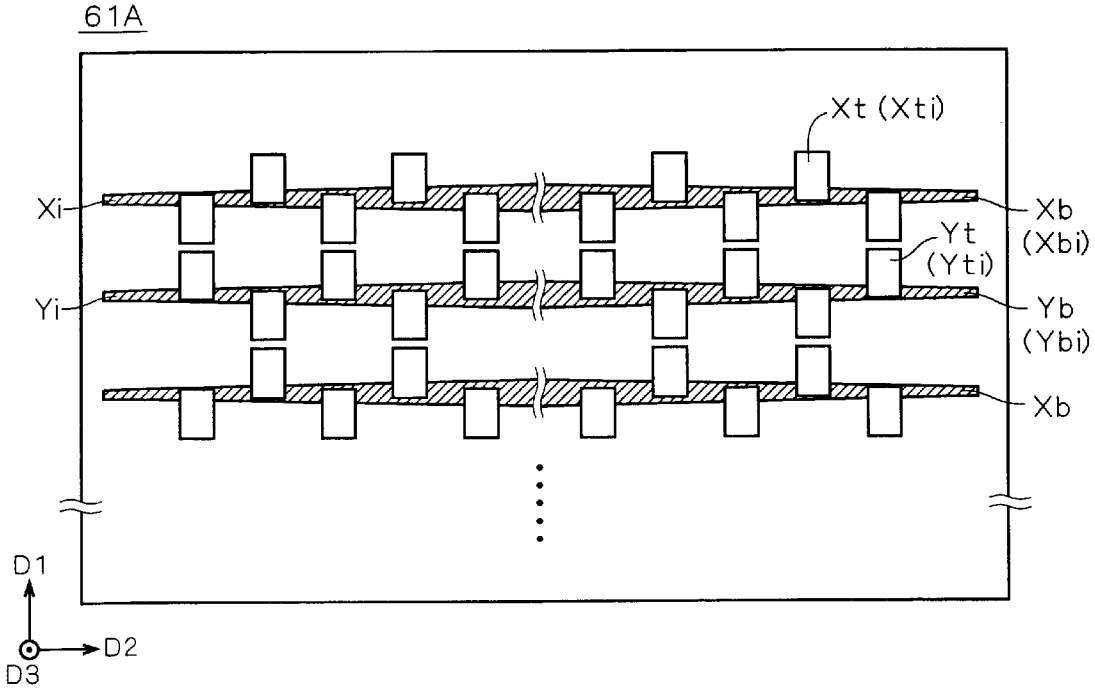
FIG. 24 is a plan view for illustrating another structure of the AC plasma display panel according to the embodiment 8.

In order to attain the effect of reducing the voltage drops by the bus electrodes Xb and Yb, the shapes of the bus electrodes Xb and Yb of the AC-PDP 61 may be reversed on the centers and the respective end portions. In other words, the widths of the bus electrodes Xb and Yb may be set substantially equal to those of the bus electrodes Xb and Yb of the AC-PDP 51 around ends of the AC-PDP and larger toward the centers, as in an AC-PDP 61A shown in FIG. 24. In particular, a prescribed voltage is supplied to each of row electrodes Xi and Yi from ends of bus electrodes Xbi and Ybi and hence voltage drops around the center causing large voltage drops due to separation from the end portions can be remarkably reduced in the AC-PDP 61A. Therefore, the aforementioned driving voltage margin can be further enlarged as compared with the aforementioned AC-PDP 61, so that the AC-PDP 61A can be more stably driven.

In the AC-PDP 61 and 61A, luminescence from discharge cells C is blocked due to the increased widths of the bus electrodes Xb and Yb and hence luminance is reduced below that in the AC-PDP 51 or the like. A CRT (cathode ray tube) display may have a luminance ratio exceeding 1:2 between a peripheral portion and a central portion of a screen, and visuality is not remarkably reduced also when supplying such a degree of luminance ratio in the AC-PDP. In other words, it can also be said that the AC-PDP 61 having central luminance higher than that on right and left end portions is more practical than the AC-PDP 61A in view of visuality.

Therefore, the shapes of the bus electrodes Xb and Yb may be properly defined on the basis of enlargement of the driving voltage margin and attainment of visuality. The shapes of the bus electrodes Xb and Yb according to the embodiment 8 are applicable to each of the aforementioned AC-PDPs.

Other Modifications

While the transparent electrodes Xt and Yt etc. are square in the aforementioned AC-PDP 51 etc., another shape is also employable so far as the aforementioned discharge gaps DG are formable. This also applies to the extension electrodes Xk and Yk of the AC-PDPs 58 and 58A.

While the AC-PDP 51 or the like employs the front glass substrate 102 as a display surface, the rear glass substrate 103 may alternatively be employed as a display surface by forming the column electrodes W1 to Wm as transparent electrodes. In this case, the transparent electrodes Xt and Yt etc. may be prepared from an opaque electrode material to be formed as such an electrode pattern that the electrodes Xt and Yt etc. and the bus electrodes Xb1 to Xbn and Yb1 to Ybn etc. are integrated with each other.

Further, the technical idea of the AC-PDP 51 etc. is also applicable to an opposite two-electrode type AC-PDP. In this case, discharge cells and non-discharge cells can be formed by controlling the thickness of discharge spaces between two opposite electrodes (with the aforementioned black insulators 30 or discharge suppressors 31, for example).

While the invention has been shown and described in detail, the foregoing description is in all aspects illustrative and not restrictive. It is therefore understood that numerous modifications and variations can be devised without departing from the scope of the invention.

What is claimed is:

1. An AC plasma display panel comprising:

a plurality of discharge cells including first and second adjacent electrodes defining discharge gaps capable of forming desired discharge and arranged on a same plane; and a plurality of non-discharge cells including said first and second adjacent electrodes defining non-discharge gaps harder to form discharge than said discharge gaps and arranged on said same plane, wherein said discharge gaps are arranged adjacently to each other through at least one said non-discharge gap at least in a direction parallel to a display line;

wherein one of said first and second adjacent electrodes functions as a scanning electrode, and the other of said first and second adjacent electrodes functions as an electrode other than said scanning electrode.

2. The AC plasma display panel according to claim 1, further comprising:

a first substrate;

a second substrate opposed to said first substrate at a prescribed distance;

a plurality of barrier ribs dividing a space between said first substrate and said second substrate into a plurality of discharge spaces;

said first electrode and said second electrode each including a strip first portion extending in parallel with said display line and a plurality of second portions connected to said first portion and extending toward said discharge cells, and arranged on the side of said first substrate;

a dielectric substance covering at least one of said first and second electrodes; and a plurality of strip third electrodes each arranged on the side of said second substrate in a direction and having an orthogonal projection intersecting each said first portion of said first and second electrodes for defining said discharge cells and said non-discharge cells with said first and second electrodes, wherein said discharge gaps are formed by both edges of each said second portion of said first and second electrodes opposed to each other in said discharge cells, and said non-discharge gaps are formed by both edges of a portion of each said first portion of said first and second electrodes opposed through said non-discharge cells.

3. The AC plasma display panel according to claim 1, further comprising:

a first substrate;

a second substrate opposed to said first substrate at a prescribed distance;

a plurality of barrier ribs dividing a space between said first substrate and said second substrate into a plurality of discharge spaces;

said first electrode and said second electrode each including a strip first portion extending in parallel with said display line and a strip second portion connected to said first portion and extending on both sides of said first portion with respect to a direction perpendicular to a longitudinal direction of said first portion to extend along said longitudinal direction of said first portion, and arranged on the side of said first substrate;

a dielectric substance covering at least one of said first and second electrodes;

a plurality of strip third electrodes each arranged on the side of said second substrate in a direction and having an orthogonal projection intersecting with each said first portion of said first and second electrodes for defining said discharge cells and said non-discharge cells with said first and second electrodes; and a discharge suppressor arranged at least on an orthogonal projection intersection of a gap between adjacent ones of said second portions and said third electrodes for defining one of said non-discharge cells, wherein said discharge gaps are formed by both edges of a portion of each said second portion of said first and second electrodes opposed in said discharge cells, and said non-discharge gaps are formed by both edges of a portion of each said second portion of said first and second electrodes opposed in said non-discharge cells.

4. The AC plasma display panel according to claim 2, wherein at least one of said discharge cells is larger than at least one of said non-discharge cells when viewing said AC plasma display panel from the side of said first or second substrate.

5. The AC plasma display panel according to claim 3, wherein at least one of said discharge cells is larger than at least one of said non-discharge cells when viewing said AC plasma display panel from the side of said first or second substrate.

6. The AC plasma display panel according to claim 2, wherein said plurality of barrier ribs include a plurality of strip barrier ribs arranged along a longitudinal direction of said third electrodes to separate adjacent ones of said third electrodes from each other, and at least one space between two adjacent ones of said strip barrier ribs is wider in a portion defining one of said discharge cells than in a portion defining one of said non-discharge cells.

7. The AC plasma display panel according to claim 3, wherein said plurality of barrier ribs include a plurality of strip barrier ribs arranged along a longitudinal direction of said third electrodes to separate adjacent ones of said third electrodes from each other, and at least one space between two adjacent ones of said strip barrier ribs is wider in a portion defining one of said discharge cells than in a portion defining one of said non-discharge cells.

8. The AC plasma display panel according to claim 2, wherein a space between both edges of said first portions of said first and second electrodes opposed through one of said discharge gaps is wider than a space between said both edges of said first portions opposed through one of said non-discharge cells.

9. The AC plasma display panel according to claim 3, wherein a space between both edges of said first portions of said first and second electrodes opposed through one of said discharge gaps is wider than a space between said both edges of said first portions opposed through one of said non-discharge cells.

10. The AC plasma display panel according to claim 2, wherein said discharge cells are equal to said non-discharge cells in area when viewing said AC plasma display panel from the side of said first or second substrate.

11. The AC plasma display panel according to claim 1, further comprising:

a first substrate;

a second substrate opposed to said first substrate at a prescribed distance;

a plurality of barrier ribs dividing a space between said first substrate and said second substrate into a plurality of spaces;

said first electrode and said second electrode each including a strip first portion extending in parallel with said display line and a plurality of second portions connected to said first portion and extending on both sides of said first portion with respect to a direction perpendicular to a longitudinal direction of said first portion, and arranged on the side of said first substrate;

a dielectric substance covering at least one of said first and second electrodes; and a plurality of strip third electrodes each arranged on the side of said second substrate in a direction and having an orthogonal projection intersecting with each said first portion of said first and second electrodes for defining said discharge cells and said non-discharge cells with said first and second electrodes, wherein said discharge gaps are formed by both edges of each said second portion of said first and second electrodes opposed to each other in said discharge cells, and said non-discharge gaps are formed by both edges of each said second portion of said first and second electrodes opposed to each other through said non-discharge cells.

12. The AC plasma display panel according to claim 11, wherein at least one of said discharge cells is larger than at least one of said non-discharge cells when viewing said AC plasma display panel from the side of said first or second substrate.

13. The AC plasma display panel according to claim 11, wherein said plurality of barrier ribs include a plurality of strip barrier ribs arranged along a longitudinal direction of said third electrodes to separate adjacent ones of said third electrodes from each other, and at least one space between two adjacent ones of said strip barrier ribs is wider in a portion defining one of said discharge cells than in a portion defining one of said non-discharge cells.

14. The AC plasma display panel according to claim 2, wherein said first and second portions are made of an opaque conductive material, and said second portions have an opening.

15. The AC plasma display panel according to claim 3, wherein said first and second portions are made of an opaque conductive material, and said second portion has an opening.

16. The AC plasma display panel according to claim 11, wherein said first and second portions are made of an opaque conductive material, and said second portions have an opening.

17. The AC plasma display panel according to claim 1, further comprising:

a black insulator arranged on a portion other than'said discharge cells.

18. The AC plasma display panel according to claim 17, wherein said black insulator is arranged on a region corresponding to one of said non-discharge cells in a surface of said first substrate closer to said discharge spaces.

19. The AC plasma display panel according to claim 17, wherein said black insulators is arranged on said second substrate.

20. The AC plasma display according to claim 2, wherein a width of said first portion is uniform along a longitudinal direction of said first portion.

* * * * *